US009460656B2

(12) United States Patent
Shim et al.

(10) Patent No.: US 9,460,656 B2
(45) Date of Patent: Oct. 4, 2016

(54) ORGANIC LIGHT EMITTING DISPLAY DEVICE HAVING REPAIR STRUCTURE

(71) Applicant: LG Display Co., Ltd., Seoul (KR)

(72) Inventors: JongSik Shim, Gyeonggi-do (KR); ChangHo Oh, Seoul (KR); Joon-Min Park, Gyeonggi-do (KR); Haeyoon Kang, Gyeonggi-do (KR); SiKyu Lee, Daejeon (KR)

(73) Assignee: LG Display Co., Ltd., Seoul (KR)

( * ) Notice: Subject to any disclaimer, the term of this patent is extended or adjusted under 35 U.S.C. 154(b) by 1 day.

(21) Appl. No.: 14/557,660

(22) Filed: Dec. 2, 2014

(65) Prior Publication Data

US 2015/0161943 A1 Jun. 11, 2015

(30) Foreign Application Priority Data

Dec. 9, 2013 (KR) ..... 10-2013-0152657

(51) Int. Cl.
*G09G 3/30* (2006.01)
*G09G 3/32* (2016.01)

(52) U.S. Cl.
CPC .... *G09G 3/3225* (2013.01); *G09G 2300/0426* (2013.01); *G09G 2300/0439* (2013.01); *G09G 2300/0842* (2013.01); *G09G 2320/0233* (2013.01); *G09G 2320/043* (2013.01); *G09G 2330/08* (2013.01); *G09G 2330/10* (2013.01)

(58) Field of Classification Search
CPC ..... G09G 3/3225; G09G 2300/08; G09G 2300/0426; G09G 2300/0439; G09G 2320/043; G09G 2320/0233
USPC ..... 345/76–98, 204–214; 257/43, 40, 91, 257/211; 349/38; 427/258
See application file for complete search history.

(56) References Cited

U.S. PATENT DOCUMENTS 7,517,551 B2 * 4/2009 Arai ..... C23C 14/12 427/258
8,106,896 B2 * 1/2012 Hwang ..... G09G 3/006 345/204
8,436,376 B2 * 5/2013 Bang ..... H01L 51/5228 257/91
8,698,158 B2 * 4/2014 Hur ..... G02F 1/136213 257/59
9,291,870 B2 * 3/2016 Shin ..... H01L 23/3677
2004/0090530 A1 * 5/2004 Gaylord ..... H04N 1/32128 348/207.99
2005/0231455 A1 * 10/2005 Moon ..... G09G 3/3648 345/89
2006/0256248 A1 * 11/2006 Baek ..... G02F 1/136286 349/42
2008/0116501 A1 * 5/2008 Lin ..... H01L 27/124 257/315

(Continued)

*Primary Examiner* — Prabodh M Dharia
(74) *Attorney, Agent, or Firm* — Morgan, Lewis & Bockius LLP

(57) ABSTRACT

The present invention provides an organic light emitting display device that includes a display panel in which an organic light emitting diode and a driving circuit are disposed in each pixel area of a first pixel and a second pixel which are certain pixels among a plurality of pixels, a floating pattern insulated from at least one of a first electrode of the organic light emitting diode of the first pixel and a first electrode of the organic light emitting diode of the second pixel is formed in the display panel, or a connection pattern for electrically connecting the first electrode of the organic light emitting diode of the first pixel with the first electrode of the organic light emitting diode of the second pixel is formed.

25 Claims, 33 Drawing Sheets

(56) References Cited

U.S. PATENT DOCUMENTS

2008/0212245 A1* 9/2008 Choi ..... H01L 27/0296 361/56
2008/0231583 A1* 9/2008 Chen ..... G02F 1/136259 345/98
2008/0297042 A1* 12/2008 Ahn ..... H01L 27/3251 313/504
2009/0026445 A1* 1/2009 Noh ..... H01L 51/0541 257/40
2009/0152552 A1* 6/2009 Ku ..... G02F 1/136213 257/59
2010/0002161 A1* 1/2010 Shin ..... G02F 1/134363 349/38
2010/0238095 A1* 9/2010 Zhang ..... H01L 27/0266 345/82
2011/0043499 A1* 2/2011 Cok ..... G09G 3/006 345/205
2012/0098805 A1* 4/2012 Kubota ..... G09G 3/003 345/205
2013/0215354 A1* 8/2013 Yoon ..... G02F 1/1309 349/46
2013/0240914 A1* 9/2013 Jin ..... H01L 27/3246 257/88
2013/0328020 A1* 12/2013 Lee ..... H01L 51/56 257/40
2014/0132584 A1* 5/2014 Kim ..... H01L 27/3276 345/212
2014/0312345 A1* 10/2014 Miyanaga ..... H01L 29/45 257/43
2015/0137099 A1* 5/2015 Choi ..... G09G 3/3258 257/40

* cited by examiner

ORGANIC LIGHT EMITTING DISPLAY DEVICE HAVING REPAIR STRUCTURE

CROSS-REFERENCE TO RELATED APPLICATION

This application claims priority from and the benefit under 35 U.S.C. §119(a) of Korean Patent Application No. 10-2013-0152657, filed on Dec. 9, 2013, which is hereby incorporated by reference for all purposes as if fully set forth herein.

BACKGROUND OF THE INVENTION

1. Field of the Invention

The present invention relates to an organic light emitting display device having a repair structure.

2. Description of the Related Art

Organic light emitting display devices, which use organic light emitting diodes (OLED) that emit light by themselves, and which has recently risen to become a popular form of display device, have many great advantages including quick response, high luminous efficiency, a high degree of brightness, and a large viewing angle.

In organic light emitting display devices, pixels including an organic light emitting diode are arranged in the form of a matrix, and the brightness of pixels selected by a scan signal is controlled according to the gradation of data.

Each pixel with organic light emitting display device has an organic light emitting diode, and a drive circuit for driving the organic light emitting diode.

A display panel defined with a plurality of pixels having such a structure requires a manufacturing process with various steps. At this time, impurities resulting from the various steps may be generated on the pixel, which cause defects such as bright spots or dark spots.

These pixel defects may extremely deteriorate the image quality, and in serious cases the display panel should be discarded.

Accordingly, a method for effectively repairing the pixel defects is urgently required.

SUMMARY OF THE INVENTION

Accordingly, the present invention is directed to a organic light emitting display device that substantially obviates one or more of the problems due to limitations and disadvantages of the related art.

An object of the present invention is to provide an organic light emitting display device that has a repair structure by which the pixel defects can be repaired, and an organic light emitting display device in which the pixel defects have been repaired.

Another object of the present invention is to provide an organic light emitting display device that has a repair structure by which a circuit defect which causes pixel defects can be repaired, and an organic light emitting display device in which a circuit defect has been repaired.

A further object of the present invention is to provide an organic light emitting display device that has a repair structure by which a light emitting defect which causes pixel defects can be repaired, and an organic light emitting display device in which a light emitting defect has been repaired.

Yet another object of the present invention is to provide an organic light emitting display device that enables to compensate for a reduction of the brightness due to a repair of a circuit defect or a light emitting defect.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purposed of the present invention, as embodied and broadly described, an organic light emitting display device includes a display panel in which a plurality of pixels defined with data lines and gate lines formed thereon are disposed; a data driving unit that supplies a data voltage to the data lines; and a gate driving unit that supplies a scan signal to the gate lines; wherein an organic light emitting diode and a driving circuit are disposed in each of the plurality of pixels, and, in a first pixel and a second pixel among the plurality of pixels, a floating pattern insulated from at least one of a first electrode of the organic light emitting diode of the first pixel and a first electrode of the organic light emitting diode of the second pixel is formed, or a connection pattern for electrically connecting the first electrode of the organic light emitting diode of the first pixel with the first electrode of the organic light emitting diode of the second pixel is formed.

In another aspect, an organic light emitting display device includes a display panel in which a plurality of pixels defined with data lines and gate lines formed thereon are disposed; a data driving unit that supplies a data voltage to the data lines; and a gate driving unit that supplies a scan signal to the gate lines; wherein an organic light emitting diode and a driving circuit are disposed in an emission area and an non-emission area of the plurality of pixels, and at least one pixel, in which a first electrode of the organic light emitting diode is cut to thereby have an emission area of a smaller size than emission areas of other pixels for emitting light of the same color, exists in the display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Figure 1:
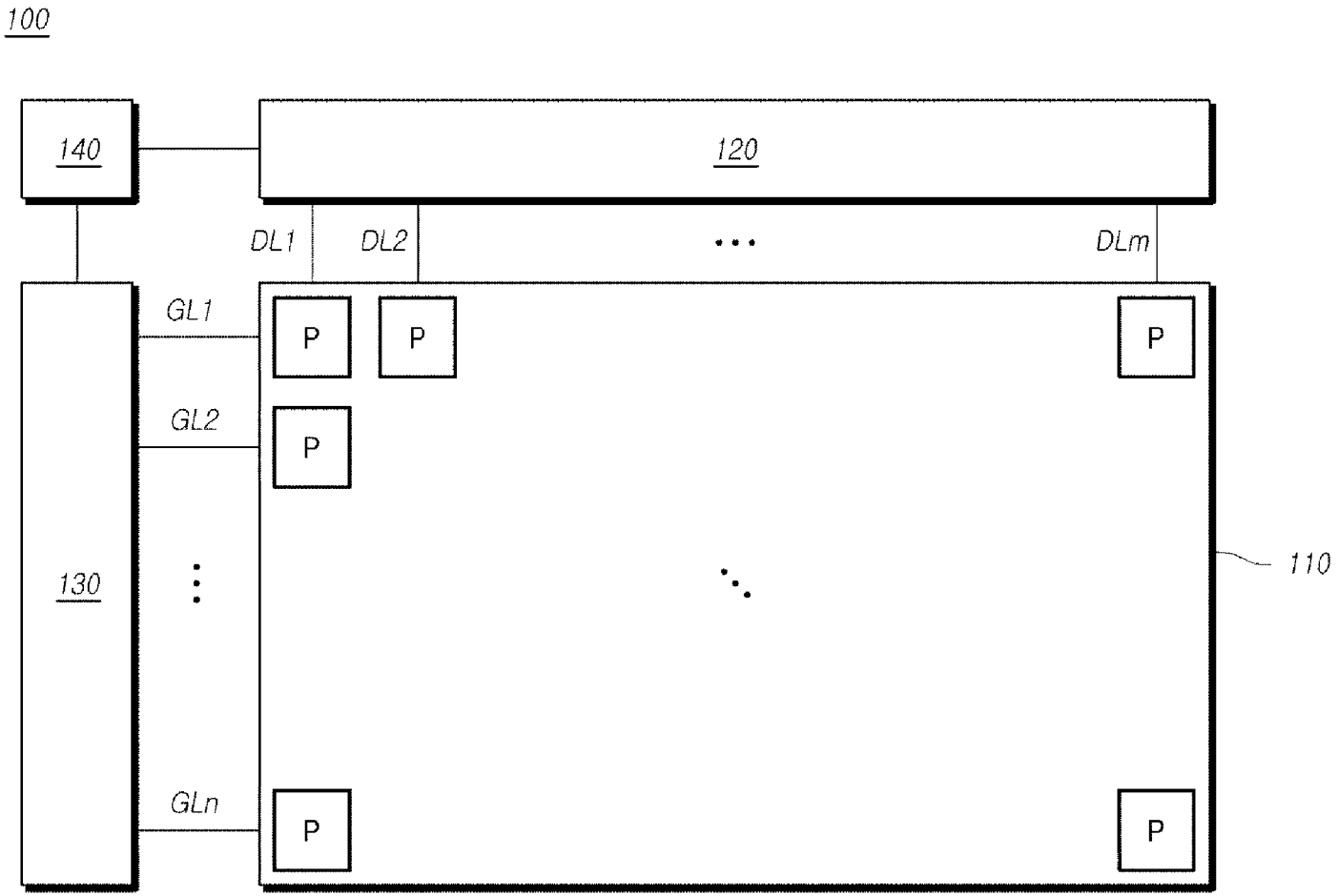
FIG. 1 schematically illustrates a system of an organic light emitting display device according to example embodiments.

Hereinafter, a few embodiments of the present invention will be described with reference to the accompanying drawings. Hereinafter, in relation to reference numerals with respect to elements of the drawings, the identical elements consequently bear the same reference numerals of the previous drawings. Further, in the following description of the present invention, a detailed description of well-known functions and configurations incorporated herein will be omitted when it may make the subject matter of the present invention rather unclear.

In addition, terms, such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, a third component may be "connected," "coupled," and "joined" between the first and second components, although the first component may be directly connected, coupled or joined to the second component.

FIG. 1 schematically illustrates a system of an organic light emitting display 100 device according to example embodiments.

Referring to FIG. 1, the organic light emitting display device 100 according to example embodiments includes a display panel 110 that includes a plurality of pixels P disposed at every intersections of a plurality of data lines DL1 to DLm formed in one direction and a plurality of gate lines GL1 to GLn formed in the other direction to intersect with the plurality of data lines DL1 to DLm, a data driving unit 120 for supplying a data voltage through the plurality of data lines DL1 to DLm, a gate driving unit 130 for supplying scan signals through the plurality of gate lines GL1 to GLn, and a timing controller 140 for controlling a driving timing of the data driving unit 120 and the gate driving unit 130.

Each of the plurality of pixels P disposed in the display panel 110 is provided with an organic light emitting diode OLED and a driving circuit DRC for driving the organic light emitting diode.

The driving circuit disposed at each pixels may basically include a driving transistor DT for supplying a current to the organic light emitting diode OLED, transistors such as a switching transistor for supplying a data voltage to a gate node of the driving transistor DT, a storage capacitor for maintaining a data voltage for one frame, and may further include a sensing transistor for supplying a reference voltage Vref to a source node (or a drain node) of the driving transistor DT. This pixel structure will be described in detail with reference to FIGS. 2 and 3.

The data driving unit 120 may include a plurality of data driving integrated circuit (which also may be referred to as a source driving integrated circuit), and the plurality of data driving integrated circuit may be coupled to a bonding pad of the display panel 110 in the form of tape automated bonding (TAB) or chip-on-glass (COG), may be directly formed on the display panel 110 to be a gate-in-panel (GIP) type, or may be integrated into the display panel 110.

The gate driving unit 130 may be positioned on one side of the display panel 110 as shown in FIG. 1, or two gate driving units may be positioned on both sides of the display panel 110 according to a driving type.

In addition, the gate driving unit 130 may include a plurality of gate driving integrated circuits, and these gate driving integrated circuits may be coupled to a bonding pad of the display panel 110 in the form of tape automated bonding (TAB) or chip-on-glass (COG), may be directly formed on the display panel 110 to be a gate-in-panel (GIP) type, or may be integrated into the display panel.

The timing controller 140 controls driving timing of the data driving unit 120 and the gate driving unit 130, and outputs various control signals to do so.

Hereinafter, a pixel structure in the pixels will be described in more detail.

Figure 2:
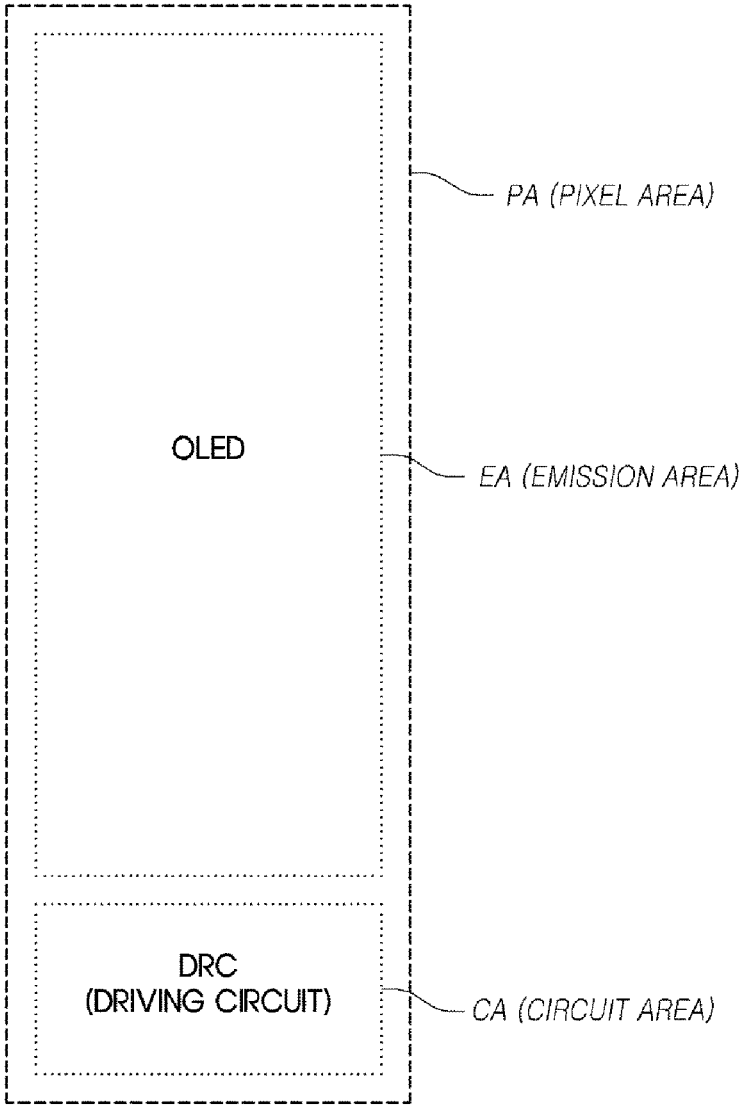
FIG. 2 illustrates a basic pixel structure of an organic light emitting display device according to example embodiments.

FIG. 2 illustrates a basic pixel structure of an organic light emitting display device 100 according to example embodiments.

Referring to FIG. 2, a pixel area PA of each of a plurality of pixels P defined in the display panel 110 of the organic light emitting display device 100 according to example embodiments may be comprised of an emission area EA where an organic light emitting diode OLED emits light, and a circuit area CA where a driving circuit DRC for driving the organic light emitting diode GELD is disposed.

A light emitting unit including the organic light emitting diode OLED is disposed in the emission area EA.

The circuit area CA is not an emission area where a circuit unit including the driving circuit DRC for driving the organic light emitting diode OLED is disposed.

Meanwhile, although the emission area EA and the circuit area CA are separately illustrated in FIG. 2, this is just for convenience of explanation, and the emission area EA and the circuit area CA may be overlapped with each other according to another example embodiment. For example, in a case of an upper light emitting type, the circuit unit may be disposed below the light emitting unit so that the emission area EA and the circuit area CA overlap with each other.

As described above, the driving circuit DRC disposed in each circuit area CA may basically include a driving transistor DT for supplying a current to the organic light emitting diode OLED, transistors such as a switching transistor (hereinafter referred to as a second transistor T2) for supplying a data voltage to a gate node of the driving transistor DT, a storage capacitor Cstg for maintaining a data voltage for one frame, and may further include a sensing transistor (hereinafter referred to as a first transistor T1) for supplying a reference voltage Vref to a source node (or a drain node) of the driving transistor DT.

Figure 3:
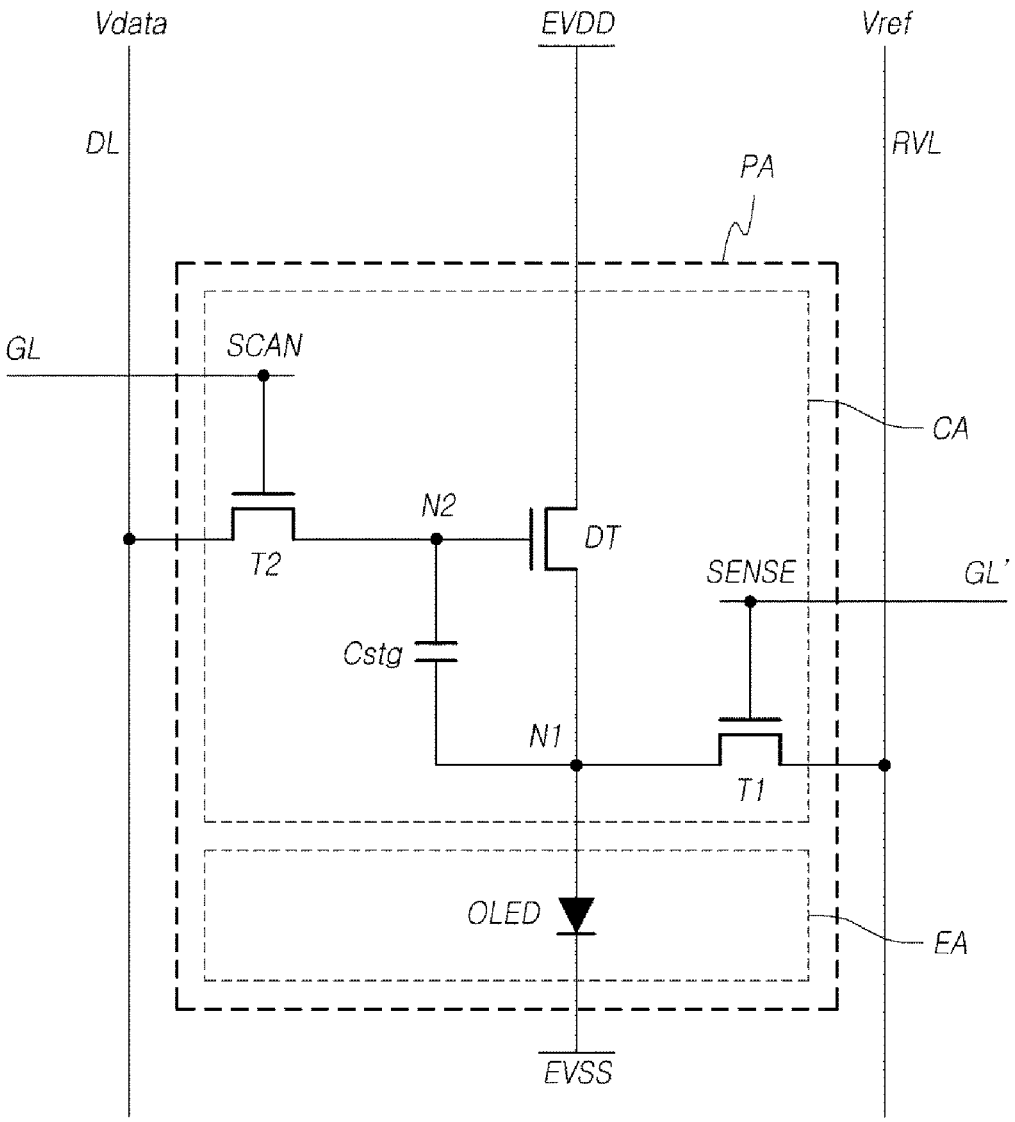
FIGS. 3 and 4 illustrate an example of an equivalent circuit diagram of pixels of an organic light emitting display device according to example embodiments.
Figure 4:
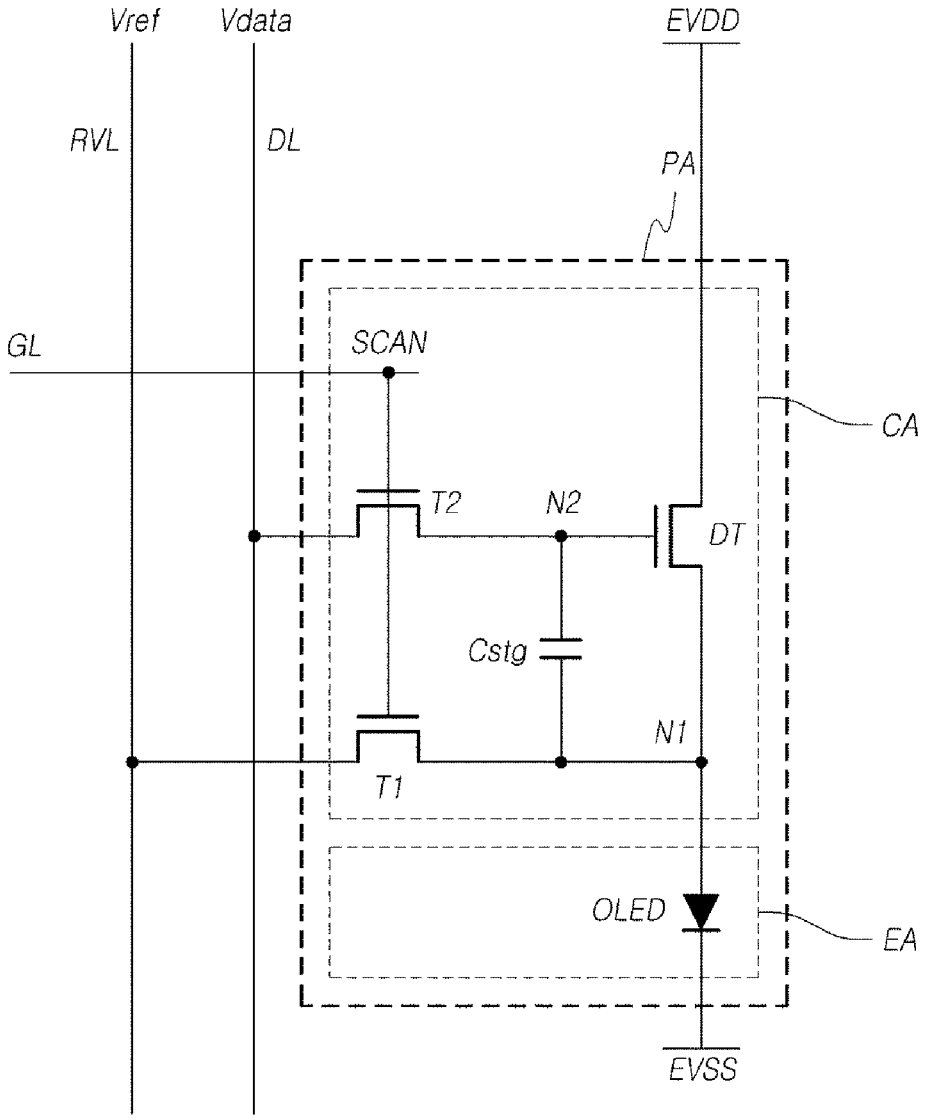

Two types of pixel having a 3T1C-structure that has three transistors DT, T1 and T2, and one capacitor Cstg are illustrated in FIGS. 3 and 4.

FIGS. 3 and 4 illustrate an example of an equivalent circuit diagram of pixels of an organic light emitting display device 100 according to example embodiments.

Referring to FIG. 3, a circuit area CA in a pixel area PA may include a driving transistor DT for supplying a current to the organic light emitting diode OLED, a first transistor T1 connected between a first node N1 of the driving transistor DT and a reference voltage line RVL for supplying a reference voltage Vref, a second transistor T2 connected between a second node N2 of the driving transistor DT and a data line DL, and a storage capacitor Cstg connected between the first node N1 and the second node N2 of the driving transistor DT in order to play a role of maintaining a voltage for one frame.

The first transistor T1 is controlled by a first scan signal (hereinafter referred to as a sensing signal SENSE) which is supplied through a first gate line (GL') to thereby supply the reference voltage Vref to the first node N1 of the driving transistor DT. The first transistor T1 may be used to sense a voltage of the first node N1 of the driving transistor DT when the corresponding pixel operates in a sensing mode in order for pixel compensation. For such a reason, the first transistor T1 may be referred to as a sensing transistor.

The second transistor T2 is controlled by a second scan signal (hereinafter referred to as a scan signal SCAN) which is supplied through a second gate line (GL) to thereby apply a data voltage Vdata to the second node N2 of the driving transistor DT. The driving transistor DT may be turned on or off by the data voltage applied to the second node N2 of the driving transistor DT to thereby control the supply of a current to the organic light emitting diode OLED. For this reason, the second transistor T2 may be referred to as a switching transistor.

That is, in the pixel structure of FIG. 3, two gate lines GL and GL' are provided, and the first transistor T1 and the second transistor T2 are controlled by different signals (the sensing signal and the scan signal) through different gate lines GL and GL', respectively. For this reason, the pixel structure of FIG. 3 is referred to as "a two-scan based pixel structure".

As described above, when each pixel had a two-scan based pixel structure, the driving unit 130 in FIG. 1 may be implemented to be divided into a gate driving unit for outputting a scan signal, and a gate driving unit for outputting a sensing signal, and the n gate lines GL1 to GLn may be formed to be divided into gate lines GL1 to GLn for supplying a scan signal, and gate lines GL1' to GLn' for supplying a sensing signal.

Meanwhile, referring to FIG. 4, a circuit area CA in a pixel area PA is similar to the pixel structure of FIG. 3 in that it includes a driving transistor DT for supplying a current to the organic light emitting diode OLED, a first transistor T1 connected between a first node N1 of the driving transistor DT and a reference voltage line RVL for supplying a reference voltage Vref, a second transistor T2 connected between a second node N2 of the driving transistor DT and a data line DL, and a storage capacitor Cstg connected between the first node N1 and the second node N2 of the driving transistor DT.

However, the pixel structure of FIG. 4 is different from the "two-scan based pixel structure" of FIG. 3 in that the first transistor T1 and the second transistor T2 are controlled by one common scan signal SCAN that is supplied through one gate line GL.

In the pixel structure of FIG. 4, only one gate line GL is required, and the first transistor T1 and the second transistor T2 are controlled by the same gate signal (scan signal) through one common gate line GL. For this reason, the pixel structure of FIG. 4 referred to as a "one-scan based pixel structure.

The driving transistor DT described in example embodiments may be an N-type transistor or a P-type transistor. In addition, although the first transistor T1 and the second transistor T2 are illustrated as N-type transistors, they may be implemented to P-type transistors.

As described above, since the circuit area CA in the pixel area PA is provided with several transistors DT, T1 and T2, and the capacitor Cstg, the manufacturing process is complex, and this complexity leads to defects in the circuit area CA.

Meanwhile, the emission area EA in the pixel area PA may also have defects.

These defects in the circuit area CA and the emission area EA may be the main causes resulting in a faulty pixel appearing as a bright or a dark spot.

The present invention defines two types of pixel defect, and provides a repair process for each pixel defect and a structure by which the defect can be repaired.

The repair described in the present specification may be made during the manufacturing of the panel before shipping the product, or made due to an after purchase service request by a customer after having purchased the product.

First, two types of pixel defect will be described with reference to FIG. 5.

Figure 5:
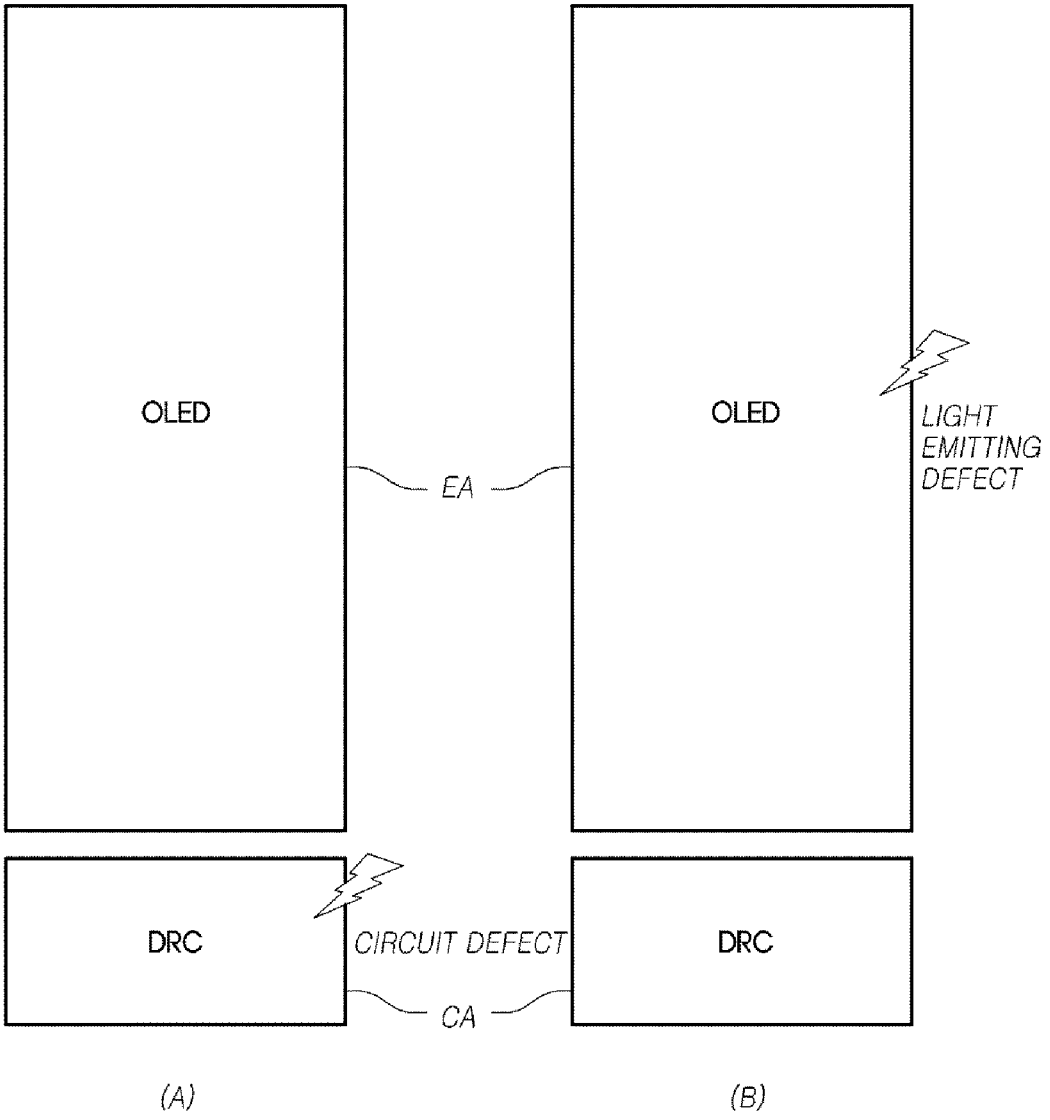
FIG. 5 illustrates two types of pixel defect of an organic light emitting display device according to example embodiments.

FIG. 5 illustrates two types of pixel defect of an organic light emitting display device 100 according to example embodiments.

Referring to FIG. 5, pixel defects of an organic light emitting display device 100 according to example embodiments may be divided into a circuit defect having problems in various transistor DT, T1 and T2, capacitors, and lines, and a light emitting defect having a problem in the organic light emitting diode OLED disposed in the emission area EA. Further, the circuit defect and the light emitting defect may concurrently occur in one pixel.

Referring to diagram (a) of FIG. 5, the circuit defect results from a short circuit, disconnection or an open circuit of at least one of the transistors DT, T1 and T2, the capacitor, and lines, which are disposed in the circuit area CA. In this case, the corresponding pixel is deemed defective and appears as a bright or dark spot.

If at least one of various transistor DT, T1 and T2, a capacitor, and lines, which are disposed in the circuit area CA, is short-circuited by impurities introduced during the manufacturing process, an excessive current flows to the organic light emitting diode OLED so that the corresponding pixel becomes a bright spot. Also, if at least one of various transistor DT, T1 and T2, a capacitor, and lines, which are disposed in the circuit area CA, is disconnected or open-circuited by impurities or a failure in manufacturing process, no current or a smaller amount of current than expected is applied to the organic light emitting diode OLED so that the corresponding pixel becomes a dark spot or a pale dark spot and is classified as a pixel defect.

Referring to diagram (b) of FIG. 5, the light emitting defect, which is the other type of pixel defect, may be generated by a short circuit of both electrodes (anode and cathode) of the organic light emitting diode OLED disposed in the emission area EA due to impurities introduced during the manufacturing process, or a failure of at least one of both electrodes (anode and cathode) of the organic light emitting diode OLED. Furthermore, the light emitting defect may result other unexpected causes.

Any state in which the organic light emitting diode OLED does not normally emit light may be regarded as a light emitting defect.

In cases where this pixel defect occurs, an excessive current, no current, or a small amount of current flows to the organic light emitting diode OLED causing the corresponding pixel become a bright spot, a dark spot, or a pale dark spot.

A repair process is required for each type of pixel defect (the circuit defect and the light emitting defect) as set forth before.

Accordingly, in the present specification, various example embodiments of repair processes for a pixel with the circuit defect and a structure for the same, and various embodiments of repair processes for a pixel with light emitting defect and a structure for the same will be disclosed.

The repair for pixel defects (the circuit defect and the light emitting defect) described in the present specification may be made during the manufacturing of the panel before shipping the product, or following the purchase of the product by a customer who requests the product be repaired.

First, repair for a pixel with the circuit defect and repair for a pixel with light emitting defect will be simply described with reference to FIG. 6.

Figure 6:
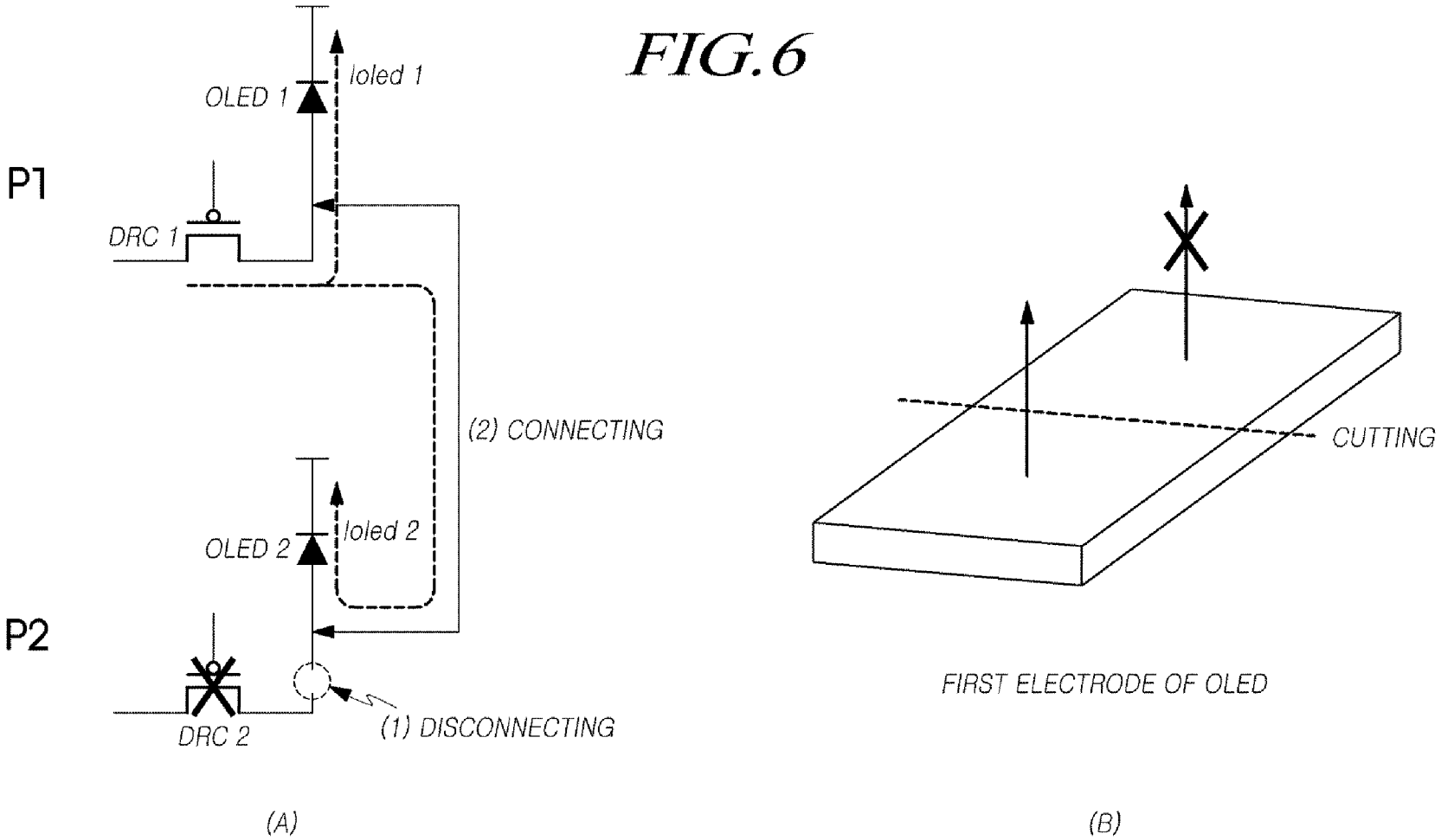
FIG. 6 is a conceptual diagram to explain repair methods for each pixel defect of an organic light emitting display device according to example embodiments.

FIG. 6 is a conceptual diagram to explain repair methods for each pixel defect of an organic light emitting display device 100 according to example embodiments.

FIG. 6(*a*) is an exemplary diagram illustrating a repair method for a pixel with a circuit defect, and FIG. 6(*b*) is a conceptual diagram illustrating a repair process for a pixel with a light emitting defect.

Referring to diagram (a) of FIG. 6, organic light emitting diodes OLED1 and OLED2, and driving circuits DRC1 and DRC2 are disposed in a first pixel P1 and a second pixel P2, respectively, which are certain pixels among a plurality of pixels disposed in the display panel 110.

Here, in diagram (a) of FIG. 6, a single transistor illustrated to be connected with the organic light emitting diode OLED1 of the first pixel P1 does not only denote a driving transistor DT of the first pixel P1, but also represent a driving circuit DRC1 of the first pixel P1.

In addition, the first pixel P1 and the second pixel P2 may be pixels of the same color or different color in some cases.

Referring to diagram (a) of FIG. 6, when a circuit defect is generated in the driving circuit DRC2 of the second pixel P2, repair for the circuit defect may include a "disconnection process (e.g., a cutting process)" by which the driving circuit DRC2 of the second pixel P2, where the circuit defect is generated, and the organic light emitting diode OLED2 are electrically disconnected, and a "connection process (e.g., a welding process)" by which the organic light emitting diode OLED1 of the first pixel P1 and the organic light emitting diode OLED2 of the second pixel P2 are electrically connected in order to supply a current to the organic light emitting diode OLED2 of the second pixel P2 from the driving circuit DRC1 of another pixel P1.

Accordingly, a current output from the driving circuit DRC1 of the first pixel P1 is divided to be supplied to the organic light emitting diode OLED1 of the first pixel P1 and the organic light emitting diode OLED2 of the second pixel P2 in parallel (I1=Ioled1+Ioled2). That is, the organic light emitting diode OLED1 of the first pixel P1 and the organic light emitting diode OLED2 of the second pixel P2 share the driving circuit DRC1 of the first pixel P1 with each other.

Referring to diagram (b) of FIG. 6, when a light emitting defect is generated in an organic light emitting diode OLED of a certain pixel P, repair for the light emitting defect may include a "cutting process" by which a defective part that results from impurities introduced during the manufacturing process is cut away from the first electrode (e.g., anode or cathode) of the organic light emitting diode OLED of the light emitting defect.

According to the repair of the light emitting defect, the emission area EA in the pixel area of the corresponding pixel P may be reduced, so the brightness of the corresponding pixel may deteriorate. However, such a reduction of brightness can be compensated through internal or external compensation by changing a data voltage applied to the corresponding pixel.

As described above, in repairing the pixel defects (the circuit defect and the light emitting defect), for example, the cutting process and the welding process may be used.

Accordingly, the point where the cutting process is to be performed and the point where the welding process is to be performed should be carefully selected in order to allow an easy and accurate repair process (a cutting process and a welding process) to be made with respect to the pixel defects while not damaging adjacent circuits.

In relation to the repair process for the circuit defect, the point where a driving circuit and an organic light emitting diode of a corresponding pixel with the circuit defect may be electrically disconnected with each other is to be cut, and in relation to the repair process for the light emitting defect, the point where an area or a part of the light emitting defect may be removed from the first electrode of an organic light emitting diode of a corresponding pixel is to be cut. Hereinafter, the point where the cutting process is to be performed will be referred to as a cutting point CP.

The point where welding is to be performed by the welding process is a point where the first electrode of an organic light emitting diode of a corresponding pixel with the circuit defect and the first electrode of an organic light emitting diode of another pixel may be connected with each other in parallel, so that the organic light emitting diode of the corresponding pixel with the circuit defect may share a current output from a driving circuit of the another pixel with the organic light emitting diode of the another pixel. Hereinafter, the point where the welding process is to be performed will be referred to as a welding point WP.

The cutting point CP and welding point WP may vary in the location and the number thereof in regard to the structure and arrangement of pixel.

For example, the cutting point CP may be an electrical connection point between the first electrode (e.g., anode) of an organic light emitting diode of a pixel with the circuit defect and a driving circuit in terms of a circuit, and may be a point on the first electrode of an organic light emitting diode of a pixel with the circuit defect, or a point on a source electrode or a drain electrode of a driving transistor in a driving circuit of a pixel with the circuit defect in order not to turn the driving transistor on in terms of a structure.

The cutting point CP may be any point where a driving circuit of a pixel with the pixel defect may not supply a current to an organic light emitting diode as well as the above points.

For example, the welding point WP may be a certain disconnection point (e.g., where the capacitor may be formed) on a repair line RL where one end of which is connected with the first electrode of an organic light emitting diode of a pixel with the circuit defect and the other end is connected with the first electrode of an organic light emitting diode of another normal pixel, or may be an area where the first electrode of an organic light emitting diode of a pixel with the circuit defect and the first electrode of an organic light emitting diode of another normal pixel are adjacent to each other.

A capacitor may be formed at any disconnected point of the repair line described above. In addition, the area where the first electrode of an organic light emitting diode of a pixel with the circuit defect and the first electrode of an organic light emitting diode of another normal pixel are adjacent to each other, may be, for example, a boundary area between an emission area EA of a pixel with the circuit defect and an emission area EA of another normal pixel, when the first electrode of an organic light emitting diode of a pixel with the circuit defect and the first electrode of an organic light emitting diode of another normal pixel are adjacent to each other. Alternatively, the area where the first electrode of an organic light emitting diode of a pixel with the circuit defect and the first electrode of an organic light emitting diode of another normal pixel are adjacent to each other, may be positioned in an circuit area CA of a pixel with the circuit defect or another normal pixel, when the first electrode of an organic light emitting diode of a pixel with the circuit defect is adjacent not to the first electrode of an organic light emitting diode of another normal pixel but to a driving circuit thereof.

The above-described welding point WP may be any point where the first electrode of an organic light emitting diode of a pixel with the circuit defect can be connected with the first electrode of an organic light emitting diode of another normal pixel as well as the above-disclosed points.

A specific pattern may be formed at each welding point WP of the display panel 110.

Such a specific pattern that is formed at each welding point WP of the display panel 110 will be referred to as a floating pattern.

This floating pattern maintains the first electrodes of the organic light emitting diodes of the two pixels to be electrically disconnected.

To this end, the floating pattern may be insulated from at least one of the first electrodes of the organic light emitting diodes of the two pixels.

Meanwhile, the floating pattern may be weld by a laser welding to thereby form a "connection pattern" in which the first electrodes of the organic light emitting diodes of the two pixels are electrically connected.

When the connection pattern is formed between the two pixels of which one is called a first pixel and the other is called a second pixel, the first electrode of the organic light emitting diode of the first pixel is electrically disconnected with the driving circuit of the first pixel, or the first electrode of the organic light emitting diode of the second pixel is electrically disconnected with the driving circuit of the second pixel.

For example, when the connection pattern is formed, and the first electrode of the organic light emitting diode of the first pixel is electrically disconnected with the driving circuit of the first pixel, an electrical connection point between the first electrode of the organic light emitting diode of the first pixel and the driving circuit of the first pixel may have been cut, or the first electrode of the organic light emitting diode of the first pixel may have been cut, or either a source electrode or a drain electrode of a driving transistor in a driving circuit of the first pixel may have been cut.

Among the above cutting points CP, in a case of cutting the first electrode of the organic light emitting diode of the first pixel, the cutting point of the first electrode of the organic light emitting diode of the first pixel may vary with a repair structure. For example, a part of the first electrode of the organic light emitting diode of the first pixel, which is extended to a circuit area CA where the driving circuit of the first pixel is disposed may be cut.

Meanwhile, when the connection pattern is formed, and the second electrode of the organic light emitting diode of the second pixel is electrically disconnected with the driving circuit of the second pixel, a connection point between the first electrode of the organic light emitting diode of the second pixel and the driving circuit of the second pixel may have been cut, or the first electrode of the organic light emitting diode of the second pixel may have been cut, or either a source electrode or a drain electrode of a driving transistor in a driving circuit of the second pixel may have been cut.

Among the above cutting points CP, in the case of cutting the first electrode of the organic light emitting diode of the second pixel, the cutting point of the first electrode of the organic light emitting diode of the second pixel may vary with a repair structure. For example, a part of the first electrode of the organic light emitting diode of the second pixel, which is extended to a circuit area CA where the driving circuit of the second pixel is disposed, may be cut.

As set forth above, when the floating pattern, which is formed to be insulated from at least one of the first electrode of the organic light emitting diode of the first pixel and the first electrode of the organic light emitting diode of the second pixel in order to disconnect the first electrode of the organic light emitting diode of the first pixel from the first electrode of the organic light emitting diode of the second pixel, is welded to thereby form the connection pattern, which electrically connect the first electrode of the organic light emitting diode of the first pixel with the first electrode of the organic light emitting diode of the second pixel, the first electrode of the organic light emitting diode of the first pixel may be electrically disconnected with the driving circuit of the first pixel, or the first electrode of the organic light emitting diode of the second pixel may be electrically disconnected with the driving circuit of the second pixel.

If the first electrode of the organic light emitting diode of the first pixel is electrically disconnected with the driving circuit of the first pixel, the driving circuit of the second pixel may drive the organic light emitting diode of the first pixel and the organic light emitting diode of the second pixel in parallel through the connection pattern.

If the first electrode of the organic light emitting diode of the second pixel is electrically disconnected with the driving circuit of the second pixel, the driving circuit of the first pixel may drive the organic light emitting diode of the first pixel and the organic light emitting diode of the second pixel in parallel through the connection pattern.

As to the floating pattern in terms of an overall area of the display panel 110, if every pixel with display panel 110 is a normal pixel having no circuit defects, only the floating pattern for maintaining an electrical disconnection state of the first electrode of each organic light emitting diode of the two pixels may be formed on the display panel 110 without formation of the connection pattern for electrically connecting the first electrodes of the organic light emitting diodes of the two pixels with each other. That is, when every pixel is a normal pixel having no circuit defects, the first electrodes of the organic light emitting diodes of the two pixels are never electrically connected.

If the circuit defect occurs in at least one pixel among every pixel with display panel 110, and then a repair according to the present embodiment has been made, at least one floating patter among every floating pattern existing in the display panel 110 may be welded to form a connection pattern. That is, if at least one pixel among all of the pixels has a circuit defect, at least one first electrode of the organic light emitting diodes of the two pixels may be electrically connected with each other.

Hereinafter, a repair structure by which a repair process may be performed, and a repair process using the same will be described in detail according to the type of pixel defect with reference to drawings.

First, in relation to a circuit defect, an example embodiment (the first example embodiment) of a repair structure by which a circuit defect can be repaired based on a repair line, and a repair process for a circuit defect by using the same will be described.

Subsequently, example embodiments (the second example embodiment to the seventh example embodiment) of repair structures by which a circuit defect can be repaired without a repair line, and a repair process for a circuit defect by using the same will be described.

Next, an example embodiment (the eighth example embodiment) of a repair structure by which a light emitting defect can be repaired, and a repair process for a light emitting defect by using the same will be described.

Further, an example embodiment (the ninth example embodiment) of a repair structure by which a pixel with a circuit defect and a pixel with a light emitting defect, which are adjacent to each other, can be repaired, and a repair process using the same will be described.

Furthermore, an example embodiment (the tenth example embodiment) of compensation for a reduction of brightness in a pixel that has been repaired with respect to the circuit defect will be described.

Hereinafter, for the convenience of explanation, an organic light emitting display device 100 having a repair structure designed to enable a repair process, a repair process by using the repair structure, and an organic light emitting display device 100 having a structure that is changed through the repair process will be described with respect to a first pixel P1 and a second pixel P2 which are certain pixels selected from among a plurality of pixels disposed in the display panel 110.

Also, the two pixels P1 and P2 may be normal pixels having no pixel defects. Alternatively, when a pixel defect occurs in at least one pixel among the plurality of pixels in the display panel 110, for the convenience of explanation, the at least one pixel with a pixel defect among the plurality of pixels may be referred to as a second pixel P2.

Further, the first pixel P1 and the second pixel P2 which are certain pixels selected from among the plurality of pixels disposed in the display panel 110 may represent the plurality of pixels disposed in the display panel 110.

That is, if the first pixel P1 and the second pixel P2 are normal pixels, every pixel disposed in the display panel 110 may be regarded to be a normal pixel. On the contrary, if a pixel defect occurs in the second pixel P2 of the first pixel P1 and the second pixel P2, at least one pixel among all the pixels disposed in the display panel 110 may be regarded to have a pixel defect. In addition, if the second pixel P2 having a pixel defect among the first pixel P1 and the second pixel P2 is repaired, it is regarded that a pixel defect of at least one pixel among all the pixels disposed in the display panel 110 is repaired.

Figure 7:
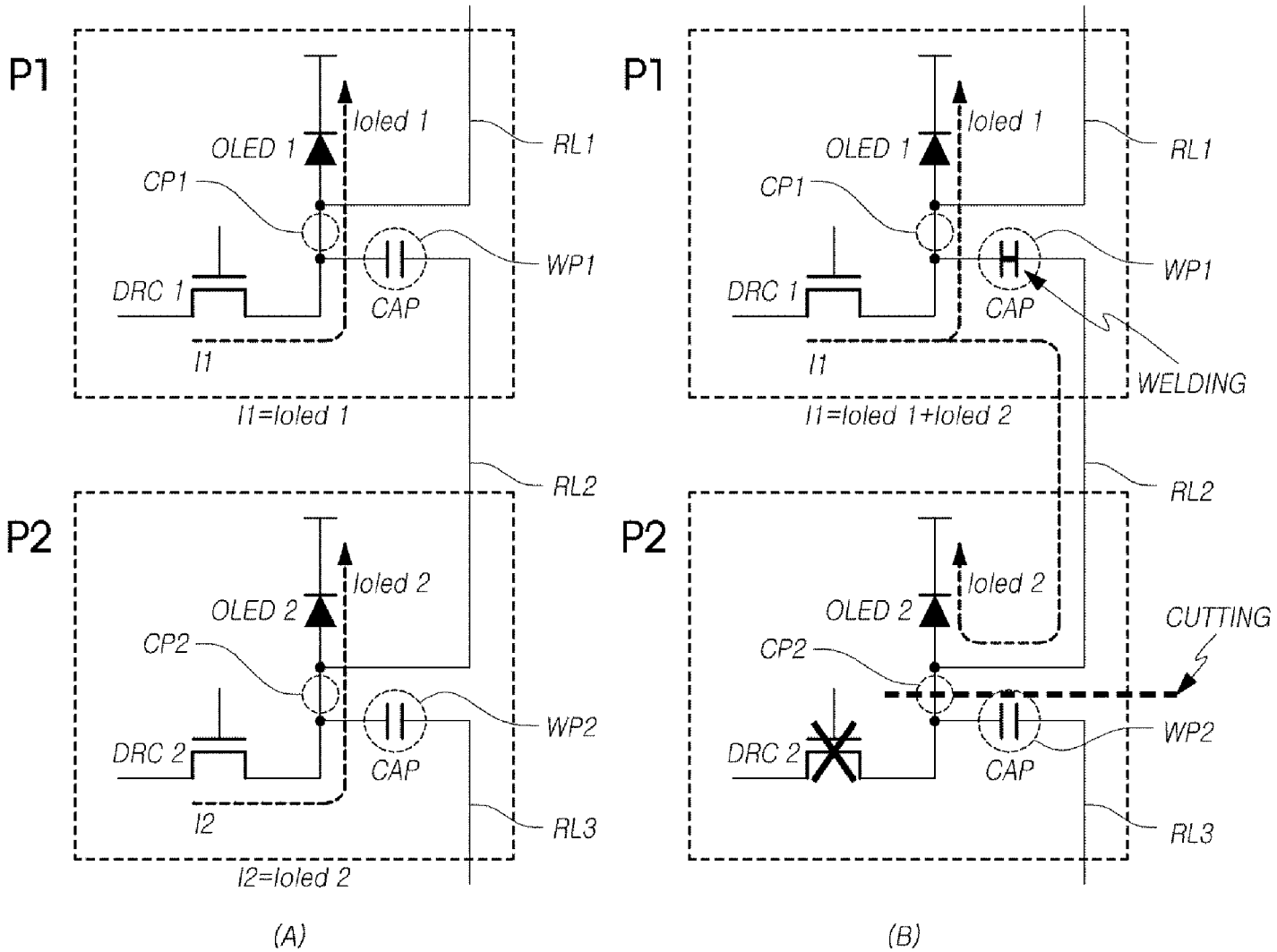
FIG. 7 illustrates a repair structure by which a circuit defect may be repaired using a repair line, and a repair process for a circuit defect by using the same in an organic light emitting display device according to a first example embodiment.

FIG. 7 illustrates a repair structure by which a circuit defect may be repaired using a repair line RL, and a repair process of a circuit defect by using the same in an organic light emitting display device 100 according to a first example embodiment.

Diagram (a) of FIG. 7 illustrates a repair structure by which a circuit defect may be repaired based on a repair line RL in an organic light emitting display device 100 according to the first example embodiment, wherein a first pixel P1 and a second pixel P2, which are certain pixels among a plurality of pixels disposed in the display panel 110, are normal pixels having no pixel defects. The display panel 110 in such a state may be obtained through a pixel defect test in which the first pixel P1 and the second pixel P2 are determined to be normal in manufacturing the display panel, or may be shipped without pixel defects.

Referring to diagram (a) of FIG. 7, the organic light emitting display device 100 according to the first example embodiment includes a display panel 110 where a plurality of pixels are disposed, and an organic light emitting diode OLED and a driving circuit DRC are disposed in each pixel area PA of the first pixel P1 and the second pixel P2 among the plurality of pixels disposed in the display panel 110.

That is, in the pixel area PA of the first pixel P1, the organic light emitting diode OLED1 is disposed in an emission area EA in the pixel area PA, and the driving circuit DRC1 for driving the organic light emitting diode OLED1 is disposed in a circuit area CA in the pixel area PA. Also, in the pixel area PA of the second pixel P2, the organic light emitting diode OLED2 is disposed in an emission area EA in the pixel area PA, and the driving circuit DRC2 for driving the organic light emitting diode OLED2 is disposed in a circuit area CA in the pixel area PA.

Referring to diagram (a) of FIG. 7, the first pixel P1 and the second pixel P2 have one welding point WP and one cutting point CP, respectively. That is, the first pixel P1 has a welding point WP1 and a cutting point CP1, and the second pixel P2 has a welding point WP2 and a cutting point CP2.

Referring to diagram (a) of FIG. 7, at least one floating pattern is formed on each welding point WP1 or WP2 of the first pixel P1 and the second pixel P2.

This floating pattern is a structure for playing a role of electrically disconnecting a first electrode (e.g., anode or cathode) of the organic light emitting diode OLED1 of the first pixel P1 from a first electrode of the organic light emitting diode OLED2 of the second pixel P2.

The floating pattern may be, for example, a repair line RL2 whose one end is connected with the first electrode (or an output point of the driving circuit DRC1) of the organic light emitting diode OLED1 of the first pixel P1, and the other end is connected with the first electrode (or an output point of the driving circuit DRC2) of the organic light emitting diode OLED2 of the second pixel P2, wherein a certain point in the middle of the repair line is disconnected.

In addition, the floating pattern may not refer to the above-described repair line RL2, but refer to a portion of the disconnected point on the repair line RL2.

Further, the floating pattern may form a capacitor CAP at the disconnected point on the repair line RL2.

In diagram (a) of FIG. 7, one end of the repair line RL2 is connected with the first electrode of the organic light emitting diode OLED1 of the first pixel P1, and the other end thereof is connected with the first electrode of the organic light emitting diode OLED2 of the second pixel P2, wherein a capacitor CAP is formed at a certain point WP1 in the middle of the repair line RL2 to thereby make the repair line RL2 to be disconnected. The repair line RL2 is for a repair for the circuit defect of the second pixel P2, when the circuit defect occurs in the driving circuit DRC2 of the second pixel P2.

Like this, one end of a repair line RL3 is connected with the first electrode of the organic light emitting diode OLED2 of the second pixel P2, and the other end thereof is connected with the first electrode of an organic light emitting diode OLED3 of a third pixel P3 other than the second pixel P2, wherein a capacitor CAP is formed at a certain point WP2 in the middle of the repair line RL3 to thereby disconnect the repair line RL3. The repair line RL3 is for a repair for the circuit defect of the third pixel P3, when the circuit defect occurs in a driving circuit DRC3 of the third pixel P3.

Like this, the repair line RL1 is for a repair for the circuit defect of the first pixel P1, when the circuit defect occurs in the driving circuit DRC1 of the first pixel P1.

Considering that a driving circuit and an organic light emitting diode of a pixel having a circuit defect are electrically disconnected with each other, an electrical connection point between a driving circuit and an organic light emitting diode of each pixel may be a cutting point CP.

That is, in order to electrically disconnect the driving circuit DRC1 and the organic light emitting diode OLED1 of the first pixel P1, an electrical connection point between the driving circuit DRC1 and the organic light emitting diode OLED1 of the first pixel P1 may be the cutting point CP1. In order to electrically disconnect the driving circuit DRC2 and the organic light emitting diode OLED2 of the second pixel P2, an electrical connection point between the driving circuit DRC2 and the organic light emitting diode OLED2 of the second pixel P2 may be the cutting point CP2.

Referring to diagram (a) of FIG. 7, since both the first pixel P1 and the second pixel P2 are normal pixels having no defects, the welding process has not been performed with respect to the welding point. Accordingly, the driving circuit DRC1 of the first pixel P1 supplies a current to only the organic light emitting diode OLED1 of the first pixel P1 to be thereby driven (I1=Ioled1). In addition, the driving circuit DRC2 of the second pixel P2 supplies a current to only the organic light emitting diode OLED2 of the second pixel P2 to be thereby driven (I2=Ioled2).

Meanwhile, referring to diagram (b) of FIG. 7, if a circuit defect occurs in the driving circuit DRC2 of the second pixel P2 among the first pixel P1 and the second pixel P2, the driving circuit DRC2 and the organic light emitting diode OLED2 of the second pixel P2 having the circuit defect are electrically disconnected through a "cutting process" at the cutting point CP2 that is an electrical connection point between the organic light emitting diode OLED2 and the driving circuit DRC DRC2 of the second pixel P2 having the circuit defect.

In addition, a "welding process" for a repair process for the circuit defect of the second pixel P2 is performed at the welding point WP1 on the repair line RL2, to thereby electrically connect the first electrode of the organic light emitting diode OLED1 of the first pixel P1 with the first electrode of the organic light emitting diode OLED2 of the second pixel P2.

Here, both ends of the capacitor CAP that is the "floating pattern" formed at the welding point WP1 on the repair line RL2 is connected by the welding to thereby form a "connection pattern" like a general signal line. Here, the connection pattern is a metallic pattern to electrically connect the first electrode of the organic light emitting diode OLED1 of the first pixel P1 and the first electrode of the organic light emitting diode OLED2 of the second pixel P2, and it may be a transformation of the floating pattern.

According to these cutting process and welding process, when the circuit defect of the second pixel P2 is repaired, the organic light emitting display device 100 comes to a state in which the organic light emitting diode OLED2 and the driving circuit DRC2 of the second pixel P2 are electrically disconnected, the driving circuit DRC1 of the first pixel P1, the organic light emitting diode OLED1 of the first pixel P1, and the organic light emitting diode OLED2 of the second pixel P2 are to be electrically connected, and the connection pattern according to the result of the repair process for the circuit defect of the second pixel P2 is formed.

Such a state after the repair process may be a state in which the manufacture of the display panel 110 is completed, or a state in which some processes are still left in order to manufacture the display panel 110 such as the second electrode of the organic light emitting diode OLED1 and OLED2, or some components of the organic light emitting display device 100.

As described above, after the circuit defect of the second pixel P2 is repaired, the organic light emitting diode OLED1 of the first pixel P1 and the organic light emitting diode OLED2 of the second pixel P2 may share the driving circuit DRC1 of the first pixel P1, and the driving circuit DRC1 of the first pixel P1 may drive the organic light emitting diode OLED1 of the first pixel P1 and the organic light emitting diode OLED2 of the second pixel P2 in parallel.

According to this, after the repair process (the welding process and the cutting process) for the circuit defect of the second pixel P2 is carried out, a current I1 output from the driving circuit DRC1 of the first pixel P1 is divided to be thereby supplied to the organic light emitting diode OLED1 of the first pixel P1 and the organic light emitting diode OLED2 of the second pixel P2 (I1=Ioled1+Ioled2).

As described in FIG. 7, separate repair lines are provided, and the welding points WP and the cutting points CP for effectively welding and cutting a typical pixel structure are defined, so it is possible to repair the pixel defects which previously were unrepairable, and faulty pixels operate as normal pixels.

In the repair process for the circuit defect as set forth above, the repair structure requires separate repair lines which are formed in the display panel 110 to have a welding point WP where the floating pattern such as a capacitor is formed, so the design of the panel and manufacturing processes may be limited to some extent.

For example, the separate repair lines may be formed in a bezel area or between the pixel lines of the display panel 110, which makes the design of a pixel structure difficult or harms an aperture ratio. This may reduce the manufacturing efficiency of the display panel 110.

Accordingly, in the present specification, various embodiments of repair structures enabling a repair without repair lines, and repair methods using the same will be disclosed.

The repair structures enabling a repair without repair lines, and repair methods using the same may vary according to the arrangement (relation of position) of a pixel (the second pixel P2) having a circuit defect and a pixel (the first pixel P1) having a driving circuit for sharing a current with the second pixel P2. Accordingly, hereinafter, example embodiments of repair structures and repair methods using the same will be described according to the type of arrangement between two pixels P1 and P2 which are related to the repair for the circuit defect.

First, arrangement of two pixels P1 and P2 related to the repair for the circuit defect will be described with reference to FIG. 8.

Figure 8:
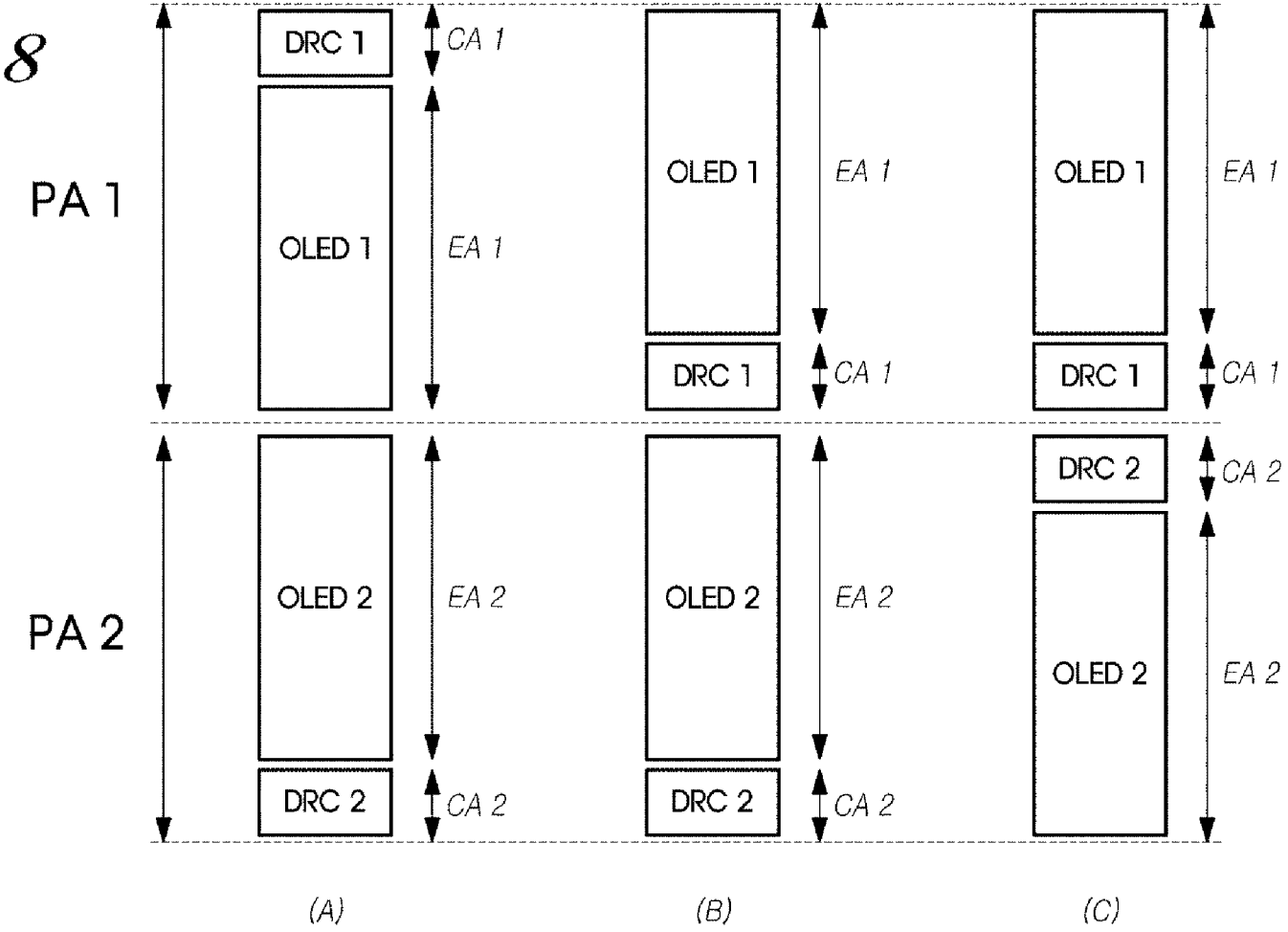
FIG. 8 illustrates three types of pixel arrangement of an organic light emitting display device according to example embodiments.

FIG. 8 illustrates three types of pixel arrangement of an organic light emitting display device 100 according to example embodiments.

As shown in diagrams (a), (b) and (c) of FIG. 8, pixel arrangement of the organic light emitting display device 100 according to example embodiments includes a type of emission areas EA having organic light emitting diodes, which are adjacent to each other, a type of a circuit area CA having a driving circuit and an emission area EA having an organic light emitting diode, which are adjacent to each other, and a type of circuit areas CA having driving circuits, which are adjacent to each other.

That is, with a pixel area PA1 of a first pixel P1 being adjacent to a pixel area PA2 of a second pixel P2, the organic light emitting diode OLED1 of the first pixel P1 is adjacent to the organic light emitting diode OLED2 of the second pixel P2 as shown in diagram (a) of FIG. 8, or the driving circuit DRC1 of the first pixel P1 is adjacent to the organic light emitting diode OLED2 of the second pixel P2 as shown in diagram (b) of FIG. 8, or the driving circuit DRC1 of the first pixel P1 is adjacent to the driving circuit DRC2 of the second pixel P2 as shown in diagram (c) of FIG. 8.

Meanwhile, the type of pixel arrangement in diagram (b) of FIG. 8 may be applied to every pixel arrangement of the display panel 110. However, the types of pixel arrangements in diagrams (a) and (c) of FIG. 8 may not be applied to every pixel arrangement of the display panel 110. For example, after pixels are arranged according to diagram (a) of FIG. 8, the second pixel P2 and a consecutive third pixel P3 disposed thereafter will make the arrangement of diagram (c) of FIG. 8. Further, after pixels are arranged according to diagram (c) of FIG. 8, the second pixel P2 and a consecutive third pixel P3 disposed thereafter will make the arrangement of diagram (a) of FIG. 8.

Hereinafter, as embodiments of repair structures without repair lines and repair methods using the same, a second example embodiment and a third example embodiment in which an emission area EA1 of a first pixel P1 is adjacent to an emission area EA2 of a second pixel P2 will be described with reference to FIGS. 9 to 16. Next, a fourth example embodiment in which a circuit area CA1 of a first pixel P1 is adjacent to an emission area EA2 of a second pixel P2 will be described with reference to FIGS. 17 to 23. Further, a fifth example embodiment in which a circuit area CA1 of a first pixel P1 is adjacent to a circuit area CA2 of a second pixel P2 will be described with reference to FIGS. 24 and 25.

Figure 9:
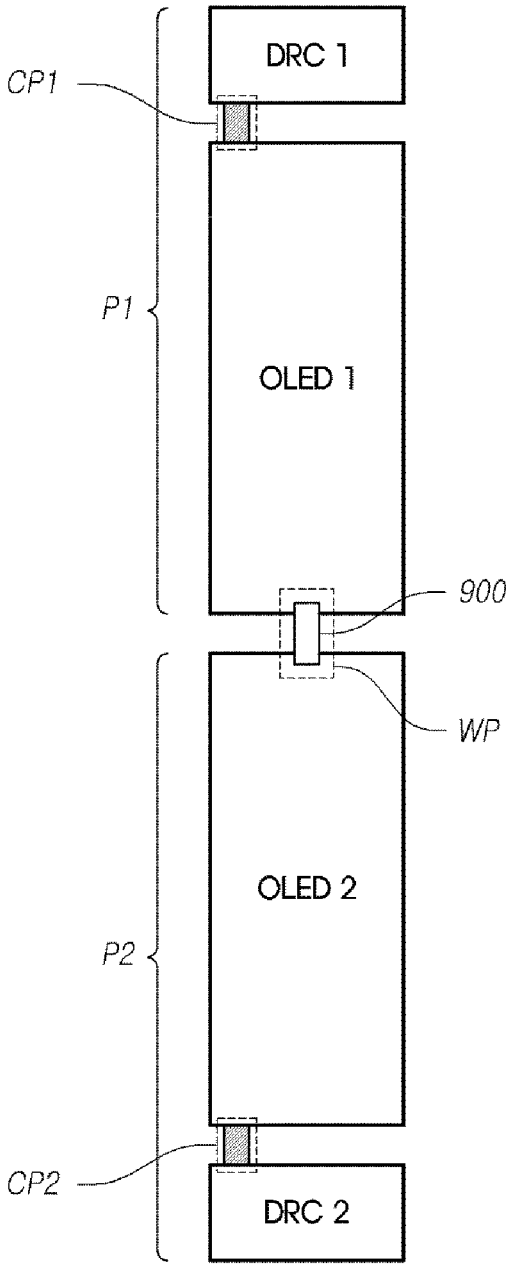
FIG. 9 is a plan view of an organic light emitting display device according to a second example embodiment.
Figure 10:
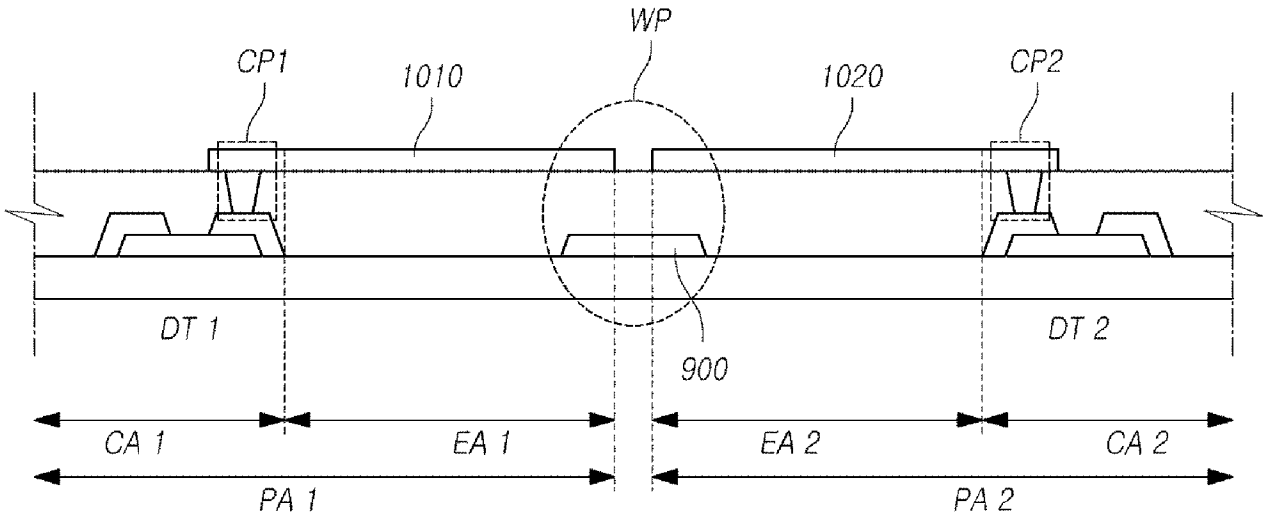
FIG. 10 is a schematically sectional view of an organic light emitting display device according to the second example embodiment.

FIGS. 9 and 10 are a plan view and a conceptual sectional view of an organic light emitting display device 100 according to a second example embodiment.

Referring to FIGS. 9 and 10, a first pixel P1 and a second pixel P2, which are certain pixels selected from among a plurality of pixels, are disposed according to the arrangement of diagram (a) of FIG. 8 (the arrangement in which emission areas of the pixels are adjacent to each other) in the display panel 110 of an organic light emitting display device 100 according to the second example embodiment.

That is, as shown in FIG. 9, an organic light emitting diode OLED1 of the first pixel P1 may be disposed to be adjacent to an organic light emitting diode OLED2 of the second pixel P2.

Referring to FIGS. 9 and 10, a floating pattern 900 that is to be welded in repairing is formed at a welding point WP.

Meanwhile, referring to FIG. 10, in the pixel arrangement according to the second example embodiment, the floating pattern 900, that is to be welded during the repair, may be formed to be insulated from at least one of a first electrode 1010 of the organic light emitting diode OLED1 of the first pixel P1 and a first electrode 1020 of the organic light emitting diode OLED2 of the second pixel P2.

In the example of FIG. 10, the floating pattern 900 is insulated from the first electrode 1020 of the organic light emitting diode OLED2 of the second pixel P2 as well as the first electrode 1010 of the organic light emitting diode OLED1 of the first pixel P1.

Like this, since the floating pattern 900 is formed to be insulated from at least one of the first electrode 1010 of the organic light emitting diode OLED1 of the first pixel P1 and a first electrode 1020 of the organic light emitting diode OLED2 of the second pixel P2, the first electrode 1010 of the organic light emitting diode OLED1 of the first pixel P1 and a first electrode 1020 of the organic light emitting diode OLED2 of the second pixel P2 come to a state of being electrically disconnected.

In addition, as shown in FIGS. 9 and 10, the floating pattern 900 may be formed to overlap with a pixel area PA1 of the first pixel P1 and a pixel area PA2 of the second pixel P2 at the boundary between the pixel area PA1 of the first pixel P1 and the pixel area PA2 of the second pixel P2.

That is, in the case of the pixel arrangement according to the second example embodiment, the welding point WP for a repair process of a circuit defect may overlap with the emission area EA1 in the pixel area PA1 of the first pixel P1, and the emission area EA2 in the pixel area PA2 of the second pixel P2.

In a case of the second example embodiment in which the organic light emitting diode OLED1 of the first pixel P1 is adjacent to the organic light emitting diode OLED2 of the second pixel P2, as described above, the welding point WP is positioned at the boundary between the two pixel areas (two emission areas), and the small floating pattern 900 is formed at the welding point WP. Accordingly, since separate repair lines RL need not be formed in the bezel area or between the pixel lines in order to form the floating pattern at the welding point WP, the design of panel and manufacturing processes can be simplified and easy.

Meanwhile, referring to FIGS. 9 and 10, the first pixel P1 and the second pixel P2 include cutting points CP1 and CP2 for disconnecting a circuit connection between its own organic light emitting diode and driving circuit, when a circuit defect occurs in its own driving circuit.

In terms of a circuit, referring to FIG. 9, upon a repair process for a circuit defect of the first pixel P1, the cutting point CP1 may be positioned at any point on the path through which a current is supplied from the driving circuit DRC1 to the organic light emitting diode OLED1 of the first pixel P1. Also, upon a repair process for a circuit defect of the second pixel P2, the cutting point CP2 may be positioned at any point on the path through which a current is supplied from the driving circuit DRC2 to the organic light emitting diode OLED2 of the second pixel P2.

In terms of the structure, referring to the second pixel P2, the cutting point CP2, where a cutting process for disconnecting the organic light emitting diode OLED2 and the driving circuit DRC2 of the second pixel P2 is performed, should be positioned at a point where the cutting process can be carried out accurately and easily.

Considering this, the cutting point CP2, where the cutting process for disconnecting the organic light emitting diode OLED2 and the driving circuit DRC2 of the second pixel P2 is performed, may be positioned at, for example, an extension part of the first electrode 1020 of the organic light emitting diode OLED2 of the second pixel P2, which is extended to the circuit area CA2.

In addition to the above-described point, the cutting point CP2 may be positioned at any point where the first electrode 1020 of the organic light emitting diode OLED2 of the second pixel P2 is connected with transistors (the driving transistor DT2 in a case of a pixel structure in FIGS. 3 and 4) disposed in the circuit area CA2.

Likewise, the cutting point CP1, where the cutting process for disconnecting the organic light emitting diode OLED1 and the driving circuit DRC1 of the first pixel P1 is performed, may be positioned at, for example, an extension part of the first electrode 1010 of the organic light emitting diode OLED1 of the first pixel P1, which is extended to the circuit area CA1.

In addition to the above-described point, the cutting point CP1 may be positioned at any point where the first electrode 1010 of the organic light emitting diode OLED1 of the first pixel P1 is connected with transistors (the driving transistor DT1 in a case of a pixel structure in FIGS. 3 and 4) disposed in the circuit area CA1.

Meanwhile, a description will be made with reference to FIG. 11 that conceptually and simply illustrates a stack of the floating pattern 900 which is formed to overlap with the boundary between the pixel area PA1 of the first pixel P1 and the pixel area PA2 of the second pixel P2.

Figure 11:
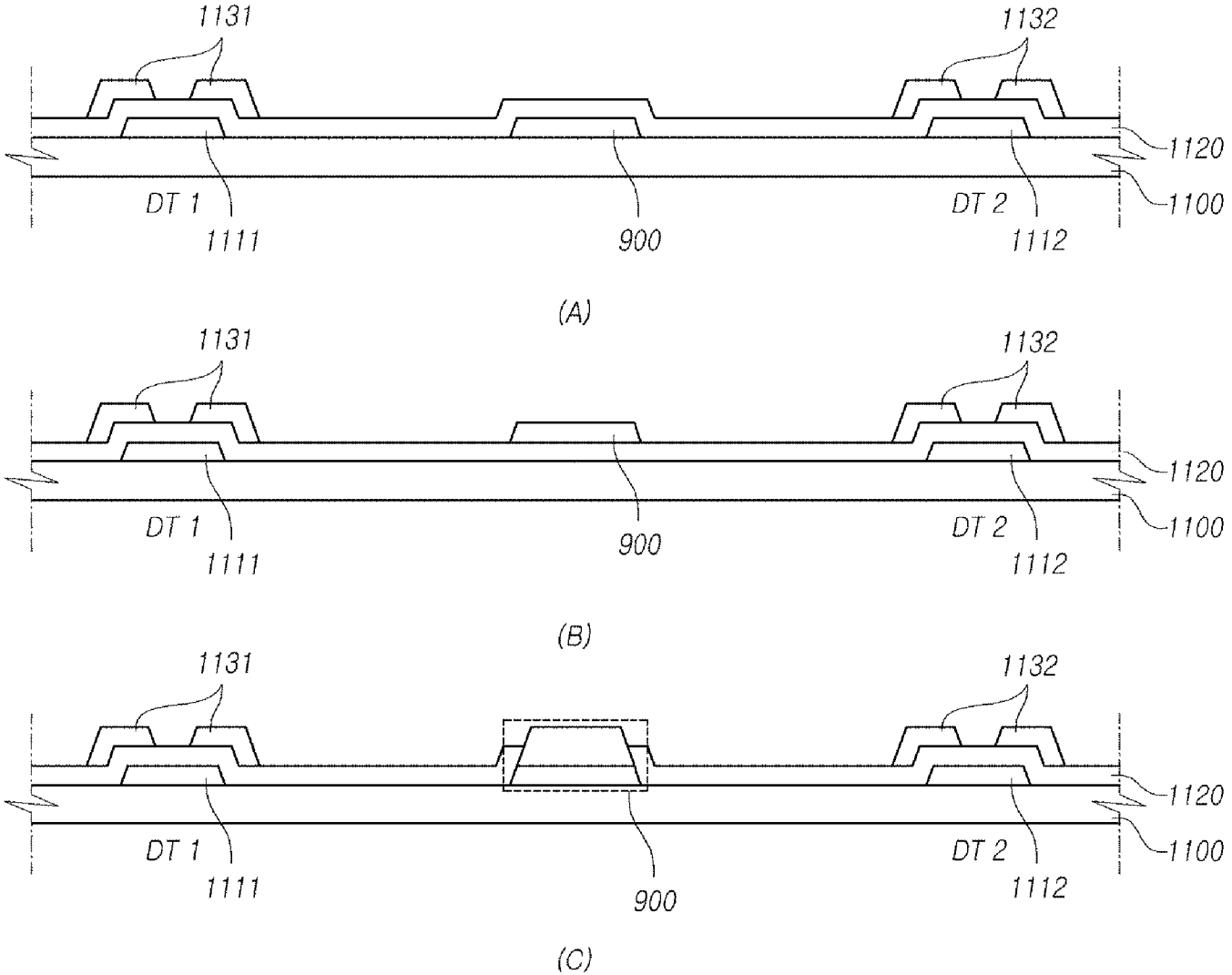
FIG. 11 illustrates an example of formation of a floating pattern of an organic light emitting display device according to the second example embodiment.

FIG. 11 illustrates an example of formation of a floating pattern 900 of an organic light emitting display device 100 according to the second example embodiment.

Referring to diagram (a) of FIG. 11, the floating pattern 900 may be formed on a gate layer.

In this case, the floating pattern 900 may be formed together with a gate electrode 1111 of a transistor DT1 disposed in the circuit area CA1 of the first pixel P1, and a gate electrode 1112 of a transistor DT2 disposed in the circuit area CA2 of the second pixel P2, while the gate electrodes 1111 and 1112 are formed on a substrate 1100. At this time, the floating pattern 900 may be the same material as the gate electrodes 1111 and 1112.

Referring to diagram (b) of FIG. 11, the floating pattern 900 may be on a source-drain layer.

In this case, after a gate electrode 1111 of a transistor DT1 disposed in the circuit area CA1 of the first pixel P1, and a gate electrode 1112 of a transistor DT2 disposed in the circuit area CA2 of the second pixel P2 are formed on a substrate 1100, and a gate insulation layer 1120 is formed thereon, the floating pattern 900 may be formed together with a source-drain electrode 1131 of a transistor DT1 disposed in the circuit area CA1 of the first pixel P1, and a source-drain electrode 1132 of a transistor DT2 disposed in the circuit area CA2 of the second pixel P2, while the source-drain electrodes 1131 and 1132 are formed. At this time, the floating pattern 900 may be the same material as the source-drain electrodes 1131 and 1132.

Referring to diagram (c) of FIG. 11, the floating pattern 900 may be formed through a gate layer and a source-drain layer.

In this case, a part of the floating pattern 900 may be formed together with a gate electrode 1111 of a transistor DT1 disposed in the circuit area CA1 of the first pixel P1, and a gate electrode 1112 of a transistor DT2 disposed in the circuit area CA2 of the second pixel P2, while the gate electrodes 1111 and 1112 are formed on a substrate 1100. Next, after a gate insulation layer 1120 is formed thereon, the rest of the floating pattern 900 may be formed together with a source-drain electrode 1131 of a transistor DT1 disposed in the circuit area CA1 of the first pixel P1, and a source-drain electrode 1132 of a transistor DT2 disposed in the circuit area CA2 of the second pixel P2, while the source-drain electrodes 1131 and 1132 are formed. At this time, the floating pattern 900 may be comprised of a gate material layer and a source-drain material layer.

Figure 12:
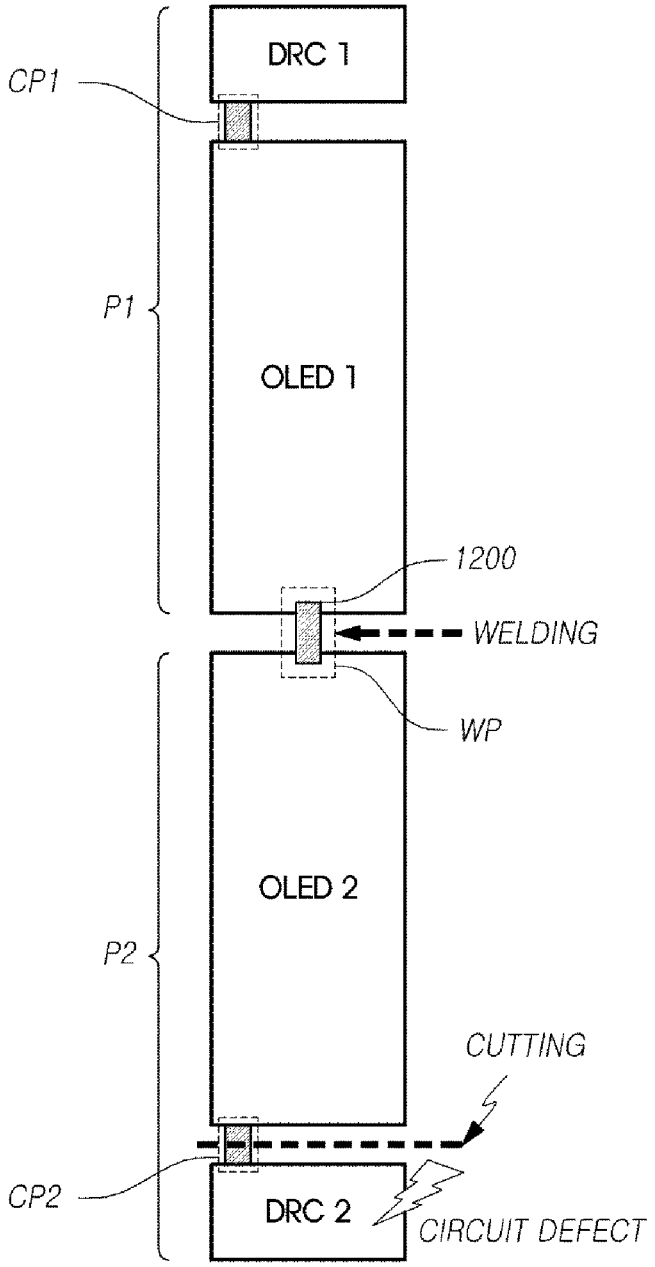
FIG. 12 is a plan view after a repair process of an organic light emitting display device according to the second example embodiment.
Figure 13:
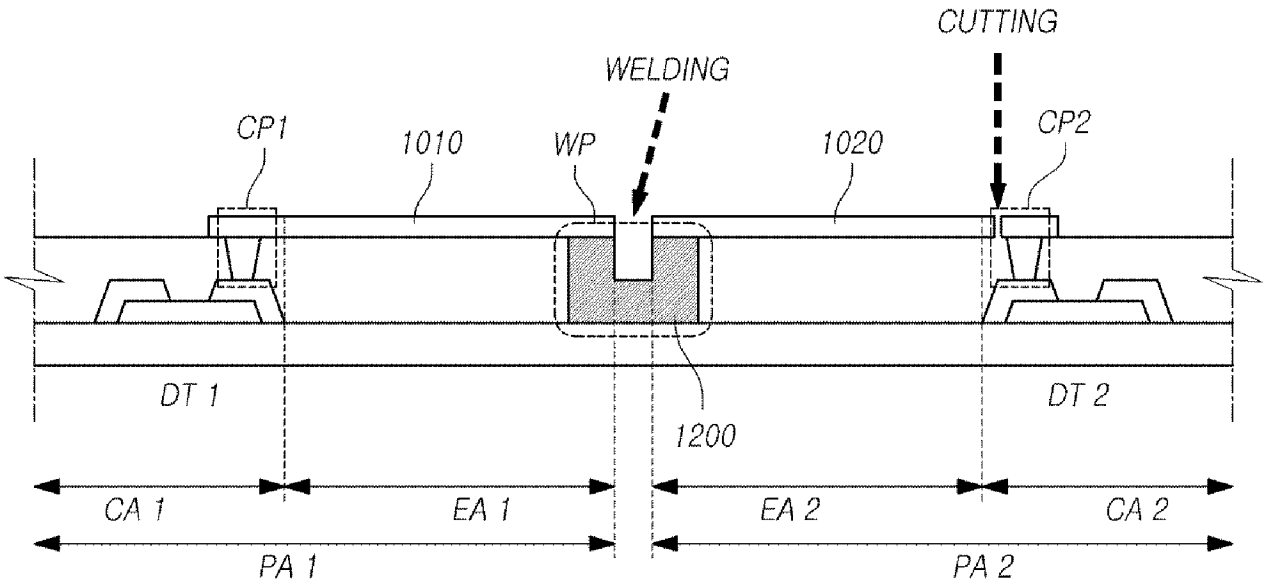
FIG. 13 is a sectional view illustrating an organic light emitting display device after a repair process has been performed according to the second example embodiment.

FIG. 12 is a plan view after a repair process of an organic light emitting display device 100 according to the second example embodiment, and FIG. 13 is a schematically sectional view after a repair process of an organic light emitting display device according to the second example embodiment.

Referring to FIGS. 12 and 13, a circuit defect occurs in the driving circuit DRC2 of the second pixel P2, in order to repair the circuit defect of the second pixel P2, the connection between the organic light emitting diode OLED2 and the driving circuit DRC2 of the second pixel P2 is disconnected by a cutting process.

Referring to FIG. 13, the cutting point CP2 to be cut may be positioned at the extension part of the first electrode 1020 of the organic light emitting diode OLED2 of the second pixel P2, which extends to the circuit area CA2.

Referring to FIG. 13, the extension part, which is extended to the circuit area CA2, of the first electrode 1020 of the organic light emitting diode OLED2 of the second pixel P2 is cut away through a cutting process at the cutting point CA2, so the electrical connection of the organic light emitting diode OLED2 and the driving circuit DRC2 of the second pixel P2 and the transistor DT2 in the driving circuit DRC2 is disconnected.

Referring to FIG. 13, in order to electrically connect the first electrode 1020 of the organic light emitting diode OLED2 of the second pixel P2 which is disconnected with the driving circuit DRC2 of the second pixel P2 in a circuit with the first electrode 1010 of the organic light emitting diode OLED1 of the first pixel P1, a welding process is performed with respect to the floating pattern 900 that is formed at the welding point WP. According to this, the floating pattern 900 is welded to thereby form a connection pattern 1200.

The connection pattern 1200 may electrically connect the first electrode 1020 of the organic light emitting diode OLED2 of the second pixel P2 with the first electrode 1010 of the organic light emitting diode OLED1 of the first pixel P1, to thereby supply a current from the driving circuit DRC1 of the first pixel P1.

The repair process (the cutting process+the welding process) described with reference to FIGS. 12 and 13 may be performed while manufacturing the panel before shipment of the product. In this case, after the first electrode (e.g., anode or cathode) of the organic light emitting diode OLED disposed in every pixel with display panel 110 is formed, and before the second electrode (e.g., cathode or anode) of the organic light emitting diode OLED is formed, a test for pixel defects may be carried out.

Although the repair process (the cutting process+the welding process) may be performed during manufacturing the panel before shipping the product or after being purchased in regards to a warranty service, it may be performed in a state in which the first electrode (e.g., anode or cathode) and the second electrode (e.g., cathode or anode) of the organic light emitting diode OLED disposed in every pixel with display panel 110 are formed.

Hereinafter, a third example embodiment of a repair structure of which pixel arrangement is similar to that of the second example embodiment, but different from the second example embodiment in that the floating pattern 900 is formed at a plurality of points, and a repair process using the same will be described with reference to FIGS. 14 to 16.

Figure 14:
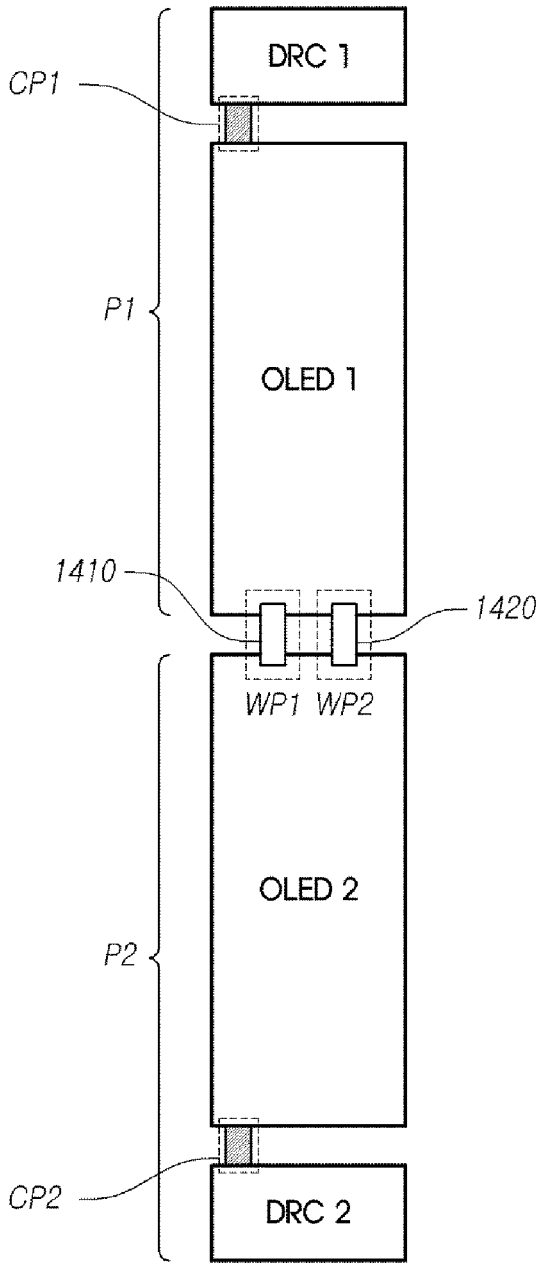
FIG. 14 is a plan view of an organic light emitting display device according to a third example embodiment.

FIG. 14 is a plan view of an organic light emitting display device 100 according to the third example embodiment.

Referring to FIG. 14, the organic light emitting display device 100 according to the third example embodiment has a similarity to the pixel arrangement of the organic light emitting display device 100 according to the second example embodiment in that the organic light emitting diode OLED1 of the first pixel P1 is adjacent to the organic light emitting diode OLED2 of the second pixel P2, and a difference from the organic light emitting display device 100 according to the second example embodiment that has only one welding point WP in that two welding points WP1 and WP2 are positioned at the boundary the organic light emitting diode OLED1 of the first pixel P1 and the organic light emitting diode OLED2 of the second pixel P2, which is adjacent to the organic light emitting diode OLED1.

That is, the organic light emitting display device 100 according to the third example embodiment has the same pixel arrangement, but different number of welding points, compared to the organic light emitting display device 100 according to the second example embodiment. Accordingly, the number of floating pattern is also different from that of the second example embodiment.

In relation to formation of the floating pattern, in the organic light emitting display device 100 according to the third example embodiment, two floating patterns 1410 and 1420 that is to be welded for a repair process is formed to be insulated from at least one of the first electrode 1010 of the organic light emitting diode OLED1 of the first pixel P1 and the first electrode 1020 of the organic light emitting diode OLED2 of the second pixel P2, and to overlap with the boundary between the pixel area PA1 of the first pixel P1 and the pixel area PA2 of the second pixel P2.

Although the two floating patterns 1410 and 1420 are illustrated to be formed at different points WP1 and WP2, respectively, in FIG. 14, this is just for the convenience of explanation, and furthermore, three or more floating patterns may be formed at three or more points.

Figure 15:
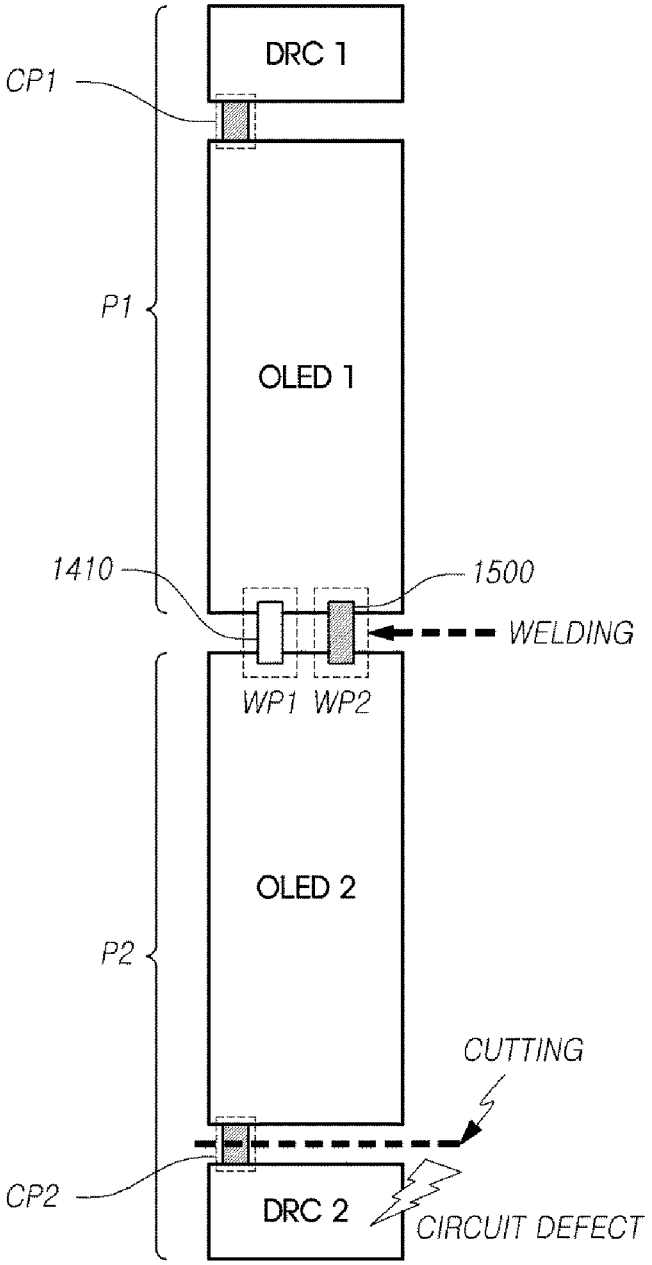
FIG. 15 is a plan view after a repair process of an organic light emitting display device according to the third example embodiment.

FIG. 15 is a plan view after a repair process of an organic light emitting display device 100 according to the third example embodiment.

Referring to FIG. 15, a circuit defect occurs in the second pixel P2 among the first pixel P1 and the second pixel P2 of the organic light emitting display device 100 according to the third example embodiment in FIG. 14, a repair is required for the circuit defect of the second pixel P2.

Referring to FIG. 15, in order to disconnect the electrical connection between the driving circuit DRC2 and the organic light emitting diode OLED2 of the second pixel P2, the point (the cutting point CP2) where the first electrode of the organic light emitting diode OLED2 of the second pixel P2 and the driving circuit DRC2 of the second pixel P2 is cut.

Further, referring to FIG. 15, in order to allow the organic light emitting diode OLED2 of the second pixel P2 to be driven by the driving circuit DRC1 of the first pixel P1, a connection pattern 1500 may be formed by welding at least one of two floating patterns 1410 and 1420 which are formed at two welding points WP1 and WP2 to be insulated from at least one of the first electrode of the organic light emitting diode OLED1 of the first pixel P1 and the first electrode of the organic light emitting diode OLED2 of the second pixel P2.

With the formation of the connection pattern 1500, the first electrode of the organic light emitting diode OLED1 of the first pixel P1 and the first electrode of the organic light emitting diode OLED2 of the second pixel P2 are electrically connected.

According to this, after the repair process, the organic light emitting display device 100 according to the third example embodiment has the connection pattern 1500 for electrically connecting the first electrode of the organic light emitting diode OLED1 of the first pixel P1 and the first electrode of the organic light emitting diode OLED2 of the second pixel P2 as shown in FIG. 15.

Meanwhile, the organic light emitting display device 100 according to the third example embodiment may perform a repair process with respect to a light emitting defect as well as the circuit defect.

For example, when a circuit defect occurs in the driving circuit DRC2 of the second pixel P2, and at the same time, a light emitting defect occurs in the organic light emitting diode OLED2 of the second pixel P2, in the organic light emitting display device 100 according to the third example embodiment, in the repair process of the circuit defect, the floating patterns 1410 and 1420 formed at least one point of two or more points WP1 and WP2 are welded to form the connection pattern 1500 to electrically connect the first electrode of the organic light emitting diode OLED1 of the first pixel P1 and the first electrode of the organic light emitting diode OLED2 of the second pixel P2, and for the repair process of the light emitting defect, the first electrode of the organic light emitting diode OLED2 of the second pixel P2 is cut in order to remove the point of the organic light emitting diode OLED2 of the second pixel P2, where the light emitting defect is generated, in a circuit. According to this, the first electrode of the organic light emitting diode OLED1 of the first pixel P1 and a part (that is left after cutting) of the first electrode of the organic light emitting diode OLED2 of the second pixel P2 are electrically connected with each other.

In the cutting process to remove the light emitting defect point, the first electrode of the organic light emitting diode OLED2 of the second pixel P2 may be cut in the lateral direction or in the longitudinal direction depending on the light emitting defect points.

When the circuit defect and the light emitting defect concurrently occurs, the organic light emitting display device 100 that is repaired will be described below with reference to FIG. 16.

Figure 16:
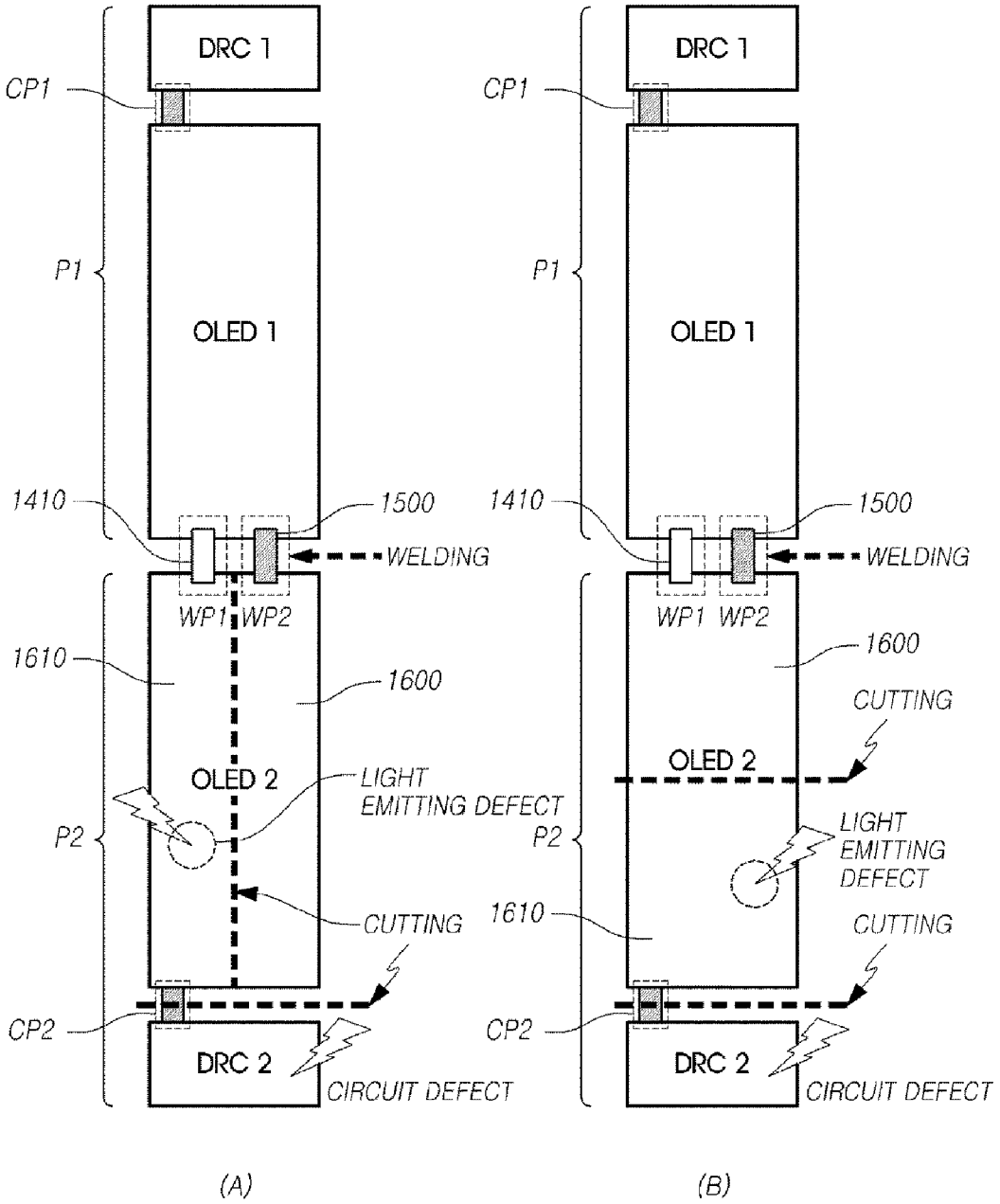
FIG. 16 is another plan view after a repair process of an organic light emitting display device according to the third example embodiment.

FIG. 16 is another plan view after a repair process of an organic light emitting display 100 device according to the third example embodiment.

Diagram (a) of FIG. 16 illustrates a longitudinal cutting process in a repair process of a light emitting defect, and diagram (b) of FIG. 16 illustrates a lateral cutting process in a repair process of a light emitting defect.

Referring to diagrams (a) and (b) of FIG. 16, after a repair process for the circuit defect is performed, in the organic light emitting display device 100 according to the third example embodiment, in order to electrically disconnect the organic light emitting diode OLED2 and the driving circuit DRC2 of the second pixel P2 having the circuit defect, the cutting point CP2 where the first electrode of the organic light emitting diode OLED2 of the second pixel P2 having the circuit defect is connected with the driving circuit DRC2 of the second pixel P2 is cut, and the floating pattern 1420, that is formed at least one point {WP2 in diagrams (a) and (b) of FIG. 16} among two or more floating patterns 1410 and 1420 formed at two or more points WP1 and WP2, is welded to form the connection pattern 1500.

In the organic light emitting display device 100 that has had a circuit defect repaired as described above, the first electrode of the organic light emitting diode OLED1 of the first pixel P1 is electrically connected with the first electrode of the organic light emitting diode OLED2 of the second pixel P2, so the driving circuit DRC1 of the first pixel P1 may supply a current the organic light emitting diode OLED1 of the first pixel P1 and the organic light emitting diode OLED2 of the second pixel P2 in parallel.

Meanwhile, referring to diagrams (a) and (b) of FIG. 16, provided that a pixel having the light emitting defect is referred to as the second pixel P2, in the organic light emitting display device 100 according to the third example embodiment after the repair process for the light emitting defect is performed, the first electrode of the organic light emitting diode OLED2 of the second pixel P2 is cut to be split into one part 1600 that is connected to the connection pattern 1500, and the other part 1610 that is not connected to the connection pattern 1500.

Referring to diagrams (a) and (b) of FIG. 16, the first electrode of the organic light emitting diode OLED2 of the second pixel P2 having the light emitting defect may be cut laterally or longitudinally, and diagonally in some cases.

Referring to diagrams (a) and (b) of FIG. 16, the first electrode of the organic light emitting diode OLED2 of the second pixel P2 having the light emitting defect may be cut linearly, or in a curve in some cases.

The direction, the point and the form of the cutting may be determined not to reduce the emission area EA2 of the second pixel P2, considering the point where the light emitting defect occurs in the organic light emitting diode OLED2 of the second pixel P2, and the area of the part 1600 of the first electrode of the organic light emitting diode OLED2 of the second pixel P2, which is involved for light emitting after the cutting.

Until now, the organic light emitting display devices 100 according to the second and third example embodiments were described in relation to the type {diagram (a) of FIG. 8} in which the emission area EA1 of the first pixel P1 is adjacent to the emission area EA2 of the second pixel P2.

Hereinafter, an organic light emitting display device 100 according to the fourth example embodiment will be described in relation to the type {diagram (b) of FIG. 8} in which the circuit area CA1 of the first pixel P1 is adjacent to the emission area EA2 of the second pixel P2 with reference to FIGS. 17 to 23.

Figure 17:
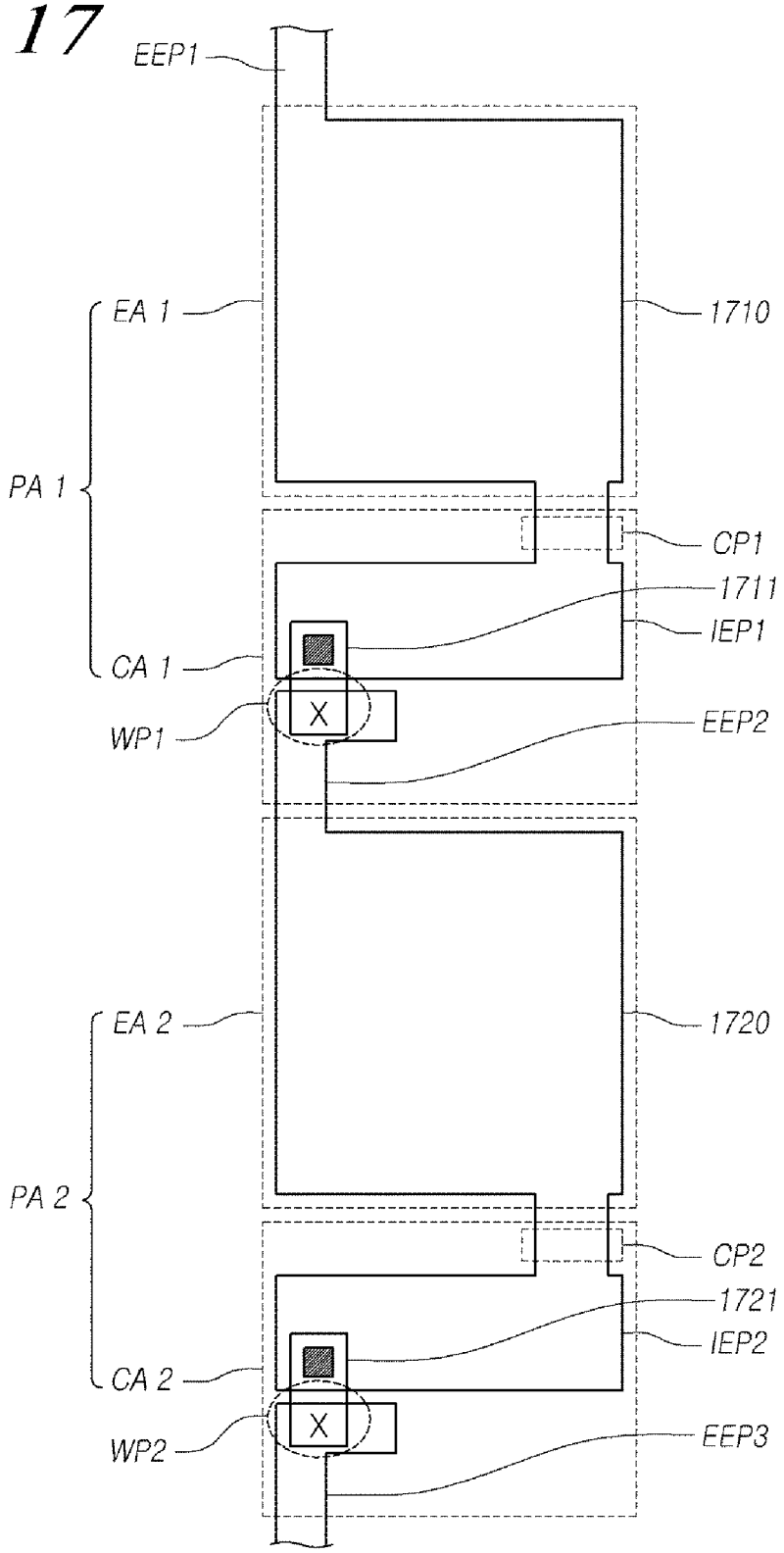
FIG. 17 is a plan view of an organic light emitting display device according to a fourth example embodiment.

FIG. 17 is a plan view of an organic light emitting display device 100 according to the fourth example embodiment.

Referring to FIG. 17, the organic light emitting display device 100 according to the fourth example embodiment has an arrangement in which the circuit area CA1 of the first pixel P1 is adjacent to the emission area EA2 of the second pixel P2.

That is, the organic light emitting display device 100 according to the fourth example embodiment has an arrangement in which the driving circuit DRC1 of the first pixel P1 is adjacent to the organic light emitting diode OLED2 of the second pixel P2.

Meanwhile, Referring to FIG. 17, in the organic light emitting display device 100 according to the fourth example embodiment, first electrodes 1710 and 1720 of the organic light emitting diodes OLED1 and OLED2 of the first pixel P1 and the second pixel P2 are formed in a special form for the repair process, respectively.

That is, in the organic light emitting display device 100 according to the fourth example embodiment, each first electrode 1710 or 1720 of the organic light emitting diodes OLED1 and OLED2 of the first and second pixels P1 and P2 is comprised of a part that belongs to the emission area of its own pixel, an internal extension part IEP that extends to the circuit area in its own pixel, and an external extension part EEP that extends to the circuit area of another pixel outside its own pixel.

According to the more detailed description with reference to FIG. 17, the first electrode 1720 of the organic light emitting diode OLED2 in the second pixel P2 is comprised of a part that belongs to the emission area EA2 of the second pixel P2, an extension part IEP2 that extends to the circuit area CA2 inside the second pixel P2, and an extension part EEP2 that extends to the circuit area CA1 of the first pixel P1.

Likewise, the first electrode 1710 of the organic light emitting diode OLED1 in the first pixel P1 is comprised of a part that belongs to the emission area EA1 of the first pixel P1, an extension part IEP1 that extends to the circuit area CA1 inside the first pixel P1, and an extension part EEP1 that extends to the circuit area CA0 of the 0th pixel P0.

Two points (the welding point and the cutting point) for the repair process (the welding process and the cutting process) are positioned in relation to the first electrodes 1710 and 1720 having the above-described structure.

First, in relation to the cutting point CP, referring to FIG. 17, to be prepared for the generation of the circuit defect in the first pixel P1, the cutting point CP1 exists at the point where the extension part IEP1 of the first electrode 1710 of the organic light emitting diode OLED1 of the first pixel P1, which extends to the circuit area CA1 of the first pixel P1, is cut.

Likewise, to be prepared for the generation of the circuit defect in the second pixel P2, the cutting point CP2 exists at the point where the extension part IEP2 of the first electrode 1720 of the organic light emitting diode OLED2 of the second pixel P2, which extends to the circuit area CA2 of the second pixel P2, is cut.

Next, in relation to the welding point WP, referring to FIG. 17, to be prepared for the generation of the circuit defect in the second pixel P2, the welding point WP1 is positioned at the point where the first electrode 1710 of the organic light emitting diode OLED1 of the first pixel P1 is adjacent to the first electrode 1720 of the organic light emitting diode OLED2 of the second pixel P2.

Referring to FIG. 17, since the first electrode 1710 of the organic light emitting diode OLED1 of the first pixel P1 and the first electrode 1720 of the organic light emitting diode OLED2 of the second pixel P2 are adjacent to each other in the circuit area CA1 of the first pixel P1, the welding point WP1 that is to be welded at the time when the circuit defect occurs in the second pixel P2 is positioned in the circuit area CA1 of the first pixel P1.

Accordingly, a floating pattern 1711, that is insulated from at least one of the first electrode 1710 and IEP1 of the organic light emitting diode OLED1 of the first pixel P1 and the first electrode 1720 and EEP2 of the organic light emitting diode OLED2 of the second pixel P2, is formed at the welding point WP1 where the first electrode 1710 and IEP1 of the organic light emitting diode OLED1 of the first pixel P1 is adjacent to the first electrode 1720 and IEP2 of the organic light emitting diode OLED2 of the second pixel P2.

Likewise, in the circuit area CA2 of the second pixel P2, a floating pattern 1721, that is insulated from at least one of the first electrode 1720 and IEP2 of the organic light emitting diode OLED2 of the second pixel P2 and the first electrode EEP3 of the organic light emitting diode OLED3 of the third pixel P3, is formed at the welding point WP2 where the first electrode 1720 and IEP2 of the organic light emitting diode OLED2 of the second pixel P2 is adjacent to the first electrode EEP3 of the organic light emitting diode OLED3 of the third pixel P3.

Figure 18:
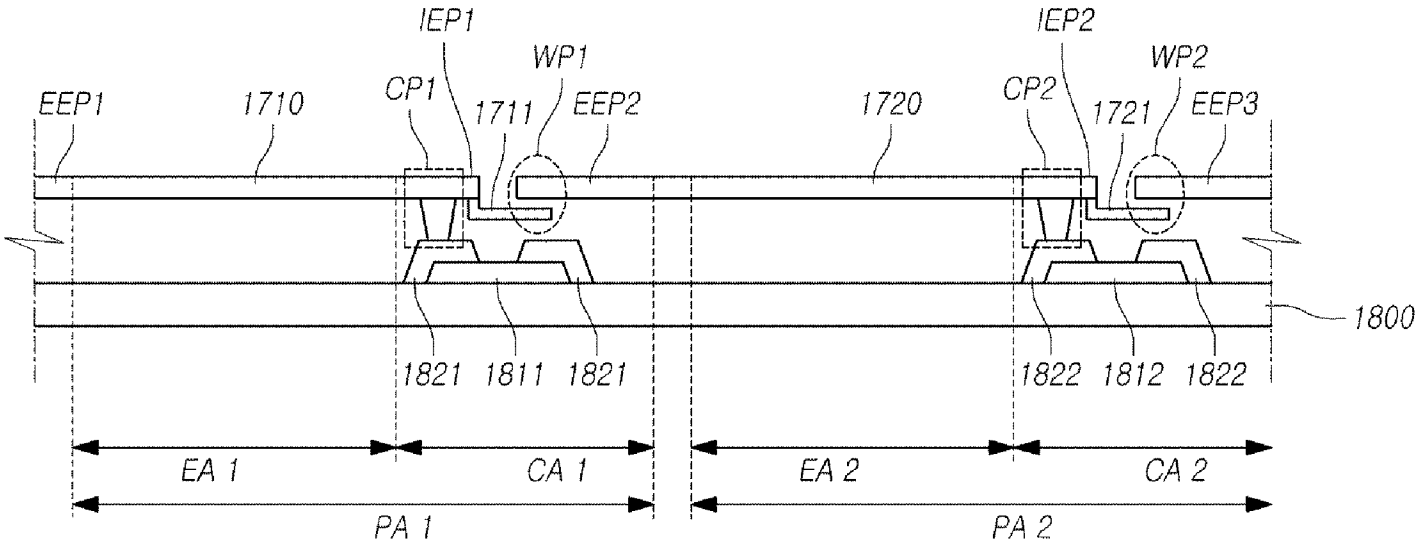
FIG. 18 is a schematic sectional view of an organic light emitting display device according to the fourth example embodiment.

FIG. 18 is a schematically sectional view of an organic light emitting display device 100 according to the fourth example embodiment.

FIG. 18 is a schematically sectional view of the plan view in FIG. 17, in which only the driving transistor DT connected with the organic light emitting diode OLED, among the transistors (DT, DT1, and DT2 in FIGS. 3 and 4) and the capacitor (Cstg in FIGS. 3 and 4) which are included in the driving circuits DRC1 and DRC2 of the first pixel P1 and the second pixel P2, are illustrated.

FIG. 18 is a conceptual and simplified view of a stack structure in order to illustrate the connection point of the organic light emitting diode OLED and the driving circuit DRC, the welding point WP, and the cutting point CP in the sectional view, which are set forth above through the plan view of FIG. 17.

Referring to FIG. 18, the first electrode 1710 of the organic light emitting diode OLED1 of the first pixel P1 is formed to extend to the circuit area CA1 of the first pixel P1.

In addition, the driving transistor DT1 for supplying a current to the organic light emitting diode OLED1 of the first pixel P1 is formed in the circuit area CA1 of the first pixel P1 on a substrate 1800.

The driving transistor DT1 of the first pixel P1 includes a gate electrode 1811 and a source/drain electrode 1821, a source electrode or a drain electrode among the source/drain electrode 1821 is connected with the extension part IEP1 of the first electrode 1710 of the organic light emitting diode OLED1 of the first pixel P1, which extends to the circuit area CA1.

A cutting point CP1 in a repair process of the circuit defect in the first pixel P1 is positioned at the connection point between the extension part IEP1 of the first electrode 1710 of the organic light emitting diode OLED1 of the first pixel P1, which extends to the circuit area CA1, and the driving transistor DT1 of the first pixel P1, or the extension part IEP1 of the first electrode 1710 of the organic light emitting diode OLED1 of the first pixel P1, which extends to the circuit area CA1.

Referring to FIG. 18, the first electrode 1720 of the organic light emitting diode OLED2 of the second pixel P2 is formed to extend to the circuit area CA1 of the first pixel P1.

In addition, the driving transistor DT2 for supplying a current to the organic light emitting diode OLED2 of the second pixel P2 is formed in the circuit area CA2 of the second pixel P2 on a substrate 1800.

The driving transistor DT2 of the second pixel P2 includes a gate electrode 1812 and a source/drain electrode 1822, a source electrode or a drain electrode among the source/drain electrode 1822 is connected with the extension part IEP2 of the first electrode 1720 of the organic light emitting diode OLED2 of the second pixel P2, which extends to the circuit area CA2.

A cutting point CP2 in a repair process of the circuit defect in the second pixel P2 is positioned at the connection point between the extension part IEP2 of the first electrode 1720 of the organic light emitting diode OLED2 of the second pixel P2, which extends to the circuit area CA2, and the driving transistor DT2 of the second pixel P2, or the extension part IEP2 of the first electrode 1720 of the organic light emitting diode OLED2 of the second pixel P2, which extends to the circuit area CA2.

Meanwhile, referring to FIG. 18, the extension part IEP1 of the first electrode 1710 of the organic light emitting diode OLED1 of the first pixel P1, which extends to the circuit area CA1, is adjacent to the extension part EEP2 of the first electrode 1720 of the organic light emitting diode OLED2 of the second pixel P2, which extends to the circuit area CA1 of the first pixel P1.

Referring to FIG. 18, a floating pattern 1711, that is insulated from at least one (EEP2 in a case of FIG. 18) of the first electrode 1710 and IEP1 of the organic light emitting diode OLED1 of the first pixel P1 and the first electrode 1720 and EEP2 of the organic light emitting diode OLED2 of the second pixel P2, is formed at the point where the extension part IEP1 of the first electrode 1710 of the organic light emitting diode OLED1 of the first pixel P1, which extends to the circuit area CA1, is adjacent to the extension part EEP2 of the first electrode 1720 of the organic light emitting diode OLED2 of the second pixel P2, which extends to the circuit area CA1 of the first pixel P1. Here, the point where the floating pattern 1711 is formed may be the welding point WP1.

Likewise, a floating pattern 1721, that is insulated from at least one (EEP3 in a case of FIG. 18) of the first electrode 1720 and IEP2 of the organic light emitting diode OLED2 of the second pixel P2 and the first electrode EEP3 of the organic light emitting diode OLED3 of the third pixel P3, is formed at the point where the extension part IEP2 of the first electrode 1720 of the organic light emitting diode OLED2 of the second pixel P2, which extends to the circuit area CA2, is adjacent to the extension part EEP3 of the first electrode (not shown) of the organic light emitting diode OLED3 of the third pixel P3, which extends to the circuit area CA2 of the second pixel P2. Here, the point where the floating pattern 1721 is formed may be the welding point WP2.

As described above, the extension part IEP1 of the first electrode 1710 of the organic light emitting diode OLED1 of the first pixel P1 and the extension part EEP2 of the first electrode 1720 of the organic light emitting diode OLED2 of the second pixel P2 are formed in the circuit area CA1 where the driving circuit DRC1 of the first pixel P1 is formed. In addition, the floating pattern 1711, that is insulated from at least one of the extension part IEP1 of the first electrode 1710 of the organic light emitting diode OLED1 of the first pixel P1 and the extension part EEP2 of the first electrode 1720 of the organic light emitting diode OLED2 of the second pixel P2, is formed in the circuit area CA1.

The relatively complicated circuit area CA1 where the driving circuit DRC1 of the first pixel P1 is formed will be described in detail with reference to a plan view of FIG. 19 and a sectional view of FIG. 20.

Figure 19:
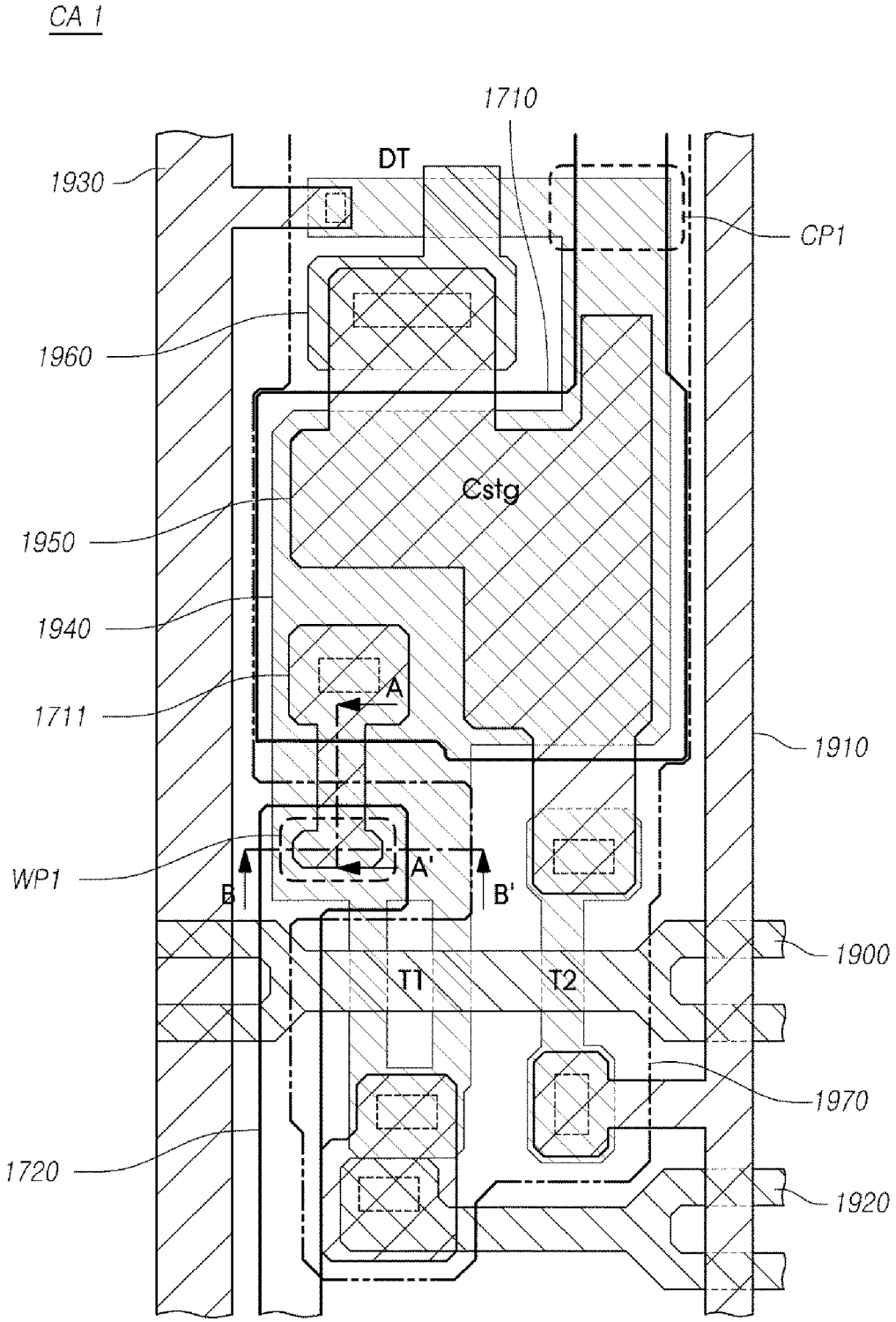
FIG. 19 is a partially detailed plan view of an organic light emitting display device according to the fourth example embodiment.

FIG. 19 is a partially detailed plan view of an organic light emitting display device 100 according to the fourth example embodiment.

FIG. 19 is a plan view illustrating the circuit area CA1 where the driving circuit DRC1 of the first pixel P1 is formed in detail, and it corresponds to the one-scan based pixel structure (equivalent circuit diagram) shown in FIG. 4.

Referring to FIG. 19, in the circuit area CA1 where the driving circuit DRC1 of the first pixel P1 is formed, three transistors of a driving transistor DT, the first transistor T1 and the second transistor T2, and one storage capacitor Cstg are formed.

Further, the second transistor T2 is controlled by a scan signal supplied from a gate line 1900, and receives a data voltage from a data line 1910.

The first transistor T1 is controlled by a scan signal supplied from a gate line 1900, and receives a reference voltage Vref from a pattern 1920 connected with a reference voltage line.

The second transistor T2 is connected with a plate 1950, and the plate 1950 is connected with a gate electrode 1960 of the driving transistor DT by a contact hole.

The driving transistor DT is controlled by a voltage applied to the gate electrode 1960, and receives a driving voltage from the driving voltage EVDD line 1930 through a drain node to thereby output a current through a source node.

Provided that FIG. 19 is designed with an Oxide transistor structure, an active layer 1940 is formed to form a source node of the driving transistor DT and a source node of the first transistor T1, and the active layer 1940 constitutes a storage capacitor Cstg together with the plate 1950 connected with the second transistor T2.

Meanwhile, referring to FIG. 19, a light shield 1970 is formed in the circuit area CA1 of the first pixel P1 in order to protect circuits such as transistors.

Meanwhile, referring to FIG. 19, the extension part IEP1 of the first electrode 1710 of the organic light emitting diode OLED1 of the first pixel P1 is formed in the circuit area CA1. In addition, the extension part EEP2 of the first electrode 1720 of the organic light emitting diode OLED2 of the second pixel P2 is formed in the circuit area CA1 of the first pixel P1.

Referring to FIG. 19, a floating pattern 1711 is formed at the point where the extension part IEP1 of the first electrode 1710 of the organic light emitting diode OLED1 of the first pixel P1 is adjacent to the extension part EEP2 of the first electrode 1720 of the organic light emitting diode OLED2 of the second pixel P2.

This point where the floating pattern 1711 is formed will be described in detail with reference to diagrams (a) and (b) of FIG. 20 taken along the lines A-A' and B-B' in FIG. 19.

Figure 20:
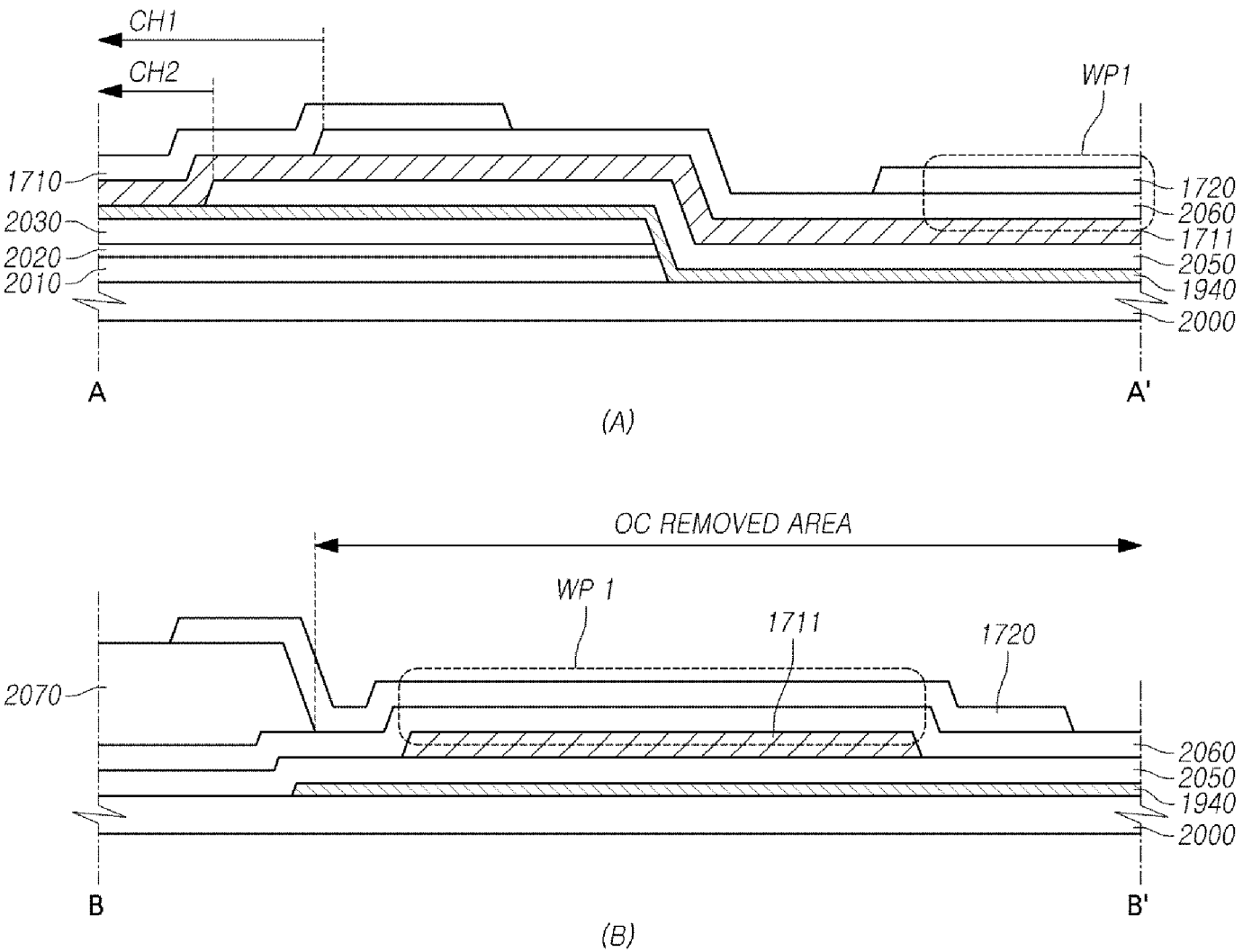
FIG. 20 is a partially detailed sectional view of an organic light emitting display device according to the fourth example embodiment.

Referring to diagram (a) of FIG. 20 that is a sectional view taken along the line A-A', on a substrate 2000, a first buffer 2010, a metal layer 2020 corresponding to the light shield 1970, and a second buffer 2030 are formed around the point A, and the active layer 1940 is formed thereon.

Referring to diagram (a) of FIG. 20, a second insulation layer 2050 is formed on the active layer 1940, and the floating pattern 1711 is formed thereon. At this time, the floating pattern 1711 is connected with the active layer 1940 through a second contact hole CH2.

Here, the active layer 1940 constitutes one electrode of the storage capacitor Cstg and plays a role of a source node N1 of the driving transistor DT. Accordingly, the floating pattern 1711 is connected with the source node N1 of the driving transistor DT in the driving circuit DRC1 of the first pixel P1 and one electrode of the storage capacitor Cstg.

A first insulation layer 2060 is formed on the floating pattern 1711.

The extension part IEP1 of the first electrode 1710 of the organic light emitting diode OLED1 of the first pixel P1 and the extension part EEP2 of the first electrode 1720 of the organic light emitting diode OLED2 of the second pixel P2 are separately formed on the first insulation layer 2060.

At this time, the extension part IEP1 of the first electrode 1710 of the organic light emitting diode OLED1 of the first pixel P1 is connected with the floating pattern 1711 by the first contact hole CH1 that corresponds to a first insulation layer contact hole formed to go through the first insulation layer 2060.

Accordingly, the first electrode 1710 of the organic light emitting diode OLED1 of the first pixel P1 is electrically connected with the floating pattern 1711.

However, the extension part EEP2 of the first electrode 1720 of the organic light emitting diode OLED2 of the second pixel P2 is not connected with the floating pattern 1711 by the first insulation layer 2060.

That is, the floating pattern 1711 is connected with the extension part IEP1 of the first electrode 1710 of the organic light emitting diode OLED1 of the first pixel P1 by the first contact hole CH1, while the floating pattern 1711 is disconnected by the first insulation layer 2060 to be thereby insulated from the first electrode 1720 of the organic light emitting diode OLED2 of the second pixel P2.

This floating pattern 1711 may be formed together with a source or a drain of each transistor and signal lines 1910 and 1930 because it is made of a source-drain material.

Further, the floating pattern 1711 is formed at the point where the storage capacitor Cstg is positioned in the driving circuit DRC1 of the first pixel P1 by being connected with the active layer 1940.

In regard to this, Referring to diagram (b) of FIG. 20 that is a sectional view taken along the lines B-B' in FIG. 19, a protection layer 2070 (also referred to as a over coat layer) is formed in the first layer 2060, and the extension part EEP2 of the first electrode 1720 of the organic light emitting diode OLED2 of the second pixel P2 is formed in an area (OC removed area) where the protection layer 2070 is removed.

Accordingly, referring to diagram (b) of FIG. 20, the first electrode 1720 of the organic light emitting diode OLED2 of the second pixel P2, and the floating pattern 1711 are insulated in the area (OC removed area) where the protection layer 2070 is removed.

Referring to diagram (b) of FIG. 20, in the area (OC removed area) where the protection layer 2070 is removed, the point where the first electrode 1720 of the organic light emitting diode OLED2 of the second pixel P2, and the floating pattern 1711 are insulated may be the welding point WP1.

Referring to diagram (b) of FIG. 20, the floating pattern 1711 is formed the protection layer removed area (OC removed area) in the area (where the active layer 1940 is formed) where the storage capacitor Cstg in the driving circuit DRC1 of the first pixel P1 is positioned.

In the organic light emitting display device 100 having a structure described with reference to FIGS. 18 to 20, a repair process for the circuit defect of the second pixel P2 will be described with reference to FIGS. 21 to 23.

Figure 21:
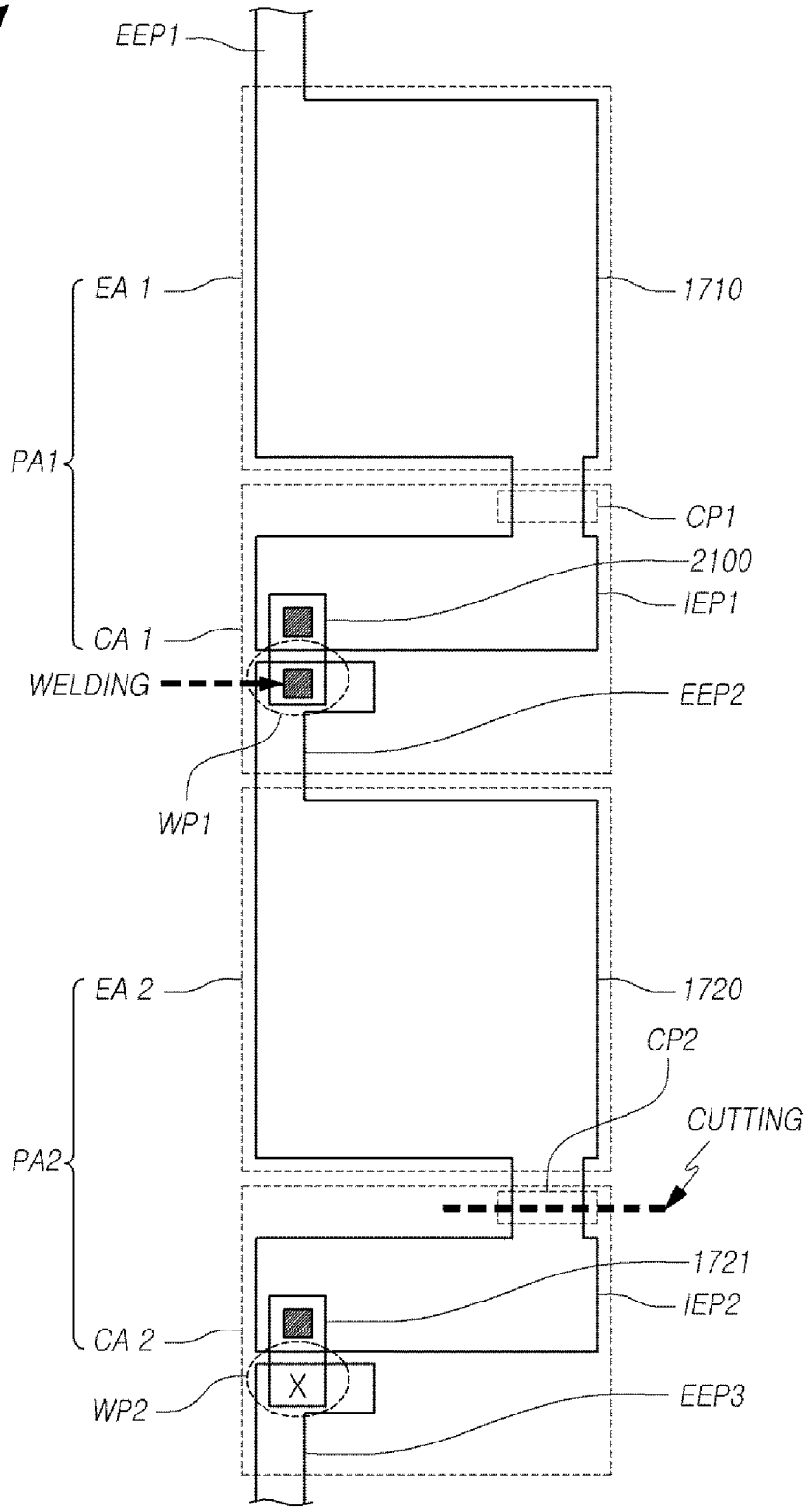
FIG. 21 is a plan view illustrating a repair process of an organic light emitting display device according to the fourth example embodiment.
Figure 22:
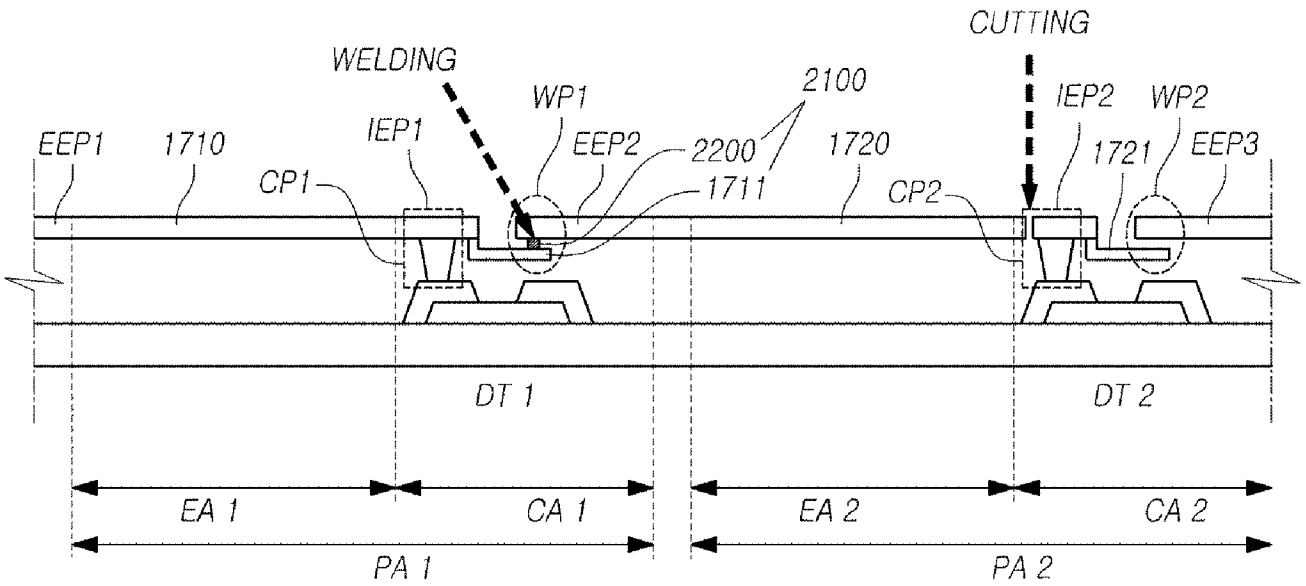
FIG. 22 is a schematic sectional view of an organic light emitting display device after a repair process has been performed according to the fourth example embodiment.
Figure 23:
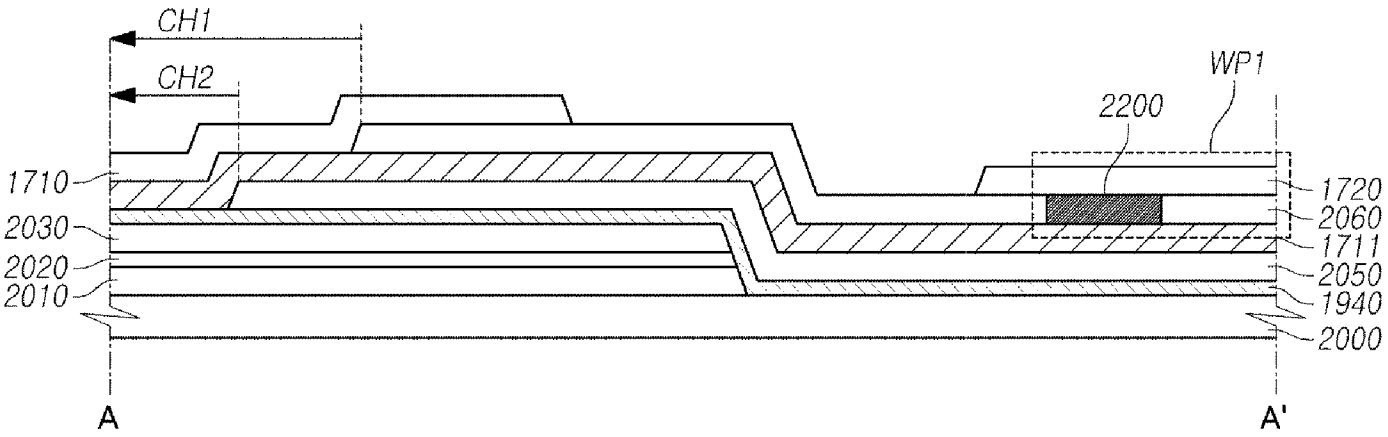
FIG. 23 is a sectional view of an organic light emitting display device after a repair process has been performed according to the fourth example embodiment.

FIGS. 21 to 23 are a plan view and sectional views illustrating a repair process of an organic light emitting display device 100 according to the fourth example embodiment.

Referring to FIGS. 21 to 23, when a circuit defect occurs in the second pixel P2, the extension part IEP2 of the first electrode 1720 of the organic light emitting diode OLED2 of the second pixel P2, which extends to the circuit area CA2, is cut to thereby electrically disconnect the organic light emitting diode OLED2 of the second pixel P2 from the driving transistor DT2.

Referring to FIGS. 21 to 23, the floating pattern 1711 is welded in order to drive the organic light emitting diode OLED2 of the second pixel P2 by the driving circuit DRC1 of the first pixel P1. According to this, the floating pattern 1711 is welded to form a connection pattern 2100. Here, the connection pattern 2100 may be comprised of the floating pattern 1711, and a welding particle 2200 newly made or transformed from a portion of the floating pattern 1711 or the first electrode 1720 by the welding process.

Referring to FIGS. 21 to 23, the connection pattern 2100 connects the extension part EEP2 of the first electrode 1720 of the organic light emitting diode OLED2 of the second pixel P2, which extends to the circuit area CA1 of the first pixel P1, with the extension part IEP1 of the first electrode 1710 of the organic light emitting diode OLED1 of the first pixel P1, which extends to the circuit area CA1 of the first pixel P1, as well as the driving transistor DT1 in the driving circuit DRC1 of the first pixel P1.

Until now, the organic light emitting display device 100 according to the fourth example embodiment having a pixel arrangement {diagram (b) of FIG. 8} in which the circuit area CA1 of the first pixel P1 is adjacent to the emission area EA2 of the second pixel P2 was described.

Hereinafter, an organic light emitting display device 100 according to a fifth example embodiment having a pixel arrangement {diagram (c) of FIG. 8} in which the circuit area CA1 of the first pixel P1 is adjacent to the circuit area CA2 of the second pixel P2 will be described with reference to FIGS. 24 and 25.

Figure 24:
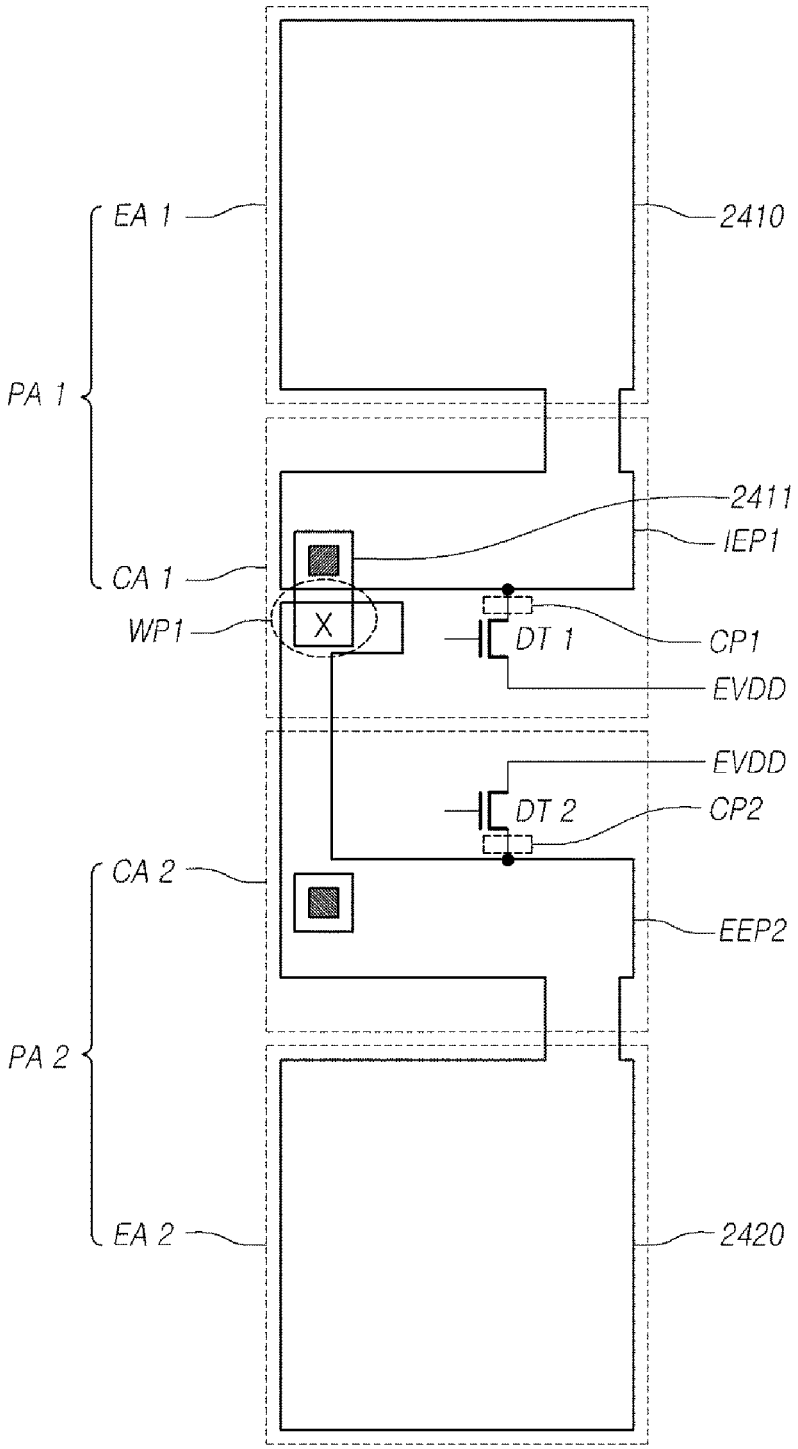
FIG. 24 is a plan view of an organic light emitting display device according to a fifth example embodiment.

FIG. 24 is a plan view of an organic light emitting display device 100 according to the fifth example embodiment.

Referring to FIG. 24, the organic light emitting display device 100 according to the fifth example embodiment has a pixel arrangement in which the circuit area CA1 of the first pixel P1 is adjacent to the circuit area CA2 of the second pixel P2.

As shown in FIG. 24, in the organic light emitting display device 100 according to the fifth example embodiment, the a first electrode 2410 of the organic light emitting diode OLED1 of the first pixel P1 is extended to the circuit area CA1 of the first pixel P1. In addition, a first electrode 2420 of the organic light emitting diode OLED2 of the second pixel P2 is extended through the circuit area CA2 of the second pixel P2 to the circuit area CA1 of the first pixel P1.

That is, in the organic light emitting display device 100 according to the fifth example embodiment, the driving circuit DRC1 of the first pixel P1 is adjacent to the driving circuit DRC2 of the second pixel P2, so the first electrode 2420 of the organic light emitting diode OLED2 of the second pixel P2 may be extended through the circuit area CA2 where the driving circuit DRC2 of the second pixel P2 is disposed to the circuit area CA1 in the pixel area PA1 of the first pixel P1.

In this case, a floating pattern 2411 that is insulated from at least one of the extension part IEP1 of the first electrode 2410 of the organic light emitting diode OLED1 of the first pixel P1, which extends to the circuit area CA1 of the first pixel P1, and the extension part EEP2 of the first electrode 2420 of the organic light emitting diode OLED2 of the second pixel P2, which extends through the circuit area CA2 of the second pixel P2 to the circuit area CA1 of the first pixel P1, may be formed.

In the case of FIG. 24, the floating pattern 2411 is connected with the extension part IEP1 of the first electrode 2410 of the organic light emitting diode OLED1 of the first pixel P1, which extends to the circuit area CA1 of the first pixel P1, by a contact hole, and is insulated from the extension part EEP2 of the first electrode 2420 of the organic light emitting diode OLED2 of the second pixel P2, which extends through the circuit area CA2 of the second pixel P2 to the circuit area CA1 of the first pixel P1, by an insulation layer. This may be similar the floating structure of FIG. 20.

According to the above description, although the floating pattern 2411 is formed in the circuit area CA1 of the first pixel P1, the floating pattern 2411 may be formed in the circuit area CA2 of the second pixel P2. To this end, the first electrode 2410 of the organic light emitting diode OLED1 of the first pixel P1 may be extended through the circuit area CA1 of the first pixel P1 to the circuit area CA2 of the second pixel P2.

A repair process for a circuit defect in the second pixel P2 will be described with reference to FIG. 25.

Figure 25:
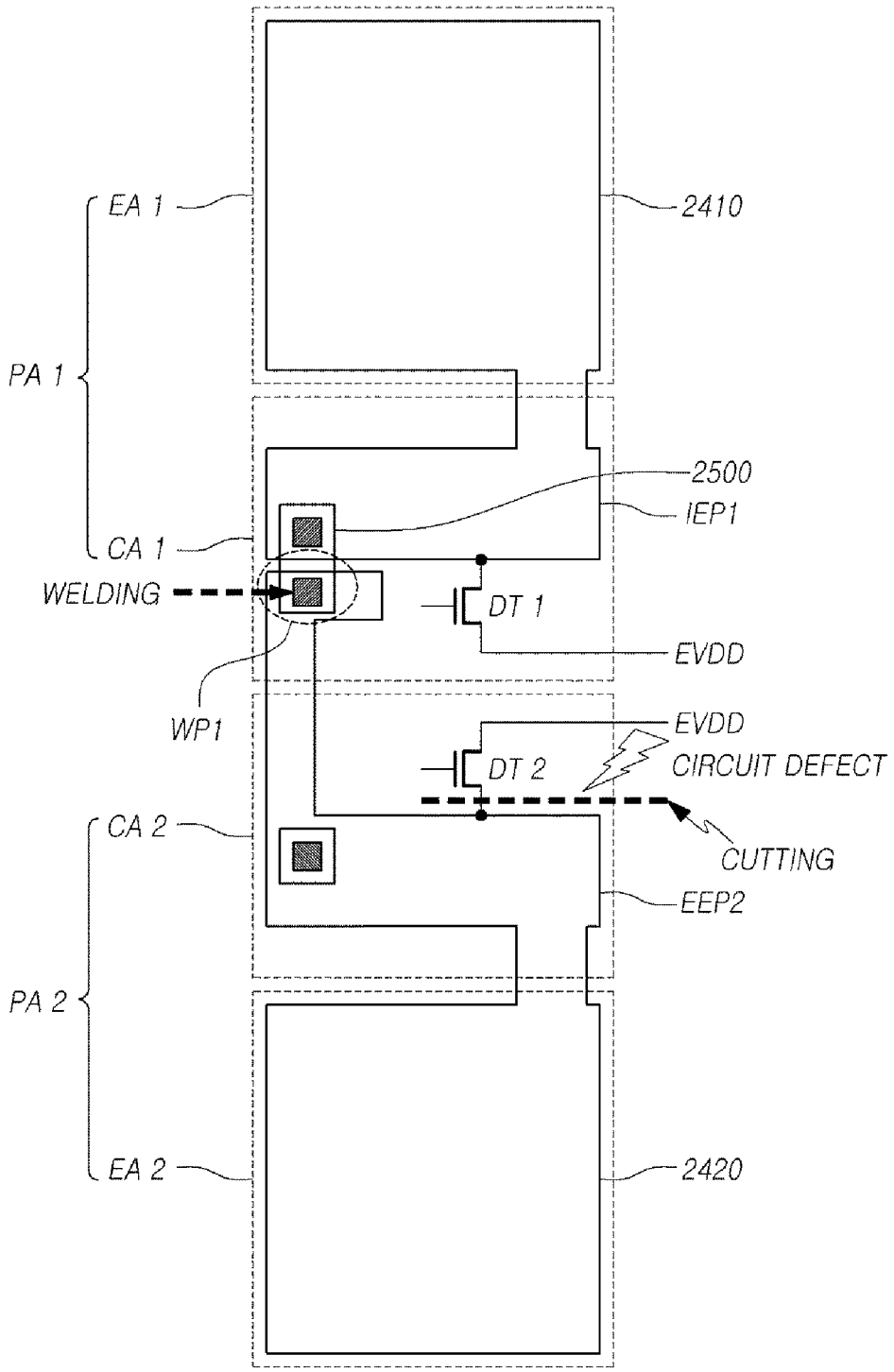
FIG. 25 is a plan view of an organic light emitting display device after a repair process has been performed according to the fifth example embodiment.

FIG. 25 is a plan view after a repair process of an organic light emitting display device 100 according to the fifth example embodiment.

Referring to FIG. 25, after the welding process as a repair process for the circuit defect of the second pixel P2 is performed, the floating pattern 2411 is welded to form a connection pattern 2500.

This connection pattern 2500 connects the extension part IEP1 of the first electrode 2410 of the organic light emitting diode OLED1 of the first pixel P1, which extends to the circuit area CA1 of the first pixel P1, with the extension part EEP2 of the first electrode 2420 of the organic light emitting diode OLED2 of the second pixel P2, which extends through the circuit area CA2 of the second pixel P2 to the circuit area CA1 of the first pixel P1. According to this, the first electrode 2420 of the organic light emitting diode OLED2 of the second pixel P2 is connected with the driving transistor DT1 in the driving circuit DRC1 of the first pixel P1, too.

Referring to FIGS. 24 and 25, in a repair process of a circuit defect of the second pixel P2, the connection between the extension part EEP2 of the first electrode 2420 of the organic light emitting diode OLED2 of the second pixel P2, which extends to the circuit area CA2 of the second pixel P2, and the driving transistor DT2 of the second pixel P2 is processed to be cut, so the first electrode 2420 of the organic light emitting diode OLED2 of the second pixel P2 and the driving circuit DRC2 of the second pixel P2 are electrically disconnected.

Referring to FIG. 25, the cutting point CP2 where the connection between the extension part EEP2 of the first electrode 2420 of the organic light emitting diode OLED2 of the second pixel P2, which extends to the circuit area CA2 of the second pixel P2, and the driving transistor DT2 of the second pixel P2 is cut, may be a source electrode or a drain electrode of the driving transistor DT2 of the second pixel P2.

Until now, the organic light emitting display device 100 according to the fourth example embodiment having a pixel arrangement {diagram (c) of FIG. 8} in which the circuit area CA1 of the first pixel P1 is adjacent to the circuit area CA2 of the second pixel P2 was described.

Meanwhile, every pixel may be disposed in the display panel 110 by using each of the three pixel arrangements as shown in FIG. 8.

When every pixel is disposed in the display panel 110 by repeating the pixel arrangement of diagram (a) of FIG. 8, the pixel arrangement of diagram (c) of FIG. 8 is surely included, too. That is, when the emission area EA1 of the pixel of P1 and the emission area EA2 of the pixel of P2 are adjacent to each other, and the emission area EA3 of the pixel of P3 and the emission area EA4 of the pixel of P4 are adjacent to each other, the pixel of P2 and the pixel of P3 constitute the pixel arrangement of diagram (c) of FIG. 8 in which the circuit areas CA2 and CA3 are adjacent to each other. Likewise, when every pixel is disposed in the display panel 110 by repeating the pixel arrangement of diagram (c) of FIG. 8, the pixel arrangement of diagram (a) of FIG. 8 is surely applied, too. That is, when the circuit area CA1 of the pixel of P1 and the circuit area CA2 of the pixel of P2 are adjacent to each other, and the circuit area CA3 of the pixel of P3 and the circuit area CA4 of the pixel of P4 are adjacent to each other, the pixel of P2 and the pixel of P3 constitute the pixel arrangement of diagram (a) of FIG. 8 in which the emission areas EA2 and EA3 are adjacent to each other.

In addition, pixels may be disposed in the display panel 110 by a combination of the pixel arrangement of diagram (a) of FIG. 8 in which the emission areas are adjacent, and diagram (c) of FIG. 8 in which the circuit areas are adjacent.

Figure 26:
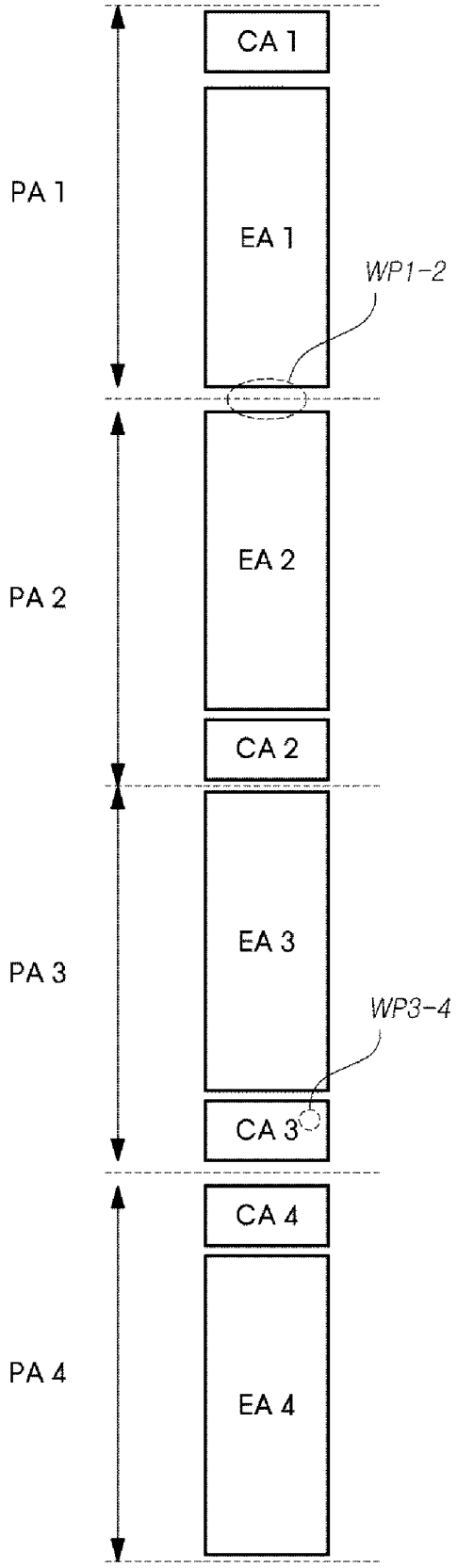
FIG. 26 is a plan view of an organic light emitting display device according to a sixth example embodiment.
Figure 27:
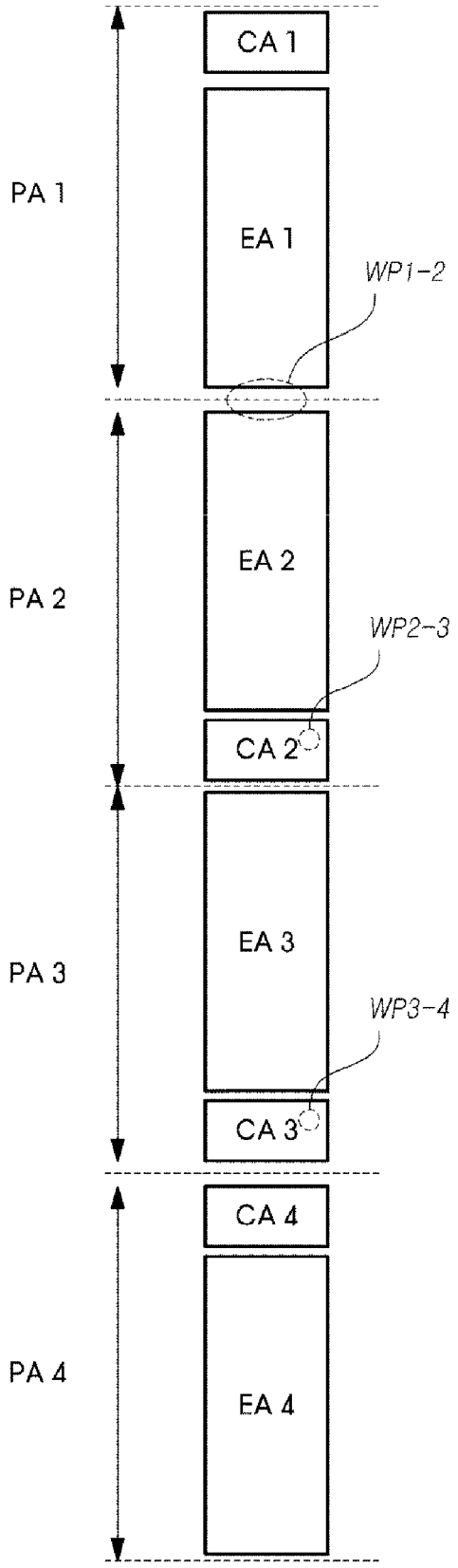
FIG. 27 is a plan view of an organic light emitting display device according to a seventh example embodiment.

These cases will be simply described as a sixth example embodiment and a seventh example embodiment with reference to FIGS. 26 and 27.

FIG. 26 is a plan view of an organic light emitting display device 100 according to the sixth example embodiment.

FIG. 26 shows a pixel arrangement of the organic light emitting display device 100 according to the sixth example embodiment, wherein the emission areas EA1 and EA2 are adjacent to each other between the first pixel P1 and the second pixel P2, and circuit areas CA1 and CA2 are adjacent to each other between the third pixel P3 and the fourth pixel P4.

According to this, in a repair process for a circuit defect of the first pixel P1 or the second pixel P2, in the organic light emitting display device 100 according to the sixth example embodiment, a repair structure (that is the same as that of the second example embodiment) may be formed around the area WP1 and WP2 of the boundary between the emission area EA1 of the first pixel P1 and the emission area EA2 of the second pixel P2.

In the organic light emitting display device 100 according to the sixth example embodiment, as a repair structure for a circuit defect of the first pixel P1 or the second pixel P2, the floating pattern 900 shown in FIGS. 9 to 11 may be formed at the welding points WP1 and WP2.

Alternatively, in the organic light emitting display device 100 according to the sixth example embodiment, according to a repair process for a circuit defect of the first pixel P1 or the second pixel P2, the floating pattern 900 formed at the welding points WP1 and WP2 is welded to thereby form the connection pattern 1200 as shown in FIGS. 12 and 13.

For a repair of a circuit defect of the third pixel P3 or the fourth pixel P4, in the organic light emitting display device 100 according to the sixth example embodiment, a repair structure (that is the same as that of the fifth example embodiment) may be formed in one of the circuit area CA3 of the third pixel P3 and the circuit area CA4 of the fourth pixel P4.

In the organic light emitting display device 100 according to the sixth example embodiment, as a repair structure for a circuit defect of the third pixel P3 or the fourth pixel P4, the floating pattern 2411 shown in FIG. 24 may be formed in the circuit area CA3 of the third pixel P3 or the circuit area CA4 of the fourth pixel P4.

Alternatively, in the organic light emitting display device 100 according to the sixth example embodiment, according to a repair process for a circuit defect of the third pixel P3 or the fourth pixel P4, the floating pattern 2411 formed at the welding points WP3 and WP4 is welded to thereby form the connection pattern 2500 as shown in FIG. 25.

FIG. 27 is a plan view of an organic light emitting display device 100 according to the seventh example embodiment.

Referring to FIG. 27, the organic light emitting display device 100 according to the sixth example embodiment has an pixel arrangement in which the emission areas EA1 and EA2 are adjacent to each other between the first pixel P1 and the second pixel P2, then the circuit area CA2 and the emission area EA3 are adjacent to each other between the second pixel P2 and the third pixel P3, and the circuit areas CA1 and CA2 are adjacent to each other between the third pixel P3 and the fourth pixel P4.

According to this, in a repair process for a circuit defect of the first pixel P1 or the second pixel P2, in the organic light emitting display device 100 according to the seventh example embodiment, a repair structure (that is the same as that of the second embodiment) may be formed around the area WP1 and WP2 of the boundary between the emission area EA1 of the first pixel P1 and the emission area EA2 of the second pixel P2.

In the organic light emitting display device 100 according to the seventh example embodiment, as a repair structure for a circuit defect of the first pixel P1 or the second pixel P2, the floating pattern 900 shown in FIGS. 9 to 11 may be formed at the welding points WP1 and WP2.

Alternatively, in the organic light emitting display device 100 according to the seventh example embodiment, according to a repair process for a circuit defect of the first pixel P1 and the second pixel P2, the floating pattern 900 formed at the welding points WP1 and WP2 is welded to thereby form the connection pattern 1200 as shown in FIGS. 12 and 13.

Meanwhile, in a repair process of a circuit defect of the second pixel P2 and the third pixel P3, in the organic light emitting display device 100 according to the seventh example embodiment, a repair structure (that is the same as that of the fourth example embodiment) may be formed in the circuit area CA2 of the second pixel P2.

In the organic light emitting display device 100 according to the seventh example embodiment, as a repair structure for a circuit defect of the second pixel P2 or the third pixel P3, the floating pattern 1711 shown in FIGS. 17 to 20 may be formed at the welding points WP2 and WP3.

Alternatively, in the organic light emitting display device 100 according to the seventh example embodiment, according to a repair process for a circuit defect of the second pixel P2 or the third pixel P3, the floating pattern 1711 formed at the welding points WP2 and WP3 is welded to thereby form the connection pattern 2100 as shown in FIGS. 21 to 23.

Meanwhile, for a repair of a circuit defect of the third pixel P3 of the fourth pixel P4, in the organic light emitting display device 100 according to the seventh example embodiment, a repair structure (that is the same as that of the fifth example embodiment) may be formed in one of the circuit area CA3 of the third pixel P3 and the circuit area CA4 of the fourth pixel P4.

In the organic light emitting display device 100 according to the seventh example embodiment, as a repair structure for a circuit defect of the third pixel P3 or the fourth pixel P4, the floating pattern 2411 shown in FIG. 24 may be formed in the circuit area CA3 of the third pixel P3 or the circuit area CA4 of the fourth pixel P4.

Alternatively, in the organic light emitting display device 100 according to the seventh example embodiment, according to a repair process for a circuit defect of the third pixel P3 or the fourth pixel P4, the floating pattern 2411 formed at the welding points WP3 and WP4 is welded to thereby form the connection pattern 2500 as shown in FIG. 25.

Until now, the organic light emitting display devices 100 having various repair structures enabling a repair for a circuit defect which is one of the pixel defects, repair methods corresponding to various repair structures, and the organic light emitting display devices 100 repaired according to the same were described.

Hereinafter, an organic light emitting display device 100 having a repair structure enabling a repair for a light emitting defect which is one of the pixel defects, a repair method corresponding to the repair structure, and an organic light emitting display device 100 repaired according to the same will be described for an eighth example embodiment with reference to FIGS. 28 and 29.

Figure 28:
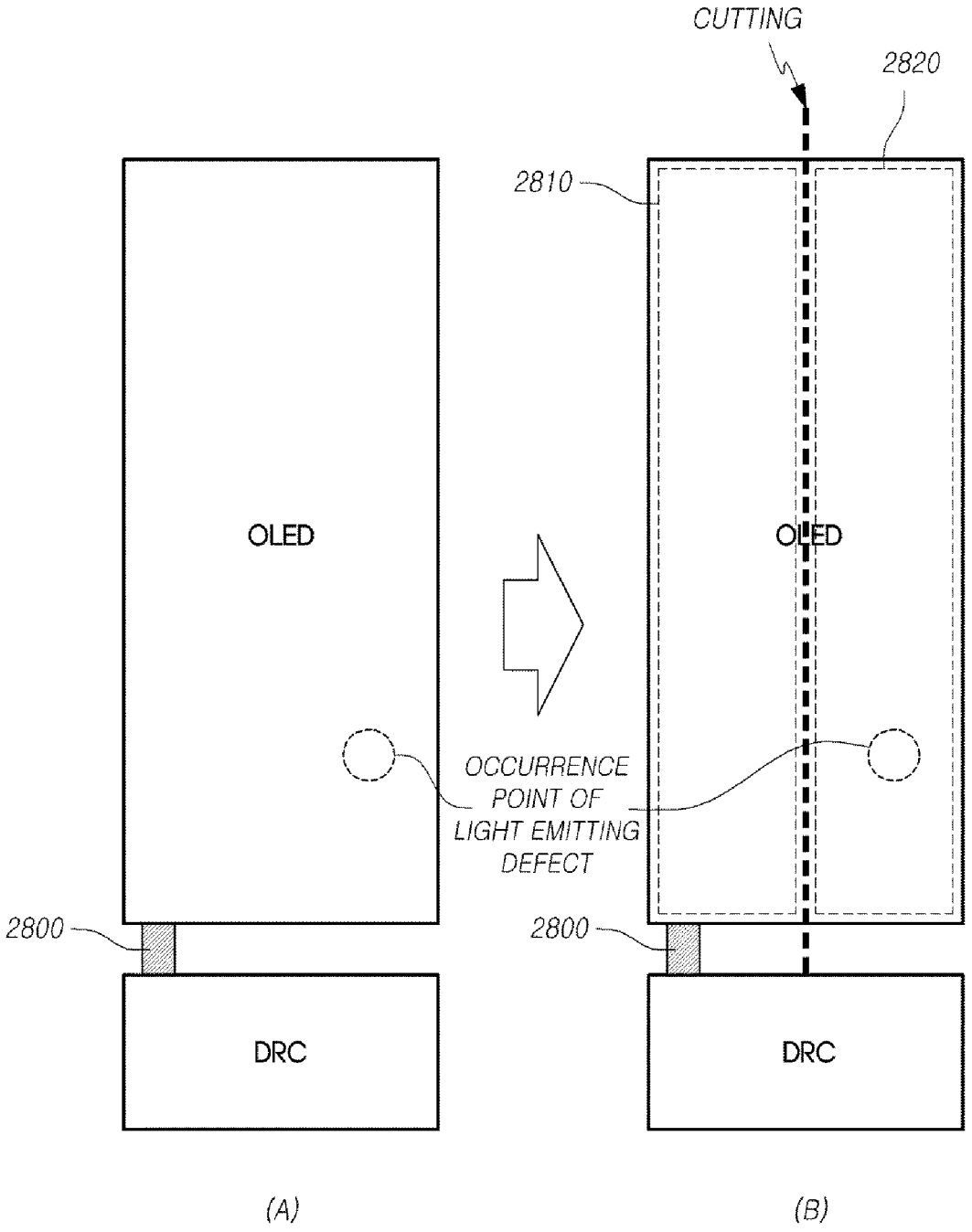
FIGS. 28 and 29 are plan views of an organic light emitting display device after a repair process for a light emitting defect has been performed according to an eighth example embodiment.
Figure 29:
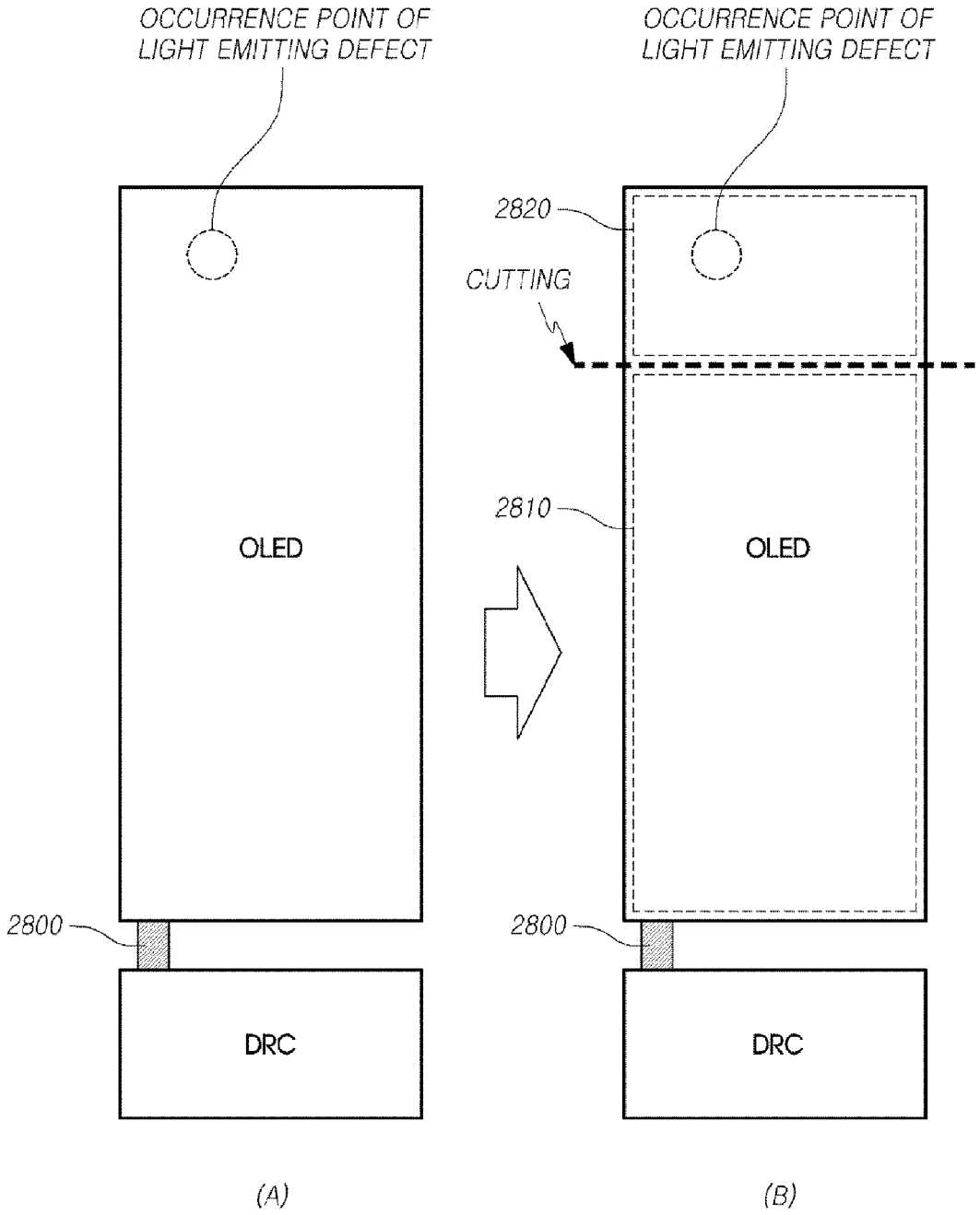

FIGS. 28 and 29 are plan views after a repair process for a light emitting defect of an organic light emitting display device 100 according to the eighth example embodiment.

Referring to FIGS. 28 and 29, each pixel area PA of the organic light emitting display device 100 according to the eighth example embodiment is comprised of an emission area where an organic light emitting diode OLED is disposed, and a circuit area where a driving circuit DRC is disposed.

Meanwhile, a light emitting defect in the emission area may be generated by, for example, a short circuit of both electrodes (anode and cathode) of the organic light emitting diode OLED by impurities in processing, or a failure of at least one of both electrodes (anode and cathode) of the organic light emitting diode OLED. Addition to this, the light emitting defect may be generated by any unexpected cause.

The state in which the organic light emitting diode OLED does not normally emit light is regarded as a light emitting defect.

When the light emitting defect occurs, as shown in diagram (b) of FIG. 28 and diagram (b) of FIG. 29, the occurrence point of the light emitting defect in the first electrode of the organic light emitting diode OLED may be cut away.

At this time, the cutting process is performed to split a connection point 2800 between the organic light emitting diode OLED and the driving circuit DRC, and the occurrence point of the light emitting defect into different areas 2810 and 2820, respectively.

According to this cutting process, the area 2810, which the connection point 2800 between the organic light emitting diode OLED and the driving circuit DRC belongs to, may be an emission area for emitting light after the cutting process, while the occurrence area 2820 of the light emitting defect, which was an emission area EA before the cutting process, may be disconnected from the circuit after the cutting process, to be thereby no emission area.

Figure 30:
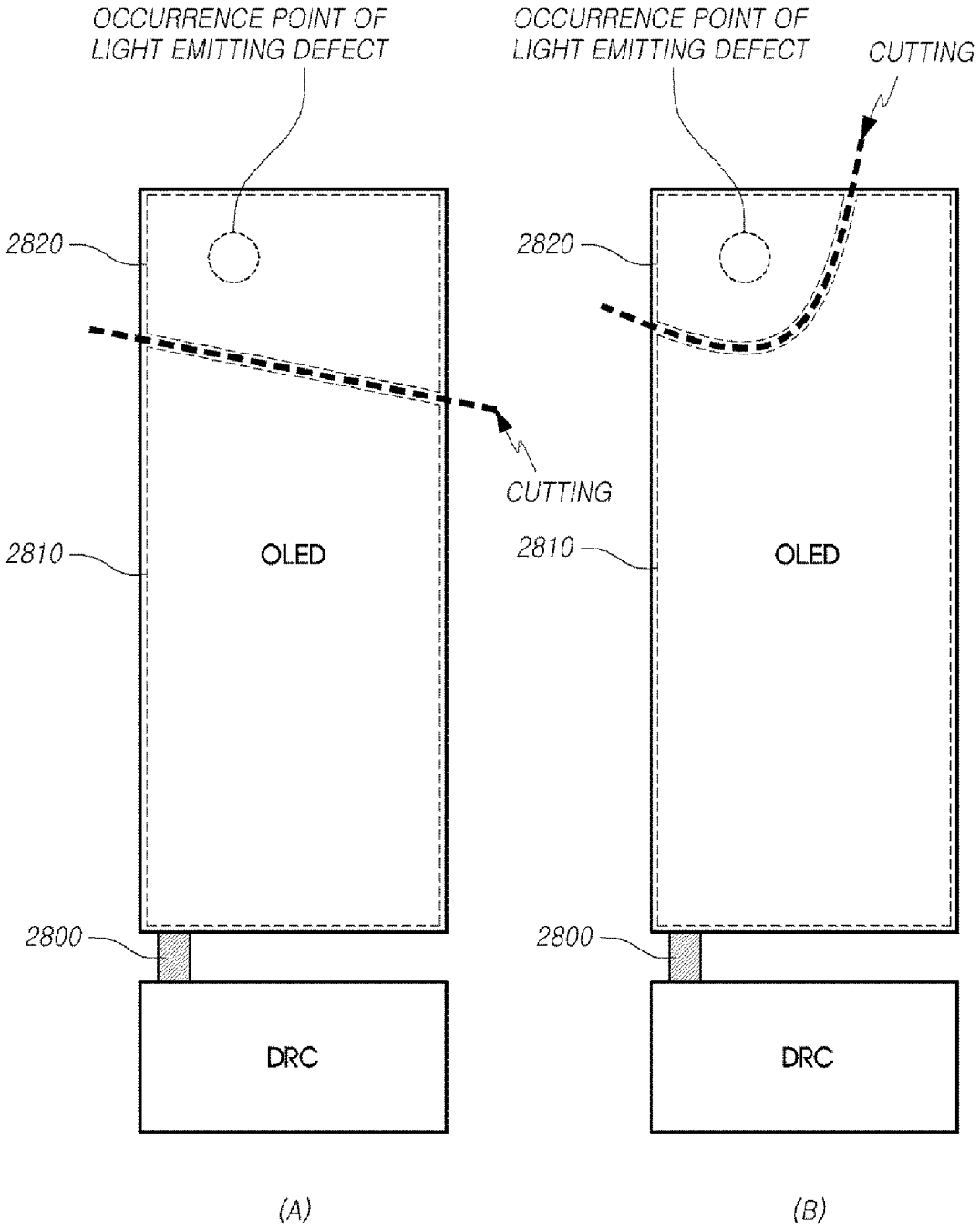
FIG. 30 illustrates an example of a cutting line upon a repair process for a light emitting defect of an organic light emitting display device according to the eighth example embodiment.

Although the cutting lines shown in FIGS. 28 and 29 are longitudinally linear or laterally linear, the cutting lines may be diagonally linear or curved as shown in FIG. 30 as long as the cutting process is made to split the connection point 2800 between the organic light emitting diode OLED and the driving circuit DRC, and the occurrence point of the light emitting defect into different areas 2810 and 2820, respectively.

Figure 31:
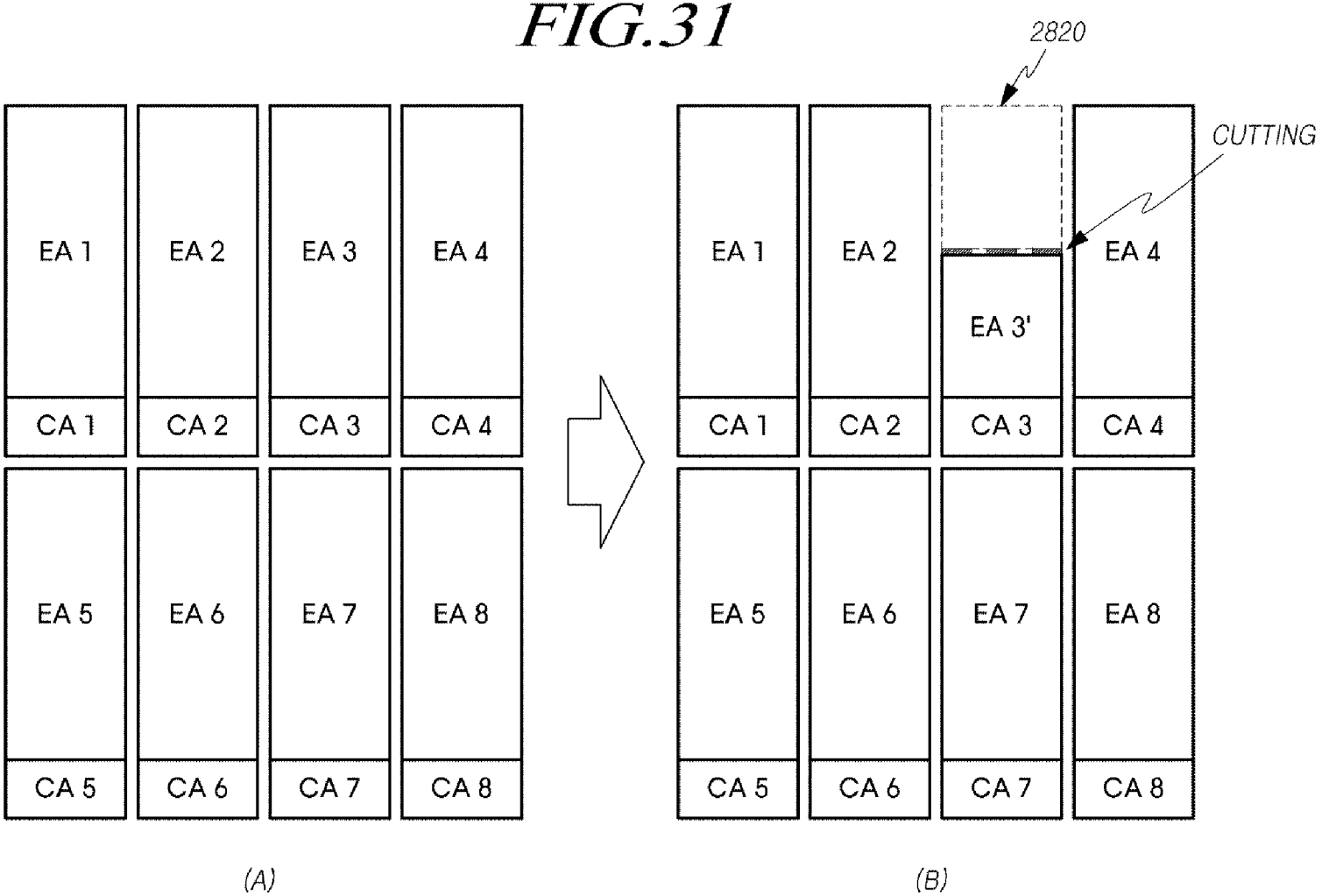
FIG. 31 illustrates a reduction of an emission area after a repair process for a light emitting defect in an organic light emitting display device according to the eighth example embodiment.

FIG. 31 illustrates a reduction of an emission area after a repair process for a light emitting defect in an organic light emitting display device 100 according to the eighth example embodiment.

Diagram (a) of FIG. 31 conceptually illustrates a display panel 110 whose pixels have no light emitting defects. Diagram (b) of FIG. 31 conceptually illustrates a display panel 110 in which a light emitting defect of one pixel is repaired.

Referring to diagram (a) of FIG. 31, each pixel P1 to P8 defined in the display panel 110 is divided into an emission area EA1 to EA8 and a non-emission area CA1 to CA8. For the convenience of explanation, it is assumed that each emission area EA1 to EA8 of the pixels has the same size.

Referring to diagram (b) of FIG. 31, a light emitting defect occurs in the emission area EA3 of the third pixel P3, and the area 2820 where the light emitting defect occurs is cut away to be repaired. Accordingly, the remaining emission area EA3' for actually emitting light in the third pixel P3 has been decreased in an area as much as the cut area 2820.

Accordingly, when the repair process is made to the light emitting defect, there may be at least one pixel in which the first electrode (e.g., anode or cathode) of the organic light emitting diode OLED is cut to thereby have an emission area of a different size. Particularly, in the display panel 110, there may be at least one pixel in which the first electrode of the organic light emitting diode OLED is cut to thereby have an emission area smaller than emission areas of other pixels for emitting light of the same color.

Meanwhile, the repair process for a circuit defect refers to a process to allow a driving circuit of a normal pixel to drive an organic light emitting diode of a faulty pixel having a circuit defect.

If there is at least one pixel with a repaired circuit defect, the display panel 110 may have at least one driving circuit that drives two or more organic light emitting diodes disposed in different pixels in parallel.

Meanwhile, when a light emitting defect occurs in an organic light emitting diode not having a circuit defect, that is, when a pixel with a circuit defect and a pixel with a light emitting defect are adjacent to each other, a driving circuit in the pixel not having a circuit defect may drive only the organic light emitting diode of the pixel having a circuit defect. An example of this will be described as a ninth example embodiment with reference to FIG. 32.

Figure 32:
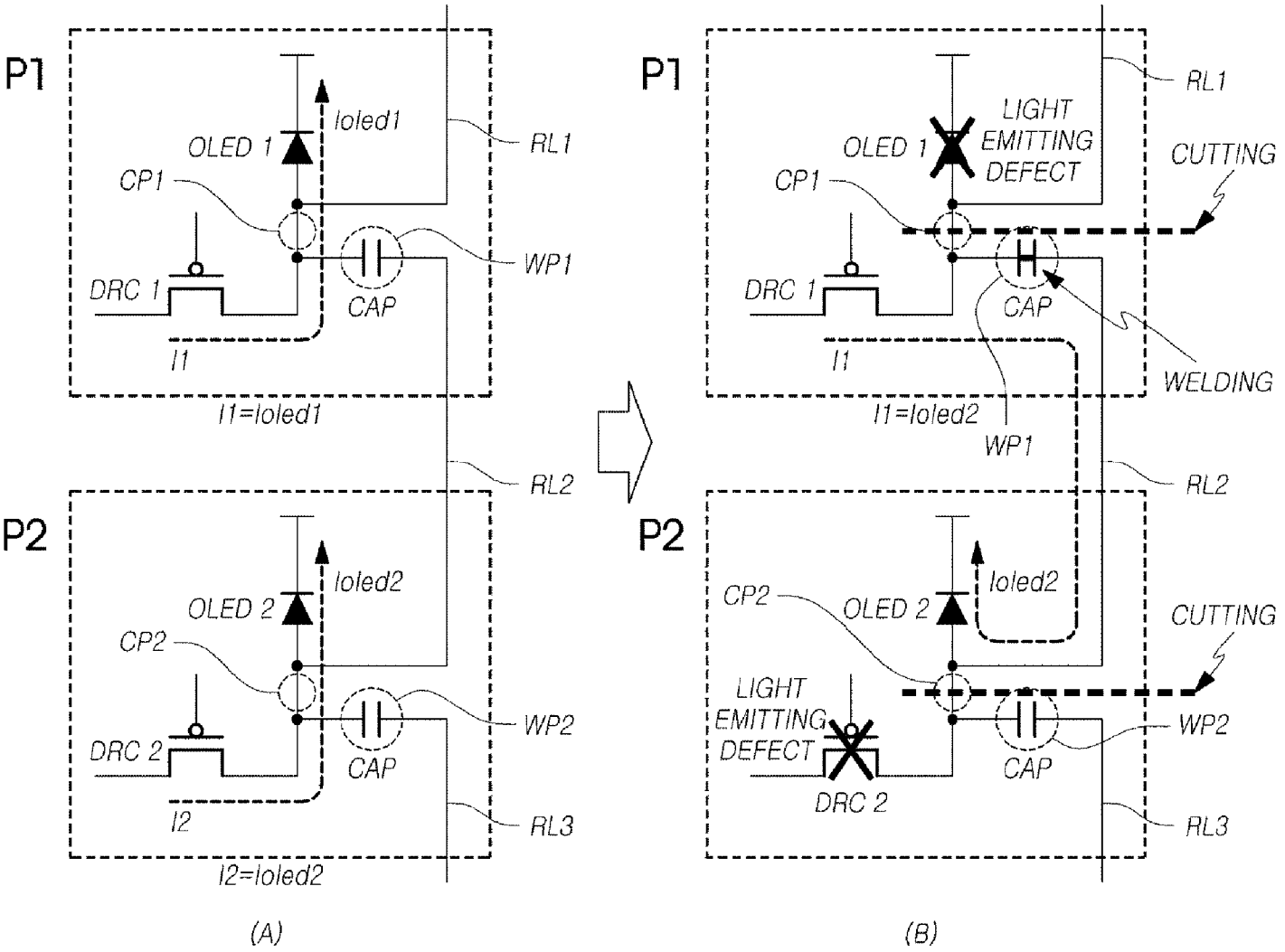
FIG. 32 is a conceptual diagram of a repair for a cross defect of an organic light emitting display device according to a ninth example embodiment.

FIG. 32 is a conceptual diagram of a repair for a cross defect of an organic light emitting display device 100 according to the ninth example embodiment.

Diagram (a) of FIG. 32 illustrates a case in which every pixel is normal, wherein the driving circuit DRC1 of the first pixel P1 drives the organic light emitting diode OLED1 of the first pixel P1, and the driving circuit DRC2 of the second pixel P2 drives the organic light emitting diode OLED2 of the second pixel P2.

As shown in diagram (b) of FIG. 32, it may happen that a light emitting defect occurs in the organic light emitting diode OLED1 of the first pixel P1, and a circuit defect occurs in the driving circuit DRC2 of the second pixel P2. Like this, if different pixel defects occur in different pixels, respectively, such a pixel defect is referred to as a cross pixel defect.

In a case of a cross pixel defect, the connection point CP1 between the organic light emitting diode OLED1 of the first pixel P1 having a light emitting defect and the driving circuit DRC1 is cut, and the connection point CP2 between the organic light emitting diode OLED2 of the second pixel P2 having a circuit defect and the driving circuit DRC2 is cut.

In addition, a capacitor that is pre-formed at the welding point WP1 is welded to thereby electrically connect the driving circuit DRC1 of the first pixel P1 with the organic light emitting diode OLED2 of the second pixel P2.

According to this, the driving circuit DRC1 of the first pixel P1 drives only the organic light emitting diode OLED2 of the second pixel P2.

If the cross pixel defect is not repaired, the first pixel P1 and the second pixel P2 may be a bright spot or a dark spot to thereby badly degrade an image quality or cause the display panel 110 to be discarded during the manufacturing process. However, by repairing the cross pixel defect, an emission area of at least one pixel may emit light, so the worst case scenario may be prevented.

If there is a pair of pixels which are repaired for a cross pixel defect, the organic light emitting display device 100 according to the ninth example embodiment may have at least one organic light emitting diode OLED2 that receives a current the driving circuit DRC1 disposed other pixel.

Meanwhile, when the repair process for a circuit defect is performed as described above, the brightness is decreased compared to before the repair.

That is, once the repair process for a circuit defect is made, since a current output from the driving circuit DRC is divided to flow into two organic light emitting diodes, the current of each organic light emitting diode is reduced by a half, so the brightness is decreased in two pixels related to the repair process.

Accordingly, in the specification, an organic light emitting display device 100 according to the tenth example embodiment to compensate for a reduction of brightness of a pixel that has been repaired for a circuit defect will be disclosed. The organic light emitting display device 100 according to the tenth example embodiment will be described with reference to FIG. 33.

Hereinafter, in relation to the compensation for the brightness, it is assumed that the second pixel P2 has been repaired for a circuit defect. Accordingly, it is also assumed that the driving circuit DRC1 of the first pixel P1 drives the organic light emitting diode OLED1 of the first pixel P1 and the organic light emitting diode OLED2 of the second pixel P2 in parallel.

Hereinafter, in relation to the compensation for the brightness, it is assumed that a pixel structure is a one-scan based pixel structure as shown in FIG. 4. Furthermore, the compensation for the brightness described below may be applied to a two-scan based pixel structure in FIG. 3.

Figure 33:
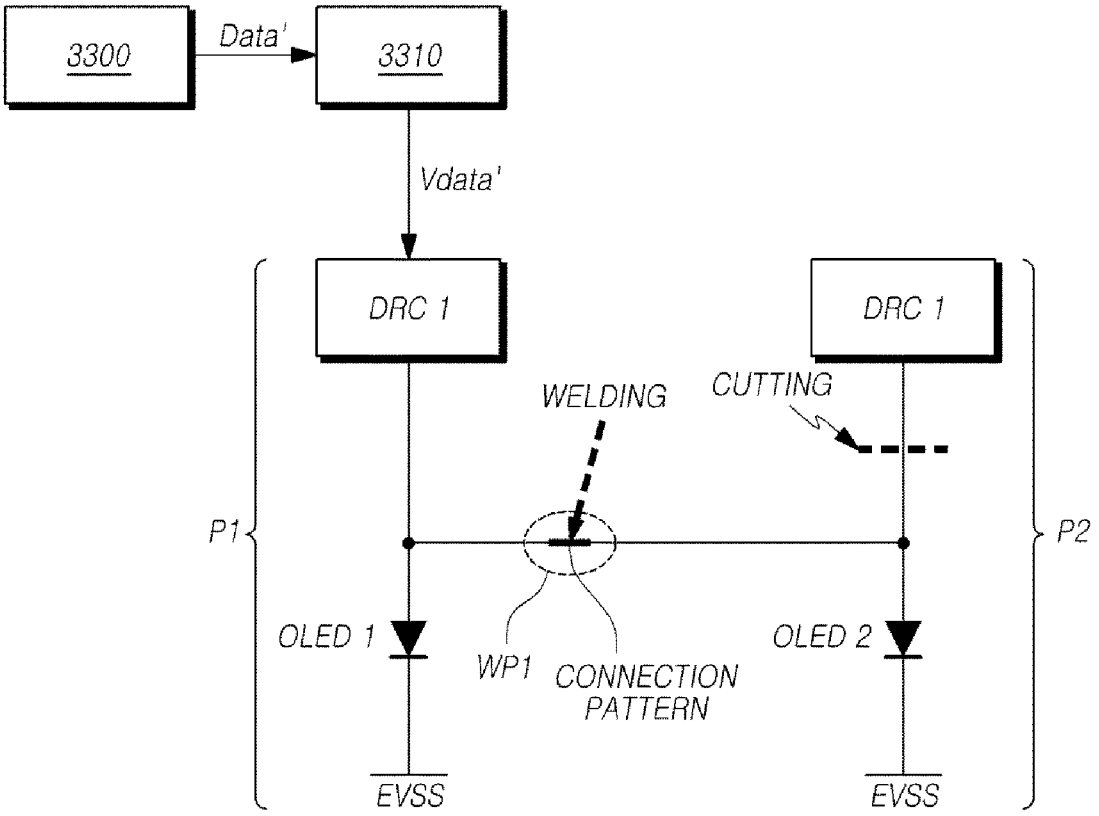
FIG. 33 is a circuit diagram for a brightness compensation of an organic light emitting display device according to a tenth example embodiment.

FIG. 33 is a circuit diagram for a brightness compensation of an organic light emitting display device 100 according to the tenth example embodiment.

Referring to FIG. 33, in the organic light emitting display device 100 according to the tenth example embodiment, the second pixel P2's circuit defect has been repaired.

Referring to FIG. 33, in the organic light emitting display device 100 according to the tenth example embodiment, the driving circuit DRC1 of the first pixel P1 supplies a current to the organic light emitting diode OLED1 of the first pixel P1 and the organic light emitting diode OLED2 of the second pixel P2 in parallel.

Accordingly, the amount of current, that each of the organic light emitting diode OLED1 of the first pixel P1 and the organic light emitting diode OLED2 of the second pixel P2 receives, is less than that required to emit a desired intensity of light.

This results in a reduction of the brightness of the first pixel P1 and the second pixel P2.

Accordingly, as shown in FIG. 33, when the second pixel P2's circuit defect has been repaired, that is, when the connection pattern for electrically connecting the first electrode of the organic light emitting diode OLED1 of the first pixel P1 and the first electrode of the organic light emitting diode OLED2 of the second pixel P2 is formed, the organic light emitting display device 100 according to the tenth example embodiment may include a compensation unit 3300 to compensate for the brightness in each of the first pixel P1 and the second pixel P2. Here, the connection pattern is formed by welding the welding pattern formed at the welding point WP.

Such a compensation unit 3300 determines the amount of data compensation by which the driving circuit DRC1 of the first pixel P1 outputs a current having a value larger than a value of a current corresponding to a predetermined brightness.

Accordingly, the compensation unit 3300 transfers compensation data Data' generated according to the amount of determined data compensation or the amount of determined data compensation to a data driver integrated circuit 3310 in a data driving unit 120.

The data driver integrated circuit 3310 supplies a compensation data voltage Vdata' corresponding to the received compensation data Data' or the amount of data compensation to the driving circuit DRC1 of the first pixel P1 through a corresponding data line.

Meanwhile, in the organic light emitting display device 100 according to the tenth example embodiment, information on pixels which have been repaired may be pre-stored in a memory (not shown), and may be used when compensating for the brightness.

The compensation unit 3300 may be included in a timing controller 140 or the data driving unit 120, or may be separately provided outside the timing controller 140 and the data driving unit 120.

As described above, according to the present invention, the present invention has an effect of providing an organic light emitting display device 100 having a repair structure by which pixel defects can be repaired, and an organic light emitting display device 100 whose pixel defects have been repaired.

In addition, the present invention has an effect of providing an organic light emitting display device 100 that has a repair structure by which a circuit defect among the causes of the pixel defects can be repaired, and an organic light emitting display device 100 in which a circuit defect has been repaired.

Further, the present invention has an effect of providing an organic light emitting display device 100 that has a repair structure by which a light emitting defect among the causes of the pixel defects can be repaired, and an organic light emitting display device 100 in which a light emitting defect has been repaired.

Further, the present invention has an effect of providing an organic light emitting display device 100 that enables to compensate for the brightness loss due to a repair for a circuit defect.

It will be apparent to those skilled in the art that various modifications and variations can be made in the organic light emitting display device of the present invention without departing from the spirit or scope of the invention. Thus, it is intended that the present invention cover the modifications and variations of this invention provided they come within the scope of the appended claims and their equivalents.

What is claimed is:

1. An organic light emitting display device, comprising:

a display panel including a plurality of pixels defined with data lines and gate lines, wherein the plurality of pixels include at least a first pixel and a second pixel each comprising an organic light emitting diode and a driving circuit;

a data driving circuit configured to supply a data voltage to the data lines;

a gate driving circuit configured to supply a scan signal to the gate lines; and a floating pattern overlapping with a first electrode of the organic light emitting diode of the first pixel and with a first electrode of the organic light emitting diode of the second pixel, and electrically insulated from at least one of the first electrode of the organic light emitting diode of the first pixel and the first electrode of the organic light emitting diode of the second pixel.

2. The device as claimed in claim 1, wherein the first pixel and the second pixel each include an emission area in which the respective organic light emitting diode is disposed and a circuit area in which the respective driving circuit is disposed, and wherein the floating pattern is disposed at a boundary between the emission area of the first pixel and the emission area of the second pixel, or disposed in the circuit area of the first pixel or in the circuit area of the second pixel.

3. The device as claimed in claim 1, wherein the first pixel and the second pixel each have a respective pixel area including an emission area in which the respective organic light emitting diode is disposed and a circuit area in which the respective driving circuit is disposed, and wherein the emission area of the first pixel and the emission area of the second pixel are adjacent to each other, or the circuit area of the first pixel and the emission area of the second pixel are adjacent to each other, or the circuit area of the first pixel and the circuit area of the second pixel are adjacent to each other.

4. The device as claimed in claim 3, wherein the first electrode of the organic light emitting diode of the second pixel extends to the pixel area of the first pixel, and wherein the floating pattern is disposed where the first electrode of the organic light emitting diode of the first pixel and the first electrode of the organic light emitting diode of the second pixel are adjacent to each other in the pixel area of the first pixel.

5. The device as claimed in claim 4, wherein the floating pattern is connected with the first electrode of the organic light emitting diode of the first pixel by a first contact hole through a first insulation layer, and is electrically insulated from the first electrode of the organic light emitting diode of the second pixel.

6. The device as claimed in claim 4, wherein the floating pattern is made of a source-drain material.

7. The device as claimed in claim 4, further comprising a protection layer over a portion of the circuit area of the first pixel, wherein the floating pattern is disposed at a portion of the circuit area of the first pixel not covered by the protection layer and where a storage capacitor is formed.

8. The device as claimed in claim 3, wherein:

the circuit area of the first pixel and the circuit area of the second pixel are adjacent to each other, the first electrode of the organic light emitting diode of the second pixel extends through the circuit area of the second pixel to the circuit area of the first pixel, and the floating pattern is disposed in the circuit area of the first pixel.

9. The device as claimed in claim 3, wherein the emission area of the first pixel and the emission area of the second pixel are adjacent to each other, and wherein the floating pattern is formed to overlap with the emission areas of both the first pixel and the second pixel.

10. The device as claimed in claim 1, wherein the floating pattern is formed from one or both of a gate layer and a source-drain layer.

11. The device as claimed in claim 1, further comprising:

a connection pattern electrically connecting the first electrode of the organic light emitting diode of the first pixel with the first electrode of the organic light emitting diode of the second pixel.

12. The device as claimed in claim 11, wherein the first electrode of the organic light emitting diode of the first pixel or of the second pixel is cut into a first part electrically connected with the connection pattern and a second part electrically disconnected from the connection pattern.

13. The device as claimed in claim 12, wherein the cut first electrode of the organic light emitting diode of the first pixel or of the second pixel is linearly cut in a longitudinal direction, a lateral direction, or a diagonal direction, or cut in a curved direction.

14. The device as claimed in claim 1, further comprising:

a repair line having a first end connected with the first electrode of the organic light emitting diode of the first pixel, and a second end connected with the first electrode of the organic light emitting diode of the second pixel and disconnected from the first end at a disconnection point, wherein the floating pattern is disposed at the disconnection point.

15. The device as claimed in claim 1, wherein the first pixel and the second pixel are same colored pixels.

16. The device of claim 1, further comprising:

another floating pattern overlapping with the first electrode of the organic light emitting diode of the first pixel and with the first electrode of the organic light emitting diode of the second pixel, and electrically insulated from at least one of the first electrode of the organic light emitting diode of the first pixel and the first electrode of the organic light emitting diode of the second pixel.

17. The device as claimed in claim 1, further comprising:

a compensation circuit configured to determine an amount of data voltage compensation to allow the driving circuit of the first pixel or the second pixel to output a current having a value larger than a value of a current corresponding to a predetermined brightness.

18. The device as claimed in claim 1, wherein the floating pattern is electrically connected to one of the first electrode of the organic light emitting diode of the first pixel and the first electrode of the organic light emitting diode of the second pixel, and is electrically insulated from the other of the first electrode of the organic light emitting diode of the first pixel and the first electrode of the organic light emitting diode of the second pixel.

19. An organic light emitting display device, comprising:

a display panel including a plurality of pixels defined with data lines and gate lines, wherein the plurality of pixels include at least a first pixel and a second pixel each comprising an organic light emitting diode and a driving circuit;

a data driving circuit configured to supply a data voltage to the data lines;

a gate driving circuit configured to supply a scan signal to the gate lines; and a connection pattern electrically connecting a first electrode of the organic light emitting diode of the first pixel with a first electrode of the organic light emitting diode of the second pixel, wherein the connection pattern is welded to one or both of the first electrode of the organic light emitting diode of the first pixel and the first electrode of the organic light emitting diode of the second pixel through a laser welding process.

20. The device as claimed in claim 19, wherein the first electrode of the organic light emitting diode of the first pixel is electrically disconnected from the driving circuit of the first pixel.

21. The device as claimed in claim 20, wherein a connection point between the first electrode of the organic light emitting diode of the first pixel and the driving circuit of the first pixel is cut, the first electrode of the organic light emitting diode of the first pixel is cut, or one of a source electrode and a drain electrode of a driving transistor in the driving circuit of the first pixel is cut.

22. The device as claimed in claim 20, wherein the first electrode of the organic light emitting diode of the first pixel includes an extension part extending to the driving circuit of the first pixel, and wherein the extension part is cut.

23. The device as claimed in claim 20, wherein the driving circuit of the second pixel is configured to drive the organic light emitting diode of the first pixel and the organic light emitting diode of the second pixel in parallel through the connection pattern.

24. The device as claimed in claim 19, further comprising:

a compensation circuit configured to determine an amount of data voltage compensation to allow the driving circuit of the first pixel or the second pixel to output a current having a value larger than a value of a current corresponding to a predetermined brightness.

25. The device as claimed in claim 19, further comprising a floating pattern, wherein:

the plurality of pixels further include a third pixel and a fourth pixel each comprising an organic light emitting diode and a driving circuit, and the floating pattern overlaps with a first electrode of the organic light emitting diode of the third pixel and with a first electrode of the organic light emitting diode of the fourth pixel, and is electrically insulated from at least one of the first electrode of the organic light emitting diode of the third pixel and the first electrode of the organic light emitting diode of the fourth pixel.

* * * * *